US007651392B2

(12) United States Patent
Pennington et al.

(10) Patent No.: US 7,651,392 B2
(45) Date of Patent: Jan. 26, 2010

(54) GAMING DEVICE SYSTEM HAVING PARTIAL PROGRESSIVE PAYOUT

(75) Inventors: Richard M. Pennington, Reno, NV (US); Binh T. Nguyen, Reno, NV (US); Richard E. Michaelson, Reno, NV (US); Craig A. Paulsen, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 285 days.

(21) Appl. No.: 11/221,266

(22) Filed: Sep. 7, 2005

(65) Prior Publication Data

US 2006/0025195 A1 Feb. 2, 2006

Related U.S. Application Data

(63) Continuation-in-part of application No. 10/769,086, filed on Jan. 29, 2004, now Pat. No. 7,354,342, which is a continuation-in-part of application No. 10/630,529, filed on Jul. 30, 2003.

(51) Int. Cl.
*A63F 9/24* (2006.01)

(52) U.S. Cl. ..... 463/16; 463/17; 463/25; 463/26; 463/27

(58) Field of Classification Search ..... 463/16–17, 463/25–27; 273/142 H, 142 R
See application file for complete search history.

(56) References Cited

U.S. PATENT DOCUMENTS

| | | | |
|---|---|---|---|
| 1,527,929 | A | 2/1925 | Simons |
| 2,095,367 | A | 10/1937 | Mattson |
| 2,283,583 | A | 5/1942 | Henry |
| 2,565,557 | A | 8/1951 | Guimond |
| 3,642,287 | A | 2/1972 | Lally et al. |
| 3,645,531 | A | 2/1972 | Wright |
| 3,804,419 | A | 4/1974 | Jackson |
| 3,817,532 | A | 6/1974 | Lee |
| 4,077,631 | A | 3/1978 | Tela, Sr. |
| 4,198,052 | A | 4/1980 | Gauselmann |
| 4,335,809 | A | 6/1982 | Wain |
| 4,448,419 | A | 5/1984 | Telnaes |
| 4,492,378 | A | 1/1985 | Williams |
| 4,508,357 | A | 4/1985 | Reich |

(Continued)

FOREIGN PATENT DOCUMENTS

AU 199717601 B2 9/1997

(Continued)

OTHER PUBLICATIONS

A Vamp for All Seasons Article (IGT), written by Strictly Slots, published in 2002.

(Continued)

*Primary Examiner*—Corbett B Coburn
*Assistant Examiner*—David Duffy
(74) *Attorney, Agent, or Firm*—K&L Gates LLP

(57) ABSTRACT

A gaming system includes a first gaming device, a second gaming device and an outcome display shared by the first and second gaming devices. The outcome display includes multiple symbols, the symbols in combination with an available amount defining mathematically a portion of the available amount to be provided to a player playing one of the gaming devices.

29 Claims, 35 Drawing Sheets

U.S. PATENT DOCUMENTS

| | | | |
|---|---|---|---|
| 4,509,754 | A | 4/1985 | Remmler et al. |
| 4,560,161 | A | 12/1985 | Hamano |
| 4,582,324 | A | 4/1986 | Koza et al. |
| 4,614,342 | A | 9/1986 | Takashima |
| 4,624,459 | A | 11/1986 | Kaufman |
| 4,674,748 | A | 6/1987 | Wismer |
| 4,678,191 | A | 7/1987 | Mills et al. |
| 4,695,053 | A | 9/1987 | Vazquez, Jr. et al. |
| 4,775,155 | A | 10/1988 | Lees |
| 4,805,907 | A | 2/1989 | Hagiwara |
| 4,837,728 | A | 6/1989 | Barrie et al. |
| 4,838,552 | A | 6/1989 | Hagiwara |
| 4,976,438 | A | 12/1990 | Tashiro et al. |
| 4,991,848 | A | 2/1991 | Greenwood et al. |
| 5,046,736 | A | 9/1991 | Bridgeman et al. |
| 5,083,800 | A | 1/1992 | Lockton |
| 5,085,436 | A | 2/1992 | Bennett |
| 5,096,196 | A | 3/1992 | Gutknecht et al. |
| 5,102,134 | A | 4/1992 | Smyth |
| 5,116,055 | A | 5/1992 | Tracy |
| 5,118,110 | A | 6/1992 | Jones |
| 5,120,060 | A | 6/1992 | Parker et al. |
| 5,167,413 | A | 12/1992 | Fulton |
| 5,178,390 | A | 1/1993 | Okada |
| 5,188,363 | A | 2/1993 | Marnell, II et al. |
| 5,205,555 | A | 4/1993 | Hamano |
| 5,221,083 | A | 6/1993 | Dote |
| 5,232,222 | A | 8/1993 | Deutch |
| 5,242,163 | A | 9/1993 | Fulton |
| D344,296 | S | 2/1994 | McKay et al. |
| 5,292,127 | A | 3/1994 | Kelly et al. |
| 5,308,065 | A | 5/1994 | Bridgeman et al. |
| 5,324,041 | A | 6/1994 | Boylan et al. |
| 5,332,228 | A | 7/1994 | Schultz |
| 5,342,047 | A | 8/1994 | Heidel et al. |
| 5,393,061 | A | 2/1995 | Manship et al. |
| 5,411,270 | A | 5/1995 | Naka et al. |
| 5,411,271 | A | 5/1995 | Mirando |
| 5,423,539 | A | 6/1995 | Nagao |
| 5,431,408 | A | 7/1995 | Adams |
| 5,431,492 | A | 7/1995 | Rothschild et al. |
| 5,449,173 | A | 9/1995 | Thomas et al. |
| 5,456,465 | A | 10/1995 | Durham |
| 5,524,888 | A | 6/1996 | Heidel |
| 5,536,016 | A | 7/1996 | Thompson |
| 5,542,669 | A | 8/1996 | Charron et al. |
| 5,553,851 | A | 9/1996 | Malavazos et al. |
| 5,560,603 | A | 10/1996 | Seelig et al. |
| 5,564,700 | A | 10/1996 | Celona |
| 5,569,084 | A | 10/1996 | Nicastro et al. |
| 5,580,309 | A | 12/1996 | Piechowiak et al. |
| 5,584,763 | A | 12/1996 | Kelly et al. |
| 5,584,764 | A | 12/1996 | Inoue |
| 5,605,506 | A | 2/1997 | Hoorn et al. |
| 5,609,524 | A | 3/1997 | Inoue |
| 5,611,535 | A | 3/1997 | Tiberio |
| 5,611,730 | A | 3/1997 | Weiss |
| 5,622,366 | A | 4/1997 | Inoue |
| 5,634,639 | A | 6/1997 | Tokito et al. |
| 5,636,838 | A | 6/1997 | Caro |
| 5,639,089 | A | 6/1997 | Matsumoto et al. |
| 5,655,961 | A | 8/1997 | Acres et al. |
| D383,171 | S | 9/1997 | Hanscom |
| 5,664,998 | A | 9/1997 | Seelig et al. |
| 5,674,127 | A | 10/1997 | Horstmann et al. |
| 5,695,400 | A | 12/1997 | Fennell, Jr. et al. |
| 5,702,304 | A | 12/1997 | Acres et al. |
| 5,711,525 | A | 1/1998 | Breeding |
| 5,722,891 | A | 3/1998 | Inoue |
| 5,741,183 | A | 4/1998 | Acres et al. |
| 5,752,882 | A | 5/1998 | Acres et al. |
| 5,755,619 | A | 5/1998 | Matsumoto et al. |
| 5,766,076 | A | 6/1998 | Pease et al. |
| 5,769,716 | A | 6/1998 | Saffari et al. |
| 5,772,509 | A | 6/1998 | Weiss |
| 5,775,692 | A | 7/1998 | Watts et al. |
| 5,779,544 | A | 7/1998 | Seelig et al. |
| 5,788,573 | A | 8/1998 | Baerlocher et al. |
| 5,810,361 | A | 9/1998 | Kadlic |
| 5,816,920 | A | 10/1998 | Hanai |
| 5,820,459 | A | 10/1998 | Acres et al. |
| 5,823,873 | A | 10/1998 | Moody |
| 5,823,874 | A | 10/1998 | Adams |
| 5,823,879 | A | 10/1998 | Goldberg et al. |
| 5,830,063 | A | 11/1998 | Byrne |
| 5,833,537 | A | 11/1998 | Barrie |
| 5,833,538 | A | 11/1998 | Weiss |
| 5,836,817 | A | 11/1998 | Acres et al. |
| 5,848,932 | A | 12/1998 | Adams |
| 5,851,148 | A | 12/1998 | Brune et al. |
| 5,855,515 | A | 1/1999 | Pease et al. |
| 5,873,781 | A | 2/1999 | Keane |
| 5,876,284 | A | 3/1999 | Acres et al. |
| 5,879,235 | A | 3/1999 | Kaneko et al. |
| 5,882,261 | A | 3/1999 | Adams |
| 5,885,158 | A | 3/1999 | Torango et al. |
| 5,902,184 | A | 5/1999 | Bennett et al. |
| 5,911,418 | A | 6/1999 | Adams |
| 5,919,091 | A | 7/1999 | Bell et al. |
| 5,924,927 | A | 7/1999 | Matsuura et al. |
| 5,927,714 | A | 7/1999 | Kaplan |
| 5,935,002 | A | 8/1999 | Falciglia |
| 5,947,820 | A | 9/1999 | Morro et al. |
| 5,951,397 | A | 9/1999 | Dickinson |
| 5,964,463 | A | 10/1999 | Moore, Jr. |
| 5,967,820 | A | 10/1999 | Siegal et al. |
| 5,967,894 | A | 10/1999 | Kinoshita et al. |
| 5,976,015 | A | 11/1999 | Seelig et al. |
| 5,976,019 | A | 11/1999 | Ikeda et al. |
| 5,980,384 | A | 11/1999 | Barrie |
| 5,984,781 | A | 11/1999 | Sunaga |
| 5,984,782 | A | 11/1999 | Inoue |
| 5,988,643 | A | 11/1999 | Awada |
| 5,989,121 | A | 11/1999 | Sakamoto |
| 5,996,997 | A | 12/1999 | Kamille |
| 5,997,400 | A | 12/1999 | Seelig et al. |
| 5,997,401 | A | 12/1999 | Crawford |
| 6,001,016 | A | 12/1999 | Walker et al. |
| 6,004,207 | A | 12/1999 | Wilson, Jr. et al. |
| 6,007,066 | A | 12/1999 | Moody |
| 6,012,982 | A | 1/2000 | Piechowiak et al. |
| 6,015,346 | A | 1/2000 | Bennett |
| D421,068 | S | 2/2000 | Yamaguchi |
| 6,019,369 | A | 2/2000 | Nakagawa et al. |
| 6,023,729 | A | 2/2000 | Samuel et al. |
| 6,027,115 | A | 2/2000 | Griswold et al. |
| 6,033,307 | A | 3/2000 | Vancura |
| 6,039,649 | A | 3/2000 | Schulze |
| 6,043,615 | A | 3/2000 | Forbes |
| 6,056,642 | A | 5/2000 | Bennett |
| 6,059,289 | A | 5/2000 | Vancura |
| 6,059,290 | A | 5/2000 | Neil |
| 6,059,658 | A | 5/2000 | Mangano et al. |
| 6,062,980 | A | 5/2000 | Luciano |
| 6,068,553 | A | 5/2000 | Parker |
| 6,077,162 | A | 6/2000 | Weiss |
| 6,082,734 | A | 7/2000 | Uehara et al. |
| 6,089,976 | A | 7/2000 | Schneider et al. |
| 6,089,977 | A | 7/2000 | Bennett |
| 6,089,978 | A | 7/2000 | Adams |
| 6,089,980 | A | 7/2000 | Gauselmann |
| 6,093,102 | A | 7/2000 | Bennett |
| 6,102,798 | A | 8/2000 | Bennett |
| 6,105,962 | A | 8/2000 | Malavazos et al. |

6,117,009 A 9/2000 Yoseloff
6,120,031 A 9/2000 Adams
6,126,541 A 10/2000 Fuchs
6,126,542 A 10/2000 Fier
6,129,355 A 10/2000 Hahn et al.
6,142,873 A 11/2000 Weiss et al.
6,142,874 A 11/2000 Kodachi et al.
6,142,875 A 11/2000 Kodachi et al.
6,146,271 A 11/2000 Kadlic
6,146,273 A 11/2000 Olsen
6,149,156 A 11/2000 Feola
6,149,157 A 11/2000 Suan
6,152,823 A 11/2000 Lacoste et al.
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,162,122 A 12/2000 Acres et al.
6,164,652 A 12/2000 Lauretta et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,183,366 B1 2/2001 Goldberg et al.
6,186,894 B1 2/2001 Mayeroff
6,190,254 B1 2/2001 Bennett
6,190,255 B1 2/2001 Thomas et al.
D439,282 S 3/2001 Yamaguchi
6,201,532 B1 3/2001 Tode et al.
6,203,427 B1 3/2001 Walker et al.
6,203,429 B1 3/2001 Demar et al.
6,210,275 B1 4/2001 Olsen
6,210,277 B1 4/2001 Stefan
6,210,279 B1 4/2001 Dickinson
6,213,876 B1 4/2001 Moore, Jr.
6,217,022 B1 4/2001 Astaneha
6,217,448 B1 4/2001 Olsen
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,241,608 B1 6/2001 Torango
6,244,958 B1 6/2001 Acres
6,251,013 B1 6/2001 Bennett
6,254,483 B1 7/2001 Acres
6,257,979 B1 7/2001 Walker et al.
6,261,177 B1 7/2001 Bennett
6,264,560 B1 7/2001 Goldberg et al.
6,270,409 B1 8/2001 Shuster
6,280,325 B1 8/2001 Fisk
6,299,165 B1 10/2001 Nagano
6,299,170 B1 10/2001 Yoseloff
6,302,398 B1 10/2001 Vecchio
6,302,790 B1 10/2001 Brossard
6,305,686 B1 10/2001 Perrie et al.
6,309,299 B1 10/2001 Weiss
6,309,300 B1 10/2001 Glavich
D451,153 S 11/2001 Hedrick et al.
6,311,976 B1 11/2001 Yoseloff et al.
6,312,333 B1 11/2001 Acres
6,312,334 B1 11/2001 Yoseloff
6,315,663 B1 11/2001 Sakamoto
6,315,664 B1 11/2001 Baerlocher et al.
6,319,124 B1 11/2001 Baerlocher et al.
6,319,125 B1 11/2001 Acres
6,322,078 B1 11/2001 Adams
6,322,309 B1 11/2001 Thomas et al.
D451,558 S 12/2001 Sano
6,328,649 B1 12/2001 Randall et al.
6,334,814 B1 1/2002 Adams
6,336,860 B1 1/2002 Webb
6,336,863 B1 1/2002 Baerlocher et al.
6,346,043 B1 2/2002 Colin et al.
6,347,996 B1 2/2002 Gilmore et al.
6,358,144 B1 3/2002 Kadlic et al.
6,358,149 B1 3/2002 Schneider et al.
6,364,314 B1 4/2002 Canterbury
6,364,766 B1 4/2002 Anderson et al.
6,364,767 B1 4/2002 Brossard et al.
6,364,768 B1 4/2002 Acres et al.
6,371,852 B1 4/2002 Acres
6,375,187 B1 4/2002 Baerlocher
6,375,567 B1 4/2002 Acres
6,375,569 B1 4/2002 Acres
6,375,570 B1 4/2002 Poole
6,386,974 B1 5/2002 Adams
6,394,902 B1 5/2002 Glavich et al.
6,398,218 B1 6/2002 Vancura
6,398,220 B1 6/2002 Inoue
6,398,644 B1 6/2002 Perrie et al.
6,406,369 B1 6/2002 Baerlocher et al.
6,409,595 B1 6/2002 Uihlein et al.
6,413,160 B1 7/2002 Vancura
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,435,511 B1 8/2002 Vancura et al.
6,435,968 B1 8/2002 Torango
6,439,943 B1 8/2002 Aoki et al.
6,439,993 B1 8/2002 O'Halloran
6,439,995 B1 8/2002 Hughs-Baird et al.
D462,397 S 9/2002 Baker et al.
6,443,452 B1 9/2002 Brune
6,443,837 B1 9/2002 Jaffe et al.
6,454,266 B1 9/2002 Breeding et al.
RE37,885 E 10/2002 Acres et al.
6,461,241 B1 10/2002 Webb et al.
6,464,582 B1 10/2002 Baerlocher et al.
6,464,586 B1 10/2002 Kamata et al.
6,475,090 B2 11/2002 Roelofs
6,491,584 B2 12/2002 Graham et al.
6,494,454 B2 12/2002 Adams
6,494,785 B1 12/2002 Gerrard et al.
6,506,117 B2 1/2003 DeMar et al.
6,506,118 B1 1/2003 Baerlocher et al.
6,514,141 B1 2/2003 Kaminkow et al.
6,536,766 B1 3/2003 Deitch et al.
D475,091 S 5/2003 Tsuda
6,561,512 B2 5/2003 Luciano et al.
6,561,899 B2 5/2003 Vancura
6,561,902 B1 5/2003 Walker et al.
6,565,434 B1 5/2003 Acres
6,569,015 B1 5/2003 Baerlocher et al.
6,572,471 B1 6/2003 Bennett
6,572,473 B1 6/2003 Baerlocher
6,575,830 B2 6/2003 Baerlocher et al.
6,575,832 B1 6/2003 Manfredi et al.
6,585,591 B1 7/2003 Baerlocher et al.
6,592,460 B2 7/2003 Torango
6,595,854 B2 7/2003 Hughs-Baird et al.
6,598,877 B1 7/2003 Luciano et al.
6,599,185 B1 7/2003 Kaminkow et al.
6,599,192 B1 7/2003 Baerlocher et al.
6,599,193 B2 7/2003 Baerlocher et al.
6,604,740 B1 8/2003 Singer et al.
6,605,000 B2 8/2003 Adams
6,607,195 B2 8/2003 Vancura 6,607,441 B1 8/2003 Acres
6,616,142 B2 9/2003 Adams
6,620,045 B2 9/2003 Berman et al.
6,626,758 B1 9/2003 Parham et al.
6,629,887 B1 10/2003 Todaiji et al.
6,632,139 B1 10/2003 Baerlocher
6,632,141 B2 10/2003 Webb et al.
6,645,071 B2 11/2003 Perrie et al.
6,645,074 B2 11/2003 Thomas et al.
6,648,753 B1 11/2003 Tracy et al.
6,648,754 B2 11/2003 Baerlocher et al.
6,659,864 B2 12/2003 McGahn et al.
6,663,488 B1 12/2003 Adams
D486,869 S 2/2004 Webb et al.
6,692,354 B2 2/2004 Tracy et al.
6,692,355 B2 2/2004 Baerlocher et al.
D487,582 S 3/2004 McGahn et al.
6,705,944 B2 3/2004 Luciano
6,712,693 B1 3/2004 Hettinger
6,712,697 B2 3/2004 Acres
6,712,702 B2 3/2004 Goldberg et al.
6,715,756 B2 4/2004 Inoue
6,722,976 B2 4/2004 Adams
6,722,981 B2 4/2004 Kaminkow et al.
6,726,563 B1 4/2004 Baerlocher et al.
6,800,030 B2 10/2004 Acres
6,827,646 B2 12/2004 Adams
6,855,056 B2 2/2005 Inoue
6,887,154 B1 5/2005 Luciano, Jr. et al.
6,899,625 B2 5/2005 Luciano, Jr. et al.
6,910,964 B2 6/2005 Acres
6,923,441 B2 8/2005 Inoue
RE38,812 E 10/2005 Acres et al.
6,966,834 B1 11/2005 Johnson
6,974,129 B2 12/2005 Nordman
6,988,731 B2 1/2006 Inoue
7,056,215 B1 6/2006 Olive
7,104,886 B2 9/2006 Baerlocher et al.
7,169,045 B2 1/2007 Nordman
7,297,059 B2 * 11/2007 Vancura et al. ..... 463/27
7,306,520 B2 12/2007 Kaminkow et al.
2001/0003709 A1 6/2001 Adams
2001/0004606 A1 6/2001 Tracy et al.
2001/0018361 A1 8/2001 Acres
2002/0042294 A1 4/2002 Pau et al.
2002/0045475 A1 4/2002 Glavich et al.
2002/0052234 A1 5/2002 Adams
2002/0055381 A1 5/2002 Tarantino
2002/0072402 A1 6/2002 Baerlocher
2002/0103029 A1 8/2002 Finlayson et al.
2002/0137559 A1 9/2002 Baerlocher
2002/0142822 A1 10/2002 Baerlocher et al.
2002/0142826 A1 10/2002 Adams
2002/0142830 A1 10/2002 Adams
2002/0151342 A1 10/2002 Tracy et al.
2002/0151350 A1 10/2002 Baerlocher et al.
2002/0155883 A1 10/2002 Baerlocher
2002/0187827 A1 12/2002 Blankstein
2002/0198038 A1 12/2002 Adams
2003/0011127 A1 1/2003 Vancura et al.
2003/0013514 A1 1/2003 Cregan et al.
2003/0013520 A1 1/2003 Adams
2003/0027628 A1 2/2003 Luciano
2003/0036420 A1 2/2003 Baerlocher et al.
2003/0036430 A1 2/2003 Cannon
2003/0040355 A1 2/2003 Baerlocher
2003/0040360 A1 2/2003 Kaminkow
2003/0045338 A1 3/2003 Dolloff et al.
2003/0045344 A1 3/2003 Webb et al.
2003/0045348 A1 3/2003 Palmer et al.
2003/0045350 A1 3/2003 Baerlocher et al.
2003/0045360 A1 3/2003 Hora
2003/0060260 A1 3/2003 Gerrard et al.
2003/0060266 A1 3/2003 Baerlocher
2003/0060277 A1 3/2003 Webb et al.
2003/0060279 A1 3/2003 Torango
2003/0064773 A1 4/2003 Baerlocher et al.
2003/0064795 A1 4/2003 Baerlocher et al.
2003/0064796 A1 4/2003 Glavich et al.
2003/0087689 A1 5/2003 Adams
2003/0087693 A1 5/2003 Baerlocher et al.
2003/0100361 A1 5/2003 Sharpless et al.
2003/0114216 A1 6/2003 Adams
2003/0153385 A1 * 8/2003 Ikeya et al. ..... 463/31
2003/0157979 A1 8/2003 Cannon et al.
2003/0157982 A1 8/2003 Gerrard et al.
2003/0181234 A1 9/2003 Falciglia, Sr.
2003/0190957 A1 10/2003 Tanskanen
2003/0199316 A1 10/2003 Miyamoto et al.
2003/0211880 A1 11/2003 Locke
2003/0216166 A1 11/2003 Baerlocher et al.
2003/0228904 A1 12/2003 Acres et al.
2003/0236116 A1 12/2003 Marks et al.
2004/0002372 A1 1/2004 Rodgers et al.
2004/0009805 A1 1/2004 Baerlocher et al.
2004/0009807 A1 1/2004 Miller et al.
2004/0009811 A1 1/2004 Torango
2004/0014517 A1 1/2004 Inoue
2004/0017041 A1 1/2004 Inoue
2004/0018866 A1 1/2004 Inoue
2004/0023708 A1 2/2004 Kaminkow et al.
2004/0033831 A1 2/2004 Tarantino
2004/0038728 A1 2/2004 Adams
2004/0038734 A1 2/2004 Adams
2004/0043811 A1 3/2004 Seelig et al.
2004/0048644 A1 3/2004 Gerrard et al.
2004/0048645 A1 3/2004 Webb et al.
2004/0051240 A1 3/2004 Adams
2004/0053660 A1 3/2004 Webb et al.
2004/0053665 A1 3/2004 Baerlocher
2004/0082378 A1 4/2004 Peterson et al.
2004/0102237 A1 5/2004 Baerlocher
2004/0106444 A1 6/2004 Cuddy et al.
2004/0121838 A1 6/2004 Hughs-Baird et al.
2004/0147306 A1 7/2004 Randall et al.
2004/0150161 A1 8/2004 Inoue
2004/0155399 A1 8/2004 Inoue
2004/0162128 A1 8/2004 Baerlocher et al.
2004/0183251 A1 9/2004 Inoue
2005/0026674 A1 2/2005 Wolf et al.
2005/0059474 A1 3/2005 O'Halloran
2005/0079911 A1 4/2005 Nakatsu
2005/0101384 A1 5/2005 Parham
2005/0137014 A1 6/2005 Vetelainen
2005/0143168 A1 6/2005 Torango
2005/0153780 A1 7/2005 Gauselmann
2005/0218590 A1 10/2005 O'Halloran et al.
2005/0233803 A1 10/2005 Yang
2006/0009283 A1 1/2006 Englman et al.
2006/0030403 A1 2/2006 Lafky et al.
2006/0040723 A1 2/2006 Baerlocher et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0046821 A1 3/2006 Kaminkow et al.
2006/0046822 A1 3/2006 Kaminkow et al.
2006/0046823 A1 3/2006 Kaminkow et al.
2006/0069619 A1 3/2006 Walker et al.
2006/0178203 A1 8/2006 Hughes et al.
2006/0183535 A1 8/2006 Marks et al.
2007/0015585 A1 * 1/2007 Sartini et al. ..... 463/42
2007/0054733 A1 3/2007 Baerlocher et al.
2007/0060271 A1 3/2007 Cregan et al.
2007/0060314 A1 3/2007 Baerlocher et al.
2007/0060321 A1 3/2007 Vasquez et al.

| | | | |
|---|---|---|---|
| 2007/0105619 | A1 | 5/2007 | Kniesteadt et al. |
| 2007/0191088 | A1 | 8/2007 | Breckner et al. |
| 2007/0218975 | A1 | 9/2007 | Iddings et al. |

FOREIGN PATENT DOCUMENTS

| | | | |
|---|---|---|---|
| AU | 199917318 | A1 | 9/1999 |
| EP | 0874337 | | 10/1998 |
| EP | 0926645 | A2 | 6/1999 |
| EP | 0944030 | A2 | 9/1999 |
| EP | 0945837 | | 9/1999 |
| EP | 0 981 119 | A2 | 2/2000 |
| EP | 0981119 | A2 | 2/2000 |
| EP | 0 984 409 | A2 | 3/2000 |
| EP | 0984408 | A2 | 3/2000 |
| EP | 0984409 | A2 | 3/2000 |
| EP | 1 513 116 | A2 | 3/2005 |
| GB | 2 322 217 | | 12/1997 |
| GB | 2 201 821 | | 9/1998 |
| WO | WO 97/32285 | | 9/1997 |
| WO | WO 99/03078 | | 1/1999 |
| WO | WO 00/12186 | | 3/2000 |
| WO | WO 00/66235 | | 11/2000 |
| WO | WO 00/76606 | | 12/2000 |
| WO | WO 2004/012159 | | 2/2004 |
| WO | WO 2004/025584 | | 3/2004 |
| WO | WO 2005/099425 | | 10/2005 |

OTHER PUBLICATIONS

Addams Family Article (IGT), written by Strictly Slots, published in 2000.
Battleship Advertisement, printed from www.mikohn.com, on Apr. 25, 2001.
Battleship Article (Mikohn), written by Strictly Slots, published in 2000.
Black Swan Paytable Display, written by IGT, published prior to 2001.
Boot Scootin Article, written by Strictly Slots, published prior to Jul. 2002.
Break the Spell Advertisement, written by Atronic Casino Technology, Ltd., published in 1999.
Break the Spell Article, written by Strictly Slots, published in Sep. 2000.
Break the Spell, printed from www.atronic.com on Jul. 15, 2001.
By George Advertisement, written by IGT, published in 2002.
Cash Chameleon Article, written by Strictly Slots, published in Apr. 2001.
Cash for Life—Offer Bonus Advertisement/Lotsa Loot Advertisement/Take It or Leave It Advertisement, written by Bally Gaming, published in 2002.
Cash for Life—Triple Spin Bonus Article (Bally Gaming), written by Strictly Slots, published in 2003.
Catch A Wave Advertisement, written by IGT, published in Dec. 2000.
Cossack Dance Advertisement, written by Olympic Video Gaming, published prior to 2002.
Deep Pockets Article (IGT), written by Strictly Slots, published in 2002.
Double Diamond Line Advertisement, written by Bally Gaming Systems, published in 2000.
Double Top Dollar Advertisement, written by IGT, published in 2003.
Enchanted Unicorn Advertisement, written by IGT, published in 2001.
Field Testing New Slots Article, written by Stictly Slots, published in Jul. 2000.
Fire and Fortune Article (Anchor Games), written by Strictly Slots, published in 2001.
Fishin' Buddies Article, written by Strictly Slots, published in Apr. 2001.
Fortune Cookie Advertisement, written by www.igt.com, printed Mar. 21, 2001.
Fortune Cookie Advertisement, written by IGT, published in 2000.
Happy Camper Advertisement, written by IGT, published in 2001.
Hollywood Advertisement, written by Shuffle Master Gaming, published in 2001.
Introducing the "Smiling Ape" Machine Advertisement (including Joker's Wild Poker description), written by IGT, published prior to 2001.
Jackpot Party Brochure and Articles, written by WMS Gaming, Inc, published in 1998.
Joker's Wild Advertisement, written by IGT, published prior to 2001.
King Cash Slots Advertisement, written by IGT, published in 2003.
Let's Make A Deal Advertisements, written by Bally Gaming/Shuffle Master Gaming, published in 2001.
Little Green Men, Jr. Advertisement, written by A.C. Coin, published prior to 2002.
Loco Loot Article, written by Strictly Slots, published in May 2002.
Mountain Money Article, written by Strictly Slots, published in Jun. 2002.
On the House Advertisement, written by Olympic Video Gaming, published prior to 2002.
Penguin Pays Advertisement, written by Aristocrat Incorporated, published in 1998.
Press Your Luck Article (Shuffle Master Gaming), written by Strictly Slots, published in 2000.
Price is Right—Cliff Hangers Description, printed from www.geocities.com on Mar. 21, 2001.
Price is Right—Cliff Hangers Advertisement, written by IGT, published in 2001.
Price is Right—Showcases Description, printed from schuminweb.com on Mar. 16, 2001.
Psycho Cash Beast Advertisement, written by IGT, published in 1999.
Reel Magic™ Gaming Machine Description, written by IGT, gaming machine available in 1986.
Symbol Feature Description in Australian UFO Gaming Machine, written by IGT, gaming machine available 1995.
Take Your Pick Advertisement, written by IGT/Anchor Gaming, published in 1999.
Take Your Pick Article (IGT), written by Strictly Slots, published in 2001.
The Latest Buzz Article, written by Bally Gaming Systems, published in Fall 2000.
Three Wishes Article (Atronic Americas), written by Strictly Slots, published in 2000.
Top Dollar Game Advertisement, written by IGT, published in 1998.
Wild Bear Salmon Run Advertisement written by IGT, published in 2003.
Wild Streak Article, written by Strictly Slots, published in 2001.
Your Real Key to Gaming Success Advertisement (including Roll Over Beethoven and Wild Fortune), written by Olympic Video Gaming, published prior to 2005.
2nd Change 7s article, published by Strictly Slots in Nov. 2000.
77's Above Advertisement published by Bell-Fruit Games prior to Sep. 30, 2004.
American Bandstand Game description written by IGT, published in 2001.
Astra article published in Coinslot Industry in Jan. 2003.
Atronic Merchandising advertisement, written by Atronic, published in 2004.
Atronic WAPs advertisement, published by Atronic in 2004.
Big Monte Game advertisement, published by Bally Gaming in 2003.
Big Shot Game advertisement, published by Aristocrat in 2002.
Big Top Keno advertisement, published by Aristocrat in Oct. 2000.
Bonus Road Rally Game advertisement, published by A. C. Coin & Slot Service Company in 1997.
Cartoon Jackpots advertisement, written by Bally Gaming Systems in 2004.
Casino Beaver Las Vegas! published by Global Games, published prior to Sep. 30, 2004.
Cyclone advertisement, written by Innovative Concepts in Entertainment, published prior to Sep. 30, 2004.
Derby Champion advertisement, written by Chang Myung Co., Ltd., published prior to Sep. 30, 2004.

Dice Shaker advertisement, written by Elaut, published prior to Sep. 30, 2004.
Eivira Game advertisement, published by IGT in 2002.
Elvira Mistress of the Dark advertisement, published by IGT prior to Jun. 30, 2004.
Elvis advertisement, published by IGT in 1999.
Game Time International Gaming advertisements, published in Aug. 2004.
Games and Technology article and photograph, published by International Gaming and Wagering Business in Jan. 2003.
Games Station advertisement, written by Atronic International, published Feb. 2003.
Ghost Hunter advertisement, written by Atronic, published in 2003.
Golden Roulette advertisement, written by Cadillac Jack, published in 2004.
Harley Davidson Video Slots advertisements, published by IGT in 2002.
Hybrid Combining the Best of Both Slot Worlds! Advertisement, written by Bally Gaming Systems, published in 2004.
IGT World of Games Class II and Central Determination Games written by IGT, published in 2004.
IGT World of Games MegaJackpots Video Slots advertisement, written by IGT, published in 2004.
Jackpot Carnival advertisement written by Aristocrat in The Gaming Entertainers Magazine 2003, published in 2003.
Life Article, published by Strictly Slots in Jun. 2002.
Life's Little Games article, published by Strictly Slots in Jun. 2002.
Lucky Wheel advertisement written by Carat Gaming Technology, published prior to Sep. 30, 2004.
Lucky Wheel Game advertisement, published by Strictly Slots in Mar. 2004.
M*A*S*H Video Slots Game advertisement, published by IGT in 2003.
Magic 8 Ball Advertisement written by IGT, published in 2003.
Magic Roulette De Luxe advertisement by IAMC, published by IAMC in 2004.
Monte Carlo advertisement, published by Bally Gaming Systems prior to Sep. 30, 2004.
Monte Carlo advertisement, writt by Bally Gaming Systems, published in 2004.
Monte Carlo Game advertisement, published by Bally Gaming Systems in 2003.
One page sheet showing and describing a 1977 Bally Monte Carlo game.
Party Games advertisement, published by Astra in 2003.
Party Time Bingo Advertisement published by Astra Games Limited, published prior to Sep. 30, 2004.
Rapid Roulette Game advertisement, published by John Huxley in 2003.
Rapid Roulette Product Overview Game advertisement, published by John Huxley in 2002.
Ring-a-Bell Game advertisement, published by JPM prior to Sep. 30, 2004.
RNGs and Multi-Coin Plays article, published by Strictly Slots in Aug. 2004.
Roulette advertisement, published by Atronic in 1999.
Roulette Grand Jeu advertisement, published by Amatic Industries prior to Sep. 30, 2002.
Roulette Grand Jeu Game description and advertisement, published by Amatic Industries prior to Sep. 30, 2004.
Roulette Prestige advertisement, written by IAMC, published in 2004.
Seeben Gaming Machine advertisement, published in Oct. 2004.
Shaking Dice advertisement, published by General Automatic Amusement prior to Sep. 30, 2004.
Slot City "Anchor Games Unveils 'City of Slots,'" Anchor Games published in 2001.
Slot Machines [In Part] written by Marshal Fey, published 1997.
Slots 2003, written by Melissa Raimondi, published in Jan. 2003.
Super Reel advertisement, published by Electrocoin Gaming Prior to Sep. 30, 2004.
The Beverly Hillbillies Video Slots advertisement, published by IGT in 2002.
The Beverly Hillbillies Video Slots article, published by Strictly Slots in Jan. 2002.
The Beverly Hills Video Slots advertisement, published by IGT in 2003.
The Game of Life advertisement, published by Sigma prior to Sep. 30, 2004.
The Game of Life Video Slot Game advertisement, published by Sigma, 2004.
The Price is Right brochure written by IGT, published in 2001.
Top Secret 2 advertisement, written by Unidesa Gaming, published in 2004.
Treble Chance advertisement, published by Astra in Jan. 2003.
Twinkle Dome advertisement, written by Manjyudo Co, published prior to Sep. 30, 2004.
Victory advertisement, written by Elaut, published prior to Sep. 30, 2004.
Victory Game advertisement, published by General Automatic Amusement prior to Sep. 30, 2004.
Wheel and Deal article, published by Strictly Slots in Dec. 2001.
Wheel of Adventure, published by John Huxley prior to Sep. 30, 2004.
Wheel of Fortune Advertisement written by IGT, 1999.
Wheel of Fortune classic gaming machine photograph, available prior to Sep. 30, 2004.
Wheel of Fortune Game advertisement, published by General Automatic Amusement prior to Sep. 30, 2004.
Wheel of Fortune Game advertisement, published by IGT in 1998.
Wheel of Fortune Game Show web page http://www.wheeloffortune.com, printed on Dec. 15, 2004.
Wheel of Fortune Lucky Spin advertisement, published by IGT, published prior to Sep. 30, 2004.
Wheel of Fortune Slots S2000 Series Advertisement, published by IGT in 2002.
Wheel of Fortune Special Edition advertisement, written by IGT, published in 2004.
Wheel of Fortune Special Edition Classic Spin Video Slots, written by IGT, published before Sep. 30, 2004.
Wheel of Fortune Triple Action article, published in Strictly Slots in Feb. 2004.
Wheel of Fortune Video advertisement, published by IGT in 1999.
Wheel of Fortune Video Slots Advertisement written by IGT, published in 2002.
Wheel of Fortune Video Slots advertisement, published by IGT prior to Sep. 30, 2004.
Wheel of Gold advertisement, published by Anchor in 1995.
Wheel Poker Brochure written by Anchor Games/Bally Gaming, Strictly Slots, was written prior to Sep. 12, 2002.
Wheel Spins Bonus (Video Wheel of Fortune) article written by IGT, published before Sep. 30, 2004.
Wild Race advertisement, written by Unidesa Gaming & Systems, published in 2004.
ZeroLabs advertisement, written by ZeroLabs, published in 2004.
Zorro advertisement, written by Aristocrat, published in 2004.
Office Action dated Apr. 23, 2009 for U.S. Appl. No. 10/630,529. (11 pages).
Office Action dated Apr. 9, 2008 for U.S. Appl. No. 10/630,529. (11 pages).
Office Action dated Aug. 21, 2007 for U.S. Appl. No. 10/630,529. (10 pages).
Office Action dated Jan. 30, 2007 for U.S. Appl. No. 10/630,529. (9 pages).
Office Action dated Jul. 12, 2006 for U.S. Appl. No. 10/630,529. (7 pages).
Office Action dated Jun. 28, 2007 for U.S. Appl. No. 10/769,086. (17 pages).
Office Action dated Nov. 17, 2008 for U.S. Appl. No. 12/045,085. (6 pages).
Office Action dated Nov. 4, 2008 for U.S. Appl. No. 10/630,529. (11 pages).

* cited by examiner

GAMING DEVICE SYSTEM HAVING PARTIAL PROGRESSIVE PAYOUT

PRIORITY CLAIM

This application is a continuation-in-part of and claims the benefit of U.S. patent application Ser. No. 10/769,086, filed Jan. 29, 2004 now U.S. Pat. No. 7,354,342, which is a continuation-in-part of and claims the benefit of U.S. patent application Ser. No. 10/630,529, filed Jul. 30, 2003, the entire contents of which are incorporated herein.

CROSS-REFERENCE TO RELATED APPLICATIONS

This application is related to the following commonly-owned co-pending patent applications: "GAMING DEVICE HAVING A MASKED AWARD GAME," Ser. No. 10/210,540, and "GAMING DEVICE HAVING AN OFFER AND ACCEPTANCE GAME," Ser. No. 11/122,719.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one way to enhance player enjoyment and excitement.

Gaming devices having bonus games generally employ a triggering event that occurs during the base game operation of the gaming device. The triggering event temporarily stalls or halts the base game play and enables a player to enter a second, different game, which is the bonus game. The player plays the bonus game, likely receives an award, and returns to the base game.

To increase player enjoyment and excitement, it is desirable to provide new games including new bonus games.

SUMMARY

One embodiment of the present invention provides a gaming device and in particular a bonus game of a gaming device that enables players to accumulate awards by obtaining sections on an award distributor such as an award wheel based on the coordinates of the sections.

In one embodiment, the award wheel includes several annular areas or groups that are each divided into a plurality of sections. The sections are each defined by first and second coordinates on the award wheel and include award symbols that are associated with awards. The coordinates define the location of each section on the award wheel. Initially, the gaming device alternately illuminates each annular area, which defines the first coordinate of the groups of sections in the annular areas. In one embodiment, the gaming device picks one of the annular areas. In another embodiment, the gaming device enables the player to pick one of the annular areas where the awards associated with the annular areas are approximately equal. Once the first coordinate is defined by selecting one of the annular areas on the award wheel, the gaming device or player activates or spins the award wheel. When the wheel stops spinning, a section indicator indicates a second coordinate which together with the first coordinate, defines the determined section in the annular area. The player receives the award associated with the section that is defined by the indicated first and second coordinates. In one embodiment, the player continues to play the bonus game until the player is out of activations or spins of the award wheel.

In one preferred embodiment, the award wheel is divided into several groups or annular areas where each of the annular areas is further divided into several sections. The first coordinate of a group of sections is represented by the radial distance from the center of the award wheel to the annular area. The second coordinate of one of the sections in the group is defined by the angular location of a section along the annular area. Each section includes a symbol such as an award symbol. A plurality of awards are associated with the award symbols. In one embodiment, the awards associated with the sections in the innermost annular areas of the award wheel are substantially lower awards than the awards associated with the sections located in the outermost annular areas of the wheel. Each annular area is alternately highlighted or illuminated at the start of the bonus game by an illumination device. The annular areas alternately light up, one at a time, until only one area is randomly selected and remains illuminated. In one embodiment, the gaming device (i.e., the processor) determines the indicated annular area. In another embodiment, the gaming device enables the player to pick the annular area as described above. Next, the gaming device or player activates or spins the award wheel. Once the wheel stops spinning, the section indicator indicates one of the sections in the indicated or highlighted annular area. The player receives the award associated with the indicated section. The player continues to play the bonus game until the player has no spins remaining in the game.

In another embodiment, the award wheel first is spun to indicate a pie-shaped area of the wheel. Each pie-shaped section is further divided into individual sections by the annular areas on the wheels. Then, the sections in the indicated pie-shaped area are alternately illuminated until one section is randomly selected and remains illuminated. The player receives the award associated with that selected section.

In a further embodiment, an annular area is illuminated and defines the first coordinate of a group of sections. Then the indicator spins about the perimeter of the award wheel to define the second coordinate of one of the sections in the illuminated annular area. When the indicator stops, the indicated first and second coordinates define the indicated section on the award wheel. The gaming devices provides the player with the award associated with the indicated section defined by the determined first and second coordinates.

In an alternative embodiment of the present invention the sections on the award wheel include a plurality of awards and a plurality of award percentages. Specifically, the award wheel includes a plurality of sections wherein the sections are arranged in a plurality of groups. The groups of sections include a symbol group, which includes the sections in the outermost annular area and a plurality of modifier groups, which include the sections in inner annular areas.

In one embodiment, a plurality of awards, such as award values or credits, are associated with the sections in the symbol group. The awards may include values, multipliers, modifiers, monetary prizes, non-monetary prizes, physical prizes or any suitable type of award. It should be appreciated that any of the annular areas or groups on the award wheel may include sections having one or more awards.

Additionally, a plurality of award portions or award percentages are associated with the sections in the modifier groups. In one embodiment, the modifier groups include award percentages of 100%, 75%, 50% and 25% associated with each of the sections in these groups. The award percentages may be any suitable award percentages desired by the game implementor. In one embodiment, the award percentages associated with the sections in each of the modifier groups are the same. In another embodiment, the award percentages associated with the sections in each of the modifier groups are different. It should be appreciated that at least one of the award percentages, a plurality of the award percentages or all of the award percentages associated with the sections within each of the groups may be different. Additionally, the award percentages associated with the sections may be different from group to group. In one embodiment, the award percentages associated with the sections in the groups increase from the innermost annular area to the outermost annular area. In another embodiment, the award percentages decrease from the innermost modifier group to outermost modifier group. Furthermore, the award percentages may be represented as fractions, decimals or any other suitable type of award portion, fraction or percentage.

In an operational embodiment, the gaming device indicates an award percentage and an award in each activation or spin of the award wheel. The indicated award percentage is multiplied by the or applied to an indicated award in the symbol group to provide an activation or spin award to the player for that activation or spin. For example, when an indicated section includes an award percentage of 75% (0.75), the gaming device provides the player with 75% of the award associated with the indicated section in the symbol group. In other words, the gaming device multiplies the indicated award by 0.75 to provide an activation award to the player for that activation or spin.

In one embodiment, each of the modifier groups are included on the same wheel and rotate in the same direction. In another embodiment, at least one of the modifier groups is included on a separate wheel from the other annular areas. In this embodiment, the wheels may rotate in the same direction or in different directions. In a further embodiment, each of the modifier groups are included on separate wheels. The wheels may rotate in the same direction, at least one may rotate in different directions from the other wheels or a plurality of the wheels may rotate in a different direction. In a further embodiment, the award wheel may also remain stationary and the section indicator may rotate about the perimeter of the award wheel in a clockwise or counterclockwise direction.

The gaming device also includes an additional bonus award such as a big bonus award. In one embodiment, the big bonus award is indicated in the middle of the award wheel includes a masked or hidden award provided to the player by the gaming device when all of the award percentages associated with a particular award are indicated in the game (i.e., in the number of spins of the wheel provided to the player). The big bonus award may be an award value, a modifier, a multiplier, free spins, free games or any other suitable award. The big bonus award is provided to the player in the game or in a subsequent game (i.e, free spins) or added to the player's total award in the game (i.e, an award value or credits).

In another embodiment, the gaming device enables a player to pick or select an annular area or pie-shaped area or segment of the wheel prior to playing the game or initiating the spins of the wheel in the game. It should be appreciated that the gaming device may enable the player to pick one, a plurality or the annular areas and/or pie-shaped segments or areas of the wheel in a game. It should also be appreciated that the gaming device may enable the player to pick the annular area or areas or pie-shaped section or sections prior to playing the game, prior to one spin in the game or prior to a plurality of the spins in the game. In one embodiment, the gaming device enables the player to pick one of the annular areas or pie-shaped sections by pressing or touching the corresponding annular area or pie-shaped section on a touch screen display device or by pressing a button or similar input device which corresponds to the annular area or pie-shaped section on the wheel.

In a further embodiment, the gaming device of the present invention is employed in a progressive type game where a player accumulates indicated sections on the wheel in a plurality of games. In this embodiment, the indicated sections remain highlighted or illuminated for a designated number of games. The designated number of games may be predetermined, randomly determined or determined in any suitable manner. In one aspect of this embodiment, the awards are associated with a probability of being indicated such that the relatively small awards include greater probabilities than the relatively large awards. In this aspect, a significant portion of the relatively small awards are indicated before the relatively large awards are indicated on the wheel. Once the designated number of games are reached, the gaming device resets the award wheel so that none of the sections are indicated (i.e., highlighted) on the wheel. It should be appreciated that the gaming device may reset the award wheel so that none, one, a plurality or all of the sections are highlighted on the wheel.

In another embodiment, a plurality of section indicators are associated with the wheel such that multiple sections are indicated on the wheel in a spin. This enables a player to obtain multiple awards associated with the multiple sections indicated on the wheel in a single spin. In one embodiment, the section indicators associated with the wheel are activated such that only the activated section indicators indicate sections on the wheel. The section indicators may be activated by particular sections on the wheel or based on the number of spins provided to the player in the game. The number of section indicators may also be based on a wager made by the player in the base game or in a bonus game.

In a further embodiment the multiple section indicators are moveable such that the section indicators move about the wheel at the beginning of a game and are stopped or locked in place by the gaming device or the player. The section indicators may move at the beginning of the game, during the game, after one spin or a plurality of the spins of the wheel or at any suitable point in a game. The moveable indicators enable the player to interact with the game and therefore provides additional excitement and enjoyment of the game.

In another embodiment, a time dimension is associated with the present invention to offer enhanced play and awards in the game. In one aspect of this embodiment, a larger award or a plurality of awards are provided to the player when a designated number of sections are indicated in a designated number of spins of the wheel. For example, the gaming device provides a larger award or a bonus award to a player when the player indicates all of the sections associated with one of the awards in a particular number of spins of the award wheel. The gaming device decreases the award for each additional spin or spins needed by the player to indicate those sections.

In another aspect of this embodiment, the gaming device only provides a bonus award when the player indicates a specific section or sections in a designated number of spins. If the sections or sections are indicated after the designated number of spins are reached, the gaming device does not provide a bonus or extra award to the player. It should be appreciated that the designated section or sections may be predetermined, randomly determined or determined according to any suitable determination method.

In a further aspect of this embodiment, a time period is associated with the game such that the gaming device or the player spins the wheel during the time period and indicates sections and accumulates awards associated with those sections during the time period. When the time period expires, the game ends and the player receives the total accumulative award for the game.

In a further embodiment, a display device such as a wheel is structured to display to the player a portion of an available amount, such as an available jackpot amount or progressive amount. The available amount is displayed to the player. The portion of the amount is randomly generated and for example displayed to the player using a suitable display device such as a wheel. The player receives the combination of the available amount and the portion, such as a percentage, fraction or decimal multiplication of the available amount.

In an alternative embodiment, a display device such as a wheel is structured to display to one or more players a portion each player will receive of an available amount, such as an available jackpot amount or progressive amount. The available amount is displayed to the players. The portions for each player of the amount are randomly generated and for example displayed to the players using a suitable display device such as a wheel. Each player receives the combination of the available amount and their portion, such as a percentage, fraction or decimal multiplication of the available amount. It should be appreciated that two or more of the players may receive the same or different amounts.

In any of the embodiments described herein the wheel may be a wheel shared by multiple gaming devices. In connection with providing the player with a portion of the available amount, apportioning symbols, such as percentages, fractions or decimals are displayed by or shown on the shared wheel. The available amount is shown for example on one or more large overhead displays, the shared wheel or at the individual gaming devices.

In one implementation, one of the played gaming devices triggers the bonus and the shared display. The shared wheel displays the determined percentage or portion. In another implementation, the shared display displays the determined type of award provided to the player, such as the apportioned jackpot award or another type of award, e.g., credit or multiplier. If the shared display indicates the apportioned jackpot award, a separate wheel on (i) the triggering gaming device, or (ii) an overhead display displays the determined percentage or portion.

In a further implementation, the shared display performs independent displays of: (i) the type of award (apportioned, multiplier, credits), and (ii) the percentage or portion of the award if the award is an apportioned award.

The amount available to be portioned can be any suitable progressive amount, fixed amount or randomly determined varying amount. Multiple embodiments are described below for providing multiple players an award from a single activation or spin of the shared display or wheel, which can be multiple awards apportioned from the same available amount or one or more apportioned award in combination with a different type of award, such as credits, multipliers and free spins.

Also described herein are multiple embodiments for handling any portion of the available amount not provided to one or more player. For example, the non-provided amount can be used to start a new progressive, fixed or random available amount. Alternatively, such non-provided amount can go to the house but be figured into the overall payout equation to benefit the players.

The present invention may be employed in a primary or base game or, a secondary or bonus game or any suitable type of game such as poker, blackjack, roulette, dice, slots, multi-line slots or any other suitable wagering game.

It is therefore an advantage of the present invention to provide a gaming device having a multi-coordinate wheel with an alternating bonus award where awards and award percentages are associated with multi-coordinate locations on the award wheel.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

Gaming Device and Electronics

Figure 1A:
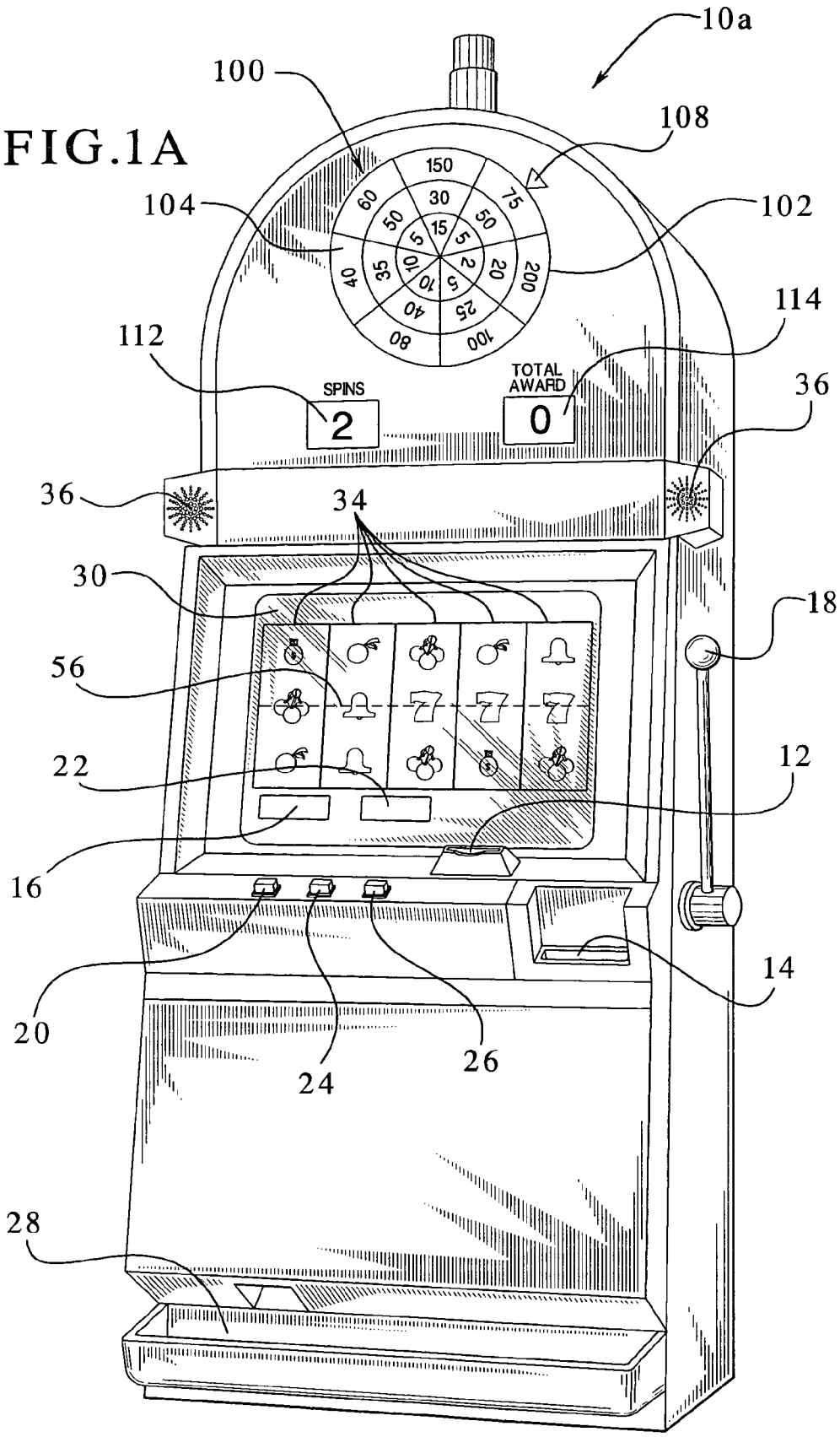
FIG. 1A is a front perspective view of one embodiment of the gaming device of the present invention which includes a mechanical multi-coordinate award wheel.
Figure 1B:
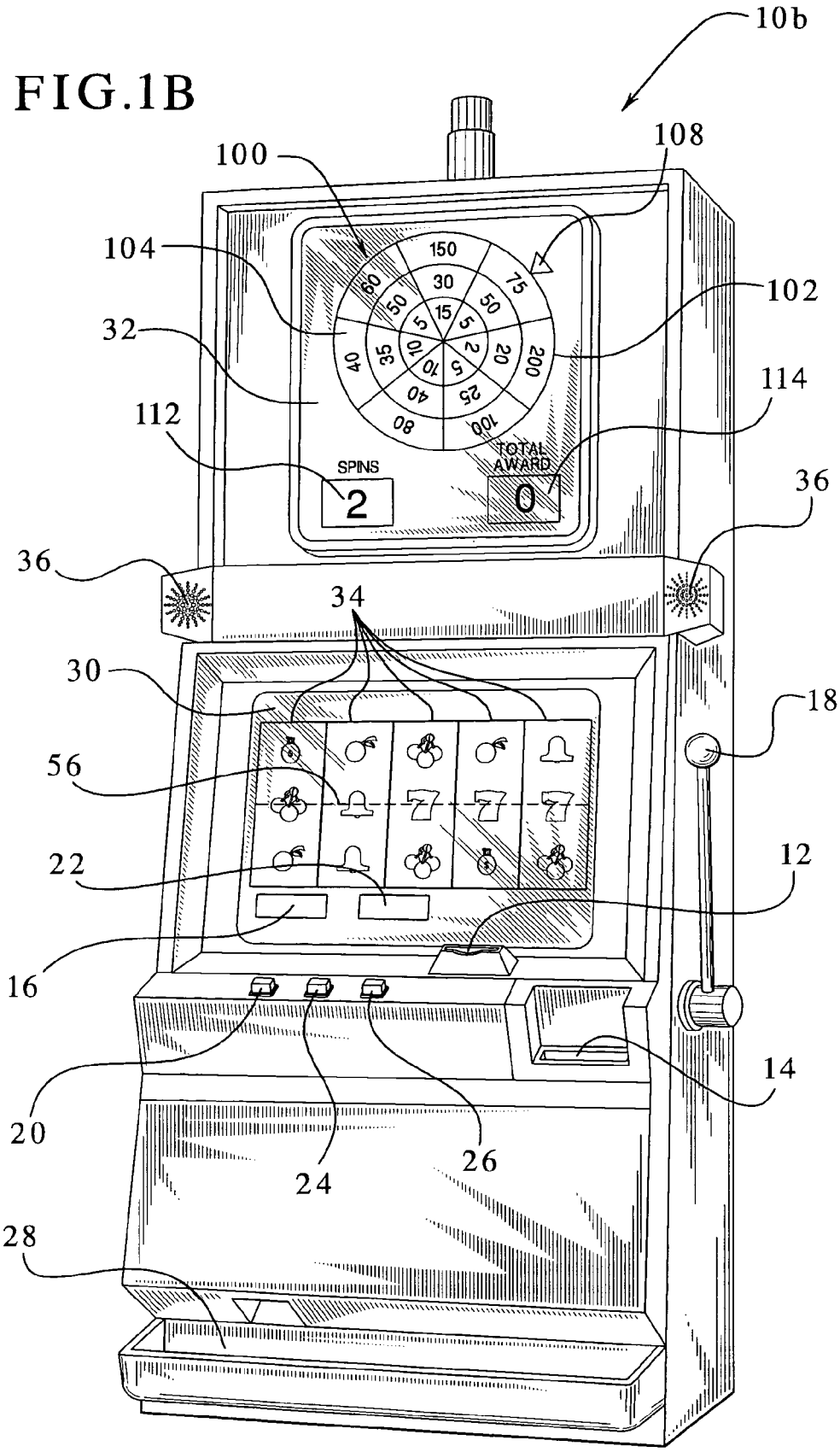
FIG. 1B is a front perspective view of another embodiment of the gaming device of the present invention which includes a multi-coordinate award wheel in a video format.

Referring now to the drawings, two embodiments of the gaming device of the present invention are illustrated in FIGS. 1A and 1B as gaming device 10*a* and gaming device 10*l*, respectively. Gaming device 10*a* and/or gaming device 10*l* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, black jack, poker or keno, any of the bonus triggering events and any of the bonus round games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30 and a mechanical multi-coordinate award wheel 100 that physically spins in front of a player. The award wheel is divided into a plurality of annular areas 102 that are further divided into sections 104 where each section is indicated by a section indicator 108. The alternative embodiment shown in FIG. 1B includes a central display device 30 as well as an upper display device 32. The upper display device 32 displays the multi-coordinate award wheel 100 of the present invention in a video format.

Gaming device 10 in one embodiment preferably displays a plurality of reels 34 such preferably three to five reels 34 in mechanical or video form, on one or more of the display devices. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
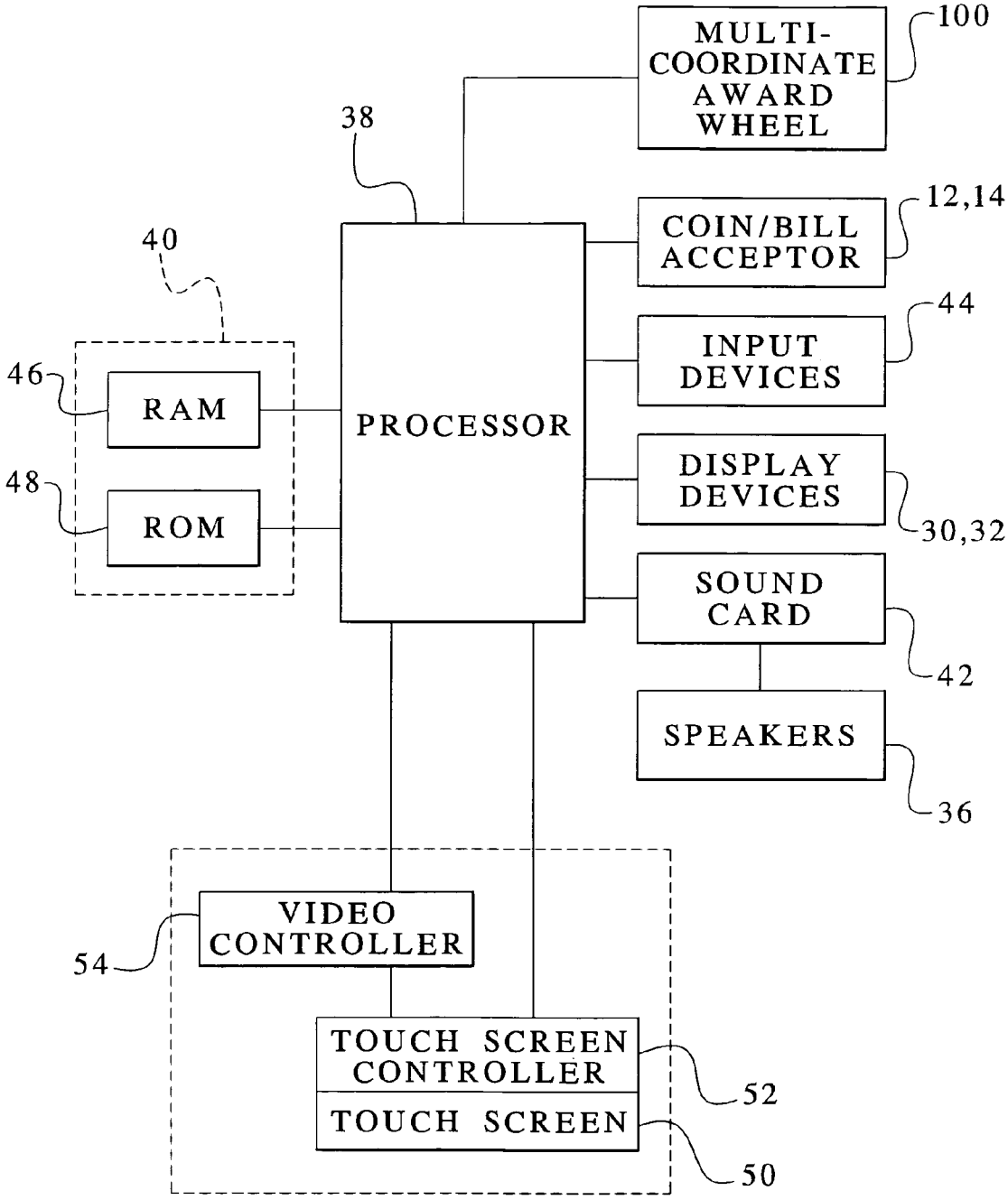
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; one or more input devices 44; and an optional mechanical multi-coordinate award wheel 100. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on one or more of a plurality of the reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Game

Figure 3:
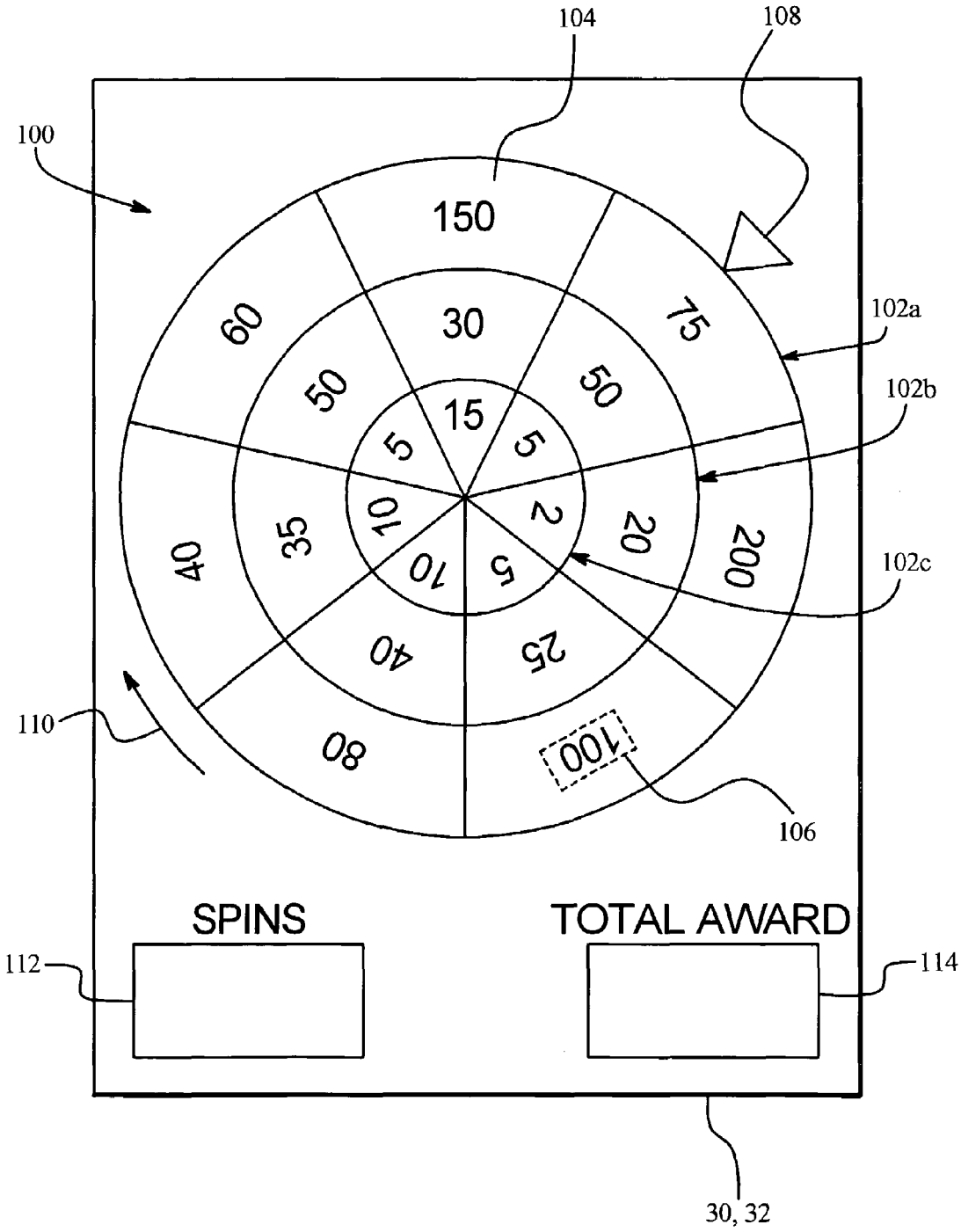
FIG. 3 is an enlarged elevation view of a display device illustrating one embodiment of the present invention.

Referring to FIG. 3, the gaming device 10 includes an award distributor such as a multi-coordinate award wheel 100. In one embodiment, the award wheel 100 is displayed on a video display device such as display device 32 in FIG. 1B. In another embodiment, the award wheel is a mechanical wheel that is physically attached to the gaming device. The award wheel 100 is divided into multiple annular areas 102 where any suitable number of annular areas may be employed by the game implementor. Each annular area 102 is divided into a plurality of sections 104. An award 106 or award symbol is associated with each section 104. In one embodiment, a bonus number of credits is associated with each award symbol. However, it should be appreciated that an award does not have to be associated with each section and that a multiplier, zero award, negative award or other type of modifier may be associated with one or more awards or award symbols on the award wheel.

In operation, the multi-coordinate award wheel alternately illuminates the annular areas 102*a* to 102*c*. In one embodiment, the gaming device randomly stops on one annular area 102*a*, 102*b*, 102*c*. In another embodiment, a player presses a button or similar input to select an annular area. Once an annular area is determined or selected, the award wheel spins or rotates in a clockwise direction as shown by arrow 110 to indicate a section 104. It should be appreciated that the award wheel can also spin in a counter-clockwise direction if desired. It should also be appreciated that the award wheel and sections thereof may be different shapes and sizes.

A section indicator 108 is positioned adjacent to the outer edge of the award wheel 100. The indicator 108 indicates or points to one of the sections 104 of the award wheel. In FIG. 3, the section indicator 104 is an arrow-shaped component that is positioned along the outer edge of the award wheel 100. It should be appreciated that the section indicator may also include an illumination device that lights up or highlights a section 104 similar to how the annular sections 102*a* to 102*c* are highlighted. An illumination device may be associated with each section or with all of the sections. It should also be appreciated that the award wheel may be stationary and the section indicator may move around the perimeter of the wheel. Alternatively, both the award wheel and the indicator may move at different rates, or in different directions or at different rates in different directions.

The gaming device preferably includes a spin remaining display 112 and a total award display 114. The spin remaining display 112 indicates the number of spins that are remaining in a game. The total award display 114 indicates the value of the bonus awards that the player has accumulated during the bonus game. When the player runs out of spins, the bonus award identified in the total award display 114 is transferred to the player's credit display in a conventional manner.

Referring now to FIGS. 4A through 4F, an example of one embodiment of the present invention is illustrated where the gaming device provides a player with three spins to start the bonus game. In this example, the multi-coordinate award wheel 100 has three annular areas 102*a*, 102*b*, 102*c*, and several sections 104 that include awards 106.

Figure 4A:
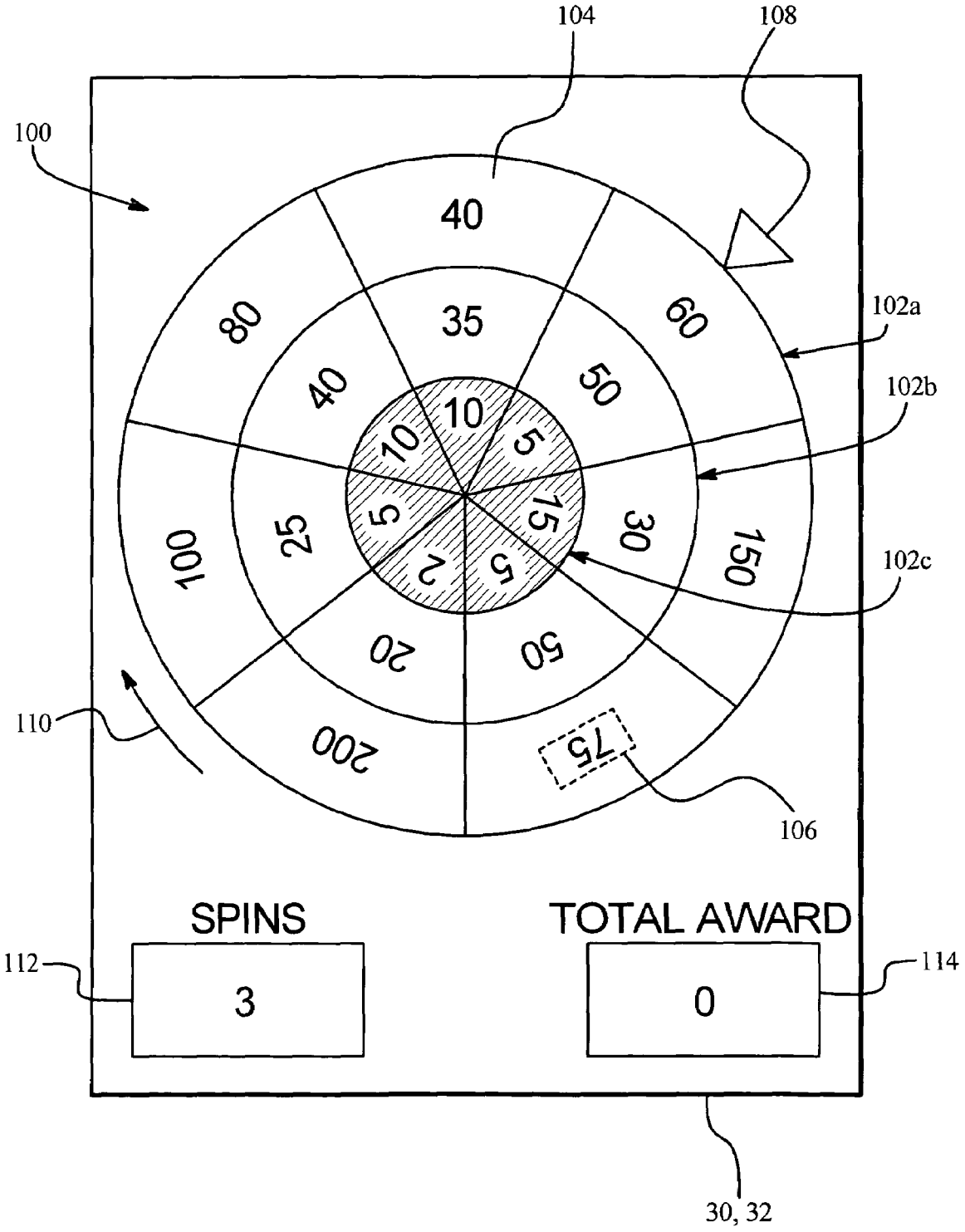
FIGS. 4A, 4B, 4C 4D, 4E and 4F are enlarged elevation views of a display device of the present invention illustrating three spins of the multi-coordinate award wheel in the bonus game.

Referring to FIG. 4A, the gaming device displays several sections 104 on an award wheel 100, where each section has a coordinate location on the award wheel 100. In this example, the coordinate location of each section is defined by a radial coordinate and an angular coordinate. The radial coordinate defines a sections' radial distance from the center of the award wheel or the annular area 102 that contains the section. The angular coordinate defines the location of the section along the perimeter of the award wheel. It should be appreciated that the coordinates of a section may be predefined or randomly determined by the processor. It should also be appreciated that the coordinates may be any coordinates defined by the game implementor.

At the start of the bonus game, the gaming device alternately illuminates the annular areas 102*a* to 102*c*. The areas illuminate one at a time where area 102*a* illuminates first, followed by area 102*b* and 102*c*. The gaming device repeats this sequence until a radial coordinate or annular area 102 is determined. It should be appreciated that the areas 102 may illuminate in any order or sequence desired by the game implementor. The gaming device stops alternately illuminating the areas after determining the radial coordinate of a section. In another embodiment, a player input determines the radial coordinate.

After the radial coordinate is identified or indicated, the gaming device spins the award wheel 100 to determine the angular coordinate of the award section. It should be appreciated that the player may physically spin the award wheel 100 to determine the angular coordinate of the award section. The gaming device spins the award wheel 100 in a clockwise direction as shown by arrow 110. After the award wheel 100 stops spinning, the symbol indicator 108 indicates a section 104, which is defined by the radial coordinate and the angular coordinate of the section. The gaming device provides an award 106 associated with the indicated section 104. The award is transferred to the total award display 114 and the gaming device or player spins the award wheel 100 again if the player has spins remaining in the game as indicated by spins remaining display 112.

Figure 4B:
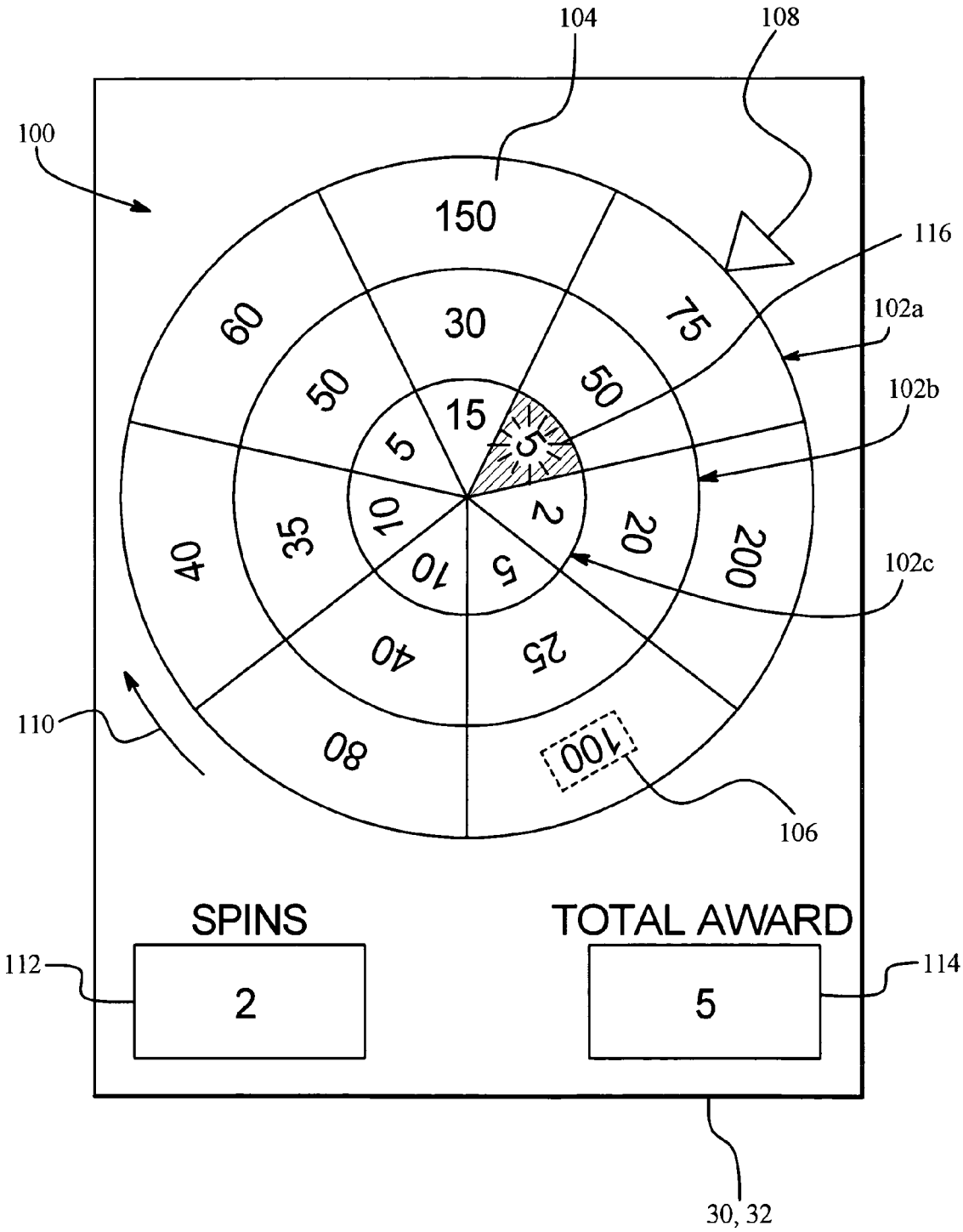

In FIG. 4A, the gaming device alternately illuminates the annular areas 102, and stops on annular area 102*c* or the innermost annular area of the multi-coordinate award wheel 100. Referring to FIG. 4B, the gaming device spins the award wheel in a clockwise direction to determine the angular coordinate of a section included in the annular area 102*c*. The section indicator 108 indicates section 116 in annular area 102*c*. An award of five is associated with section 116 and this award is transferred to the total award display as indicated by display 114. The player has two spins remaining in the bonus game.

Figure 4C:
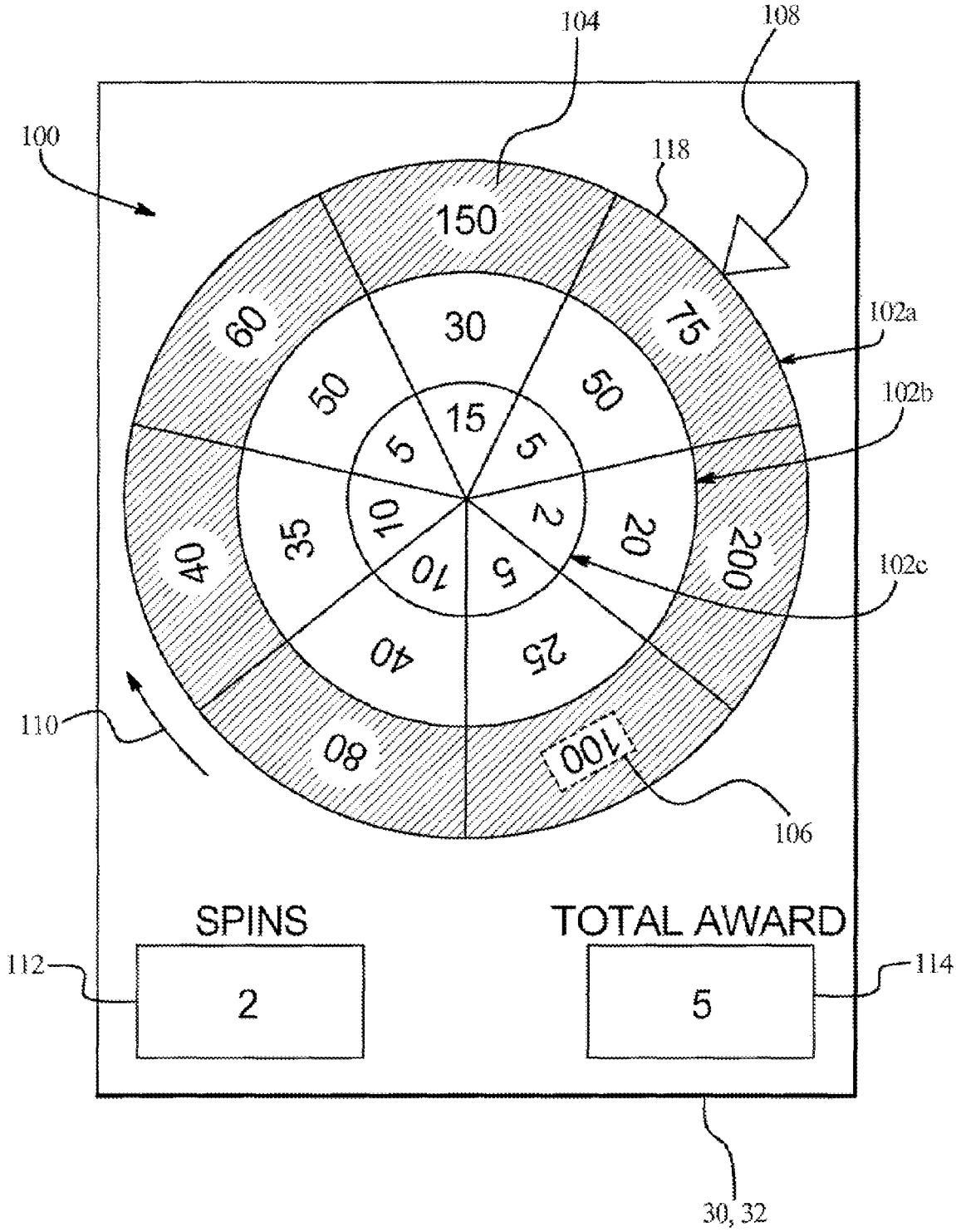
Figure 4D:
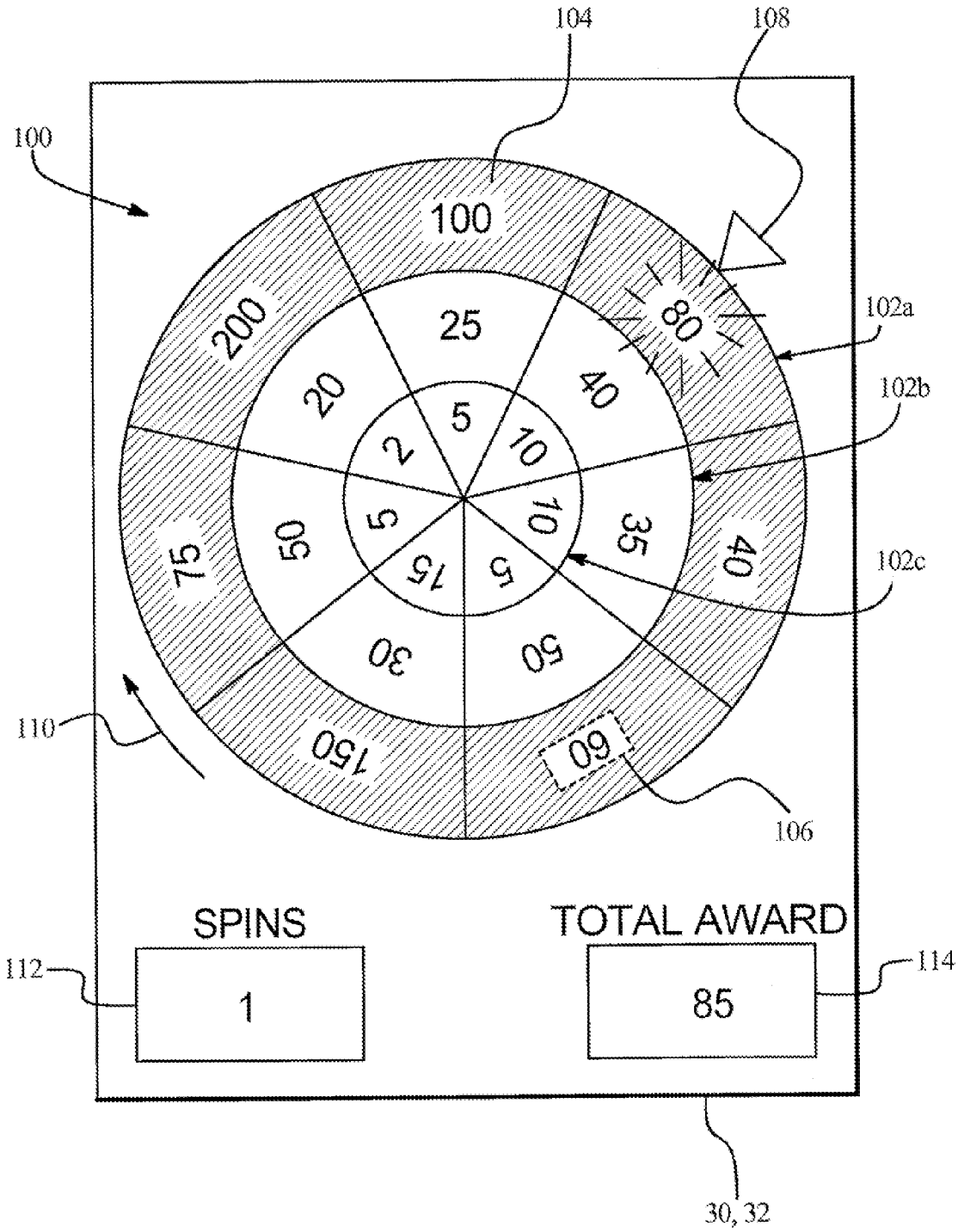

Referring now to FIG. 4C, the gaming device alternately illuminates the annular areas 102*a*, 102*b* and 102*c* again. A radial coordinate or annular area 102 is determined by the gaming device, which is annular area 102*a*. Annular area 102*a* remains illuminated while the gaming device spins the award wheel 100. In FIG. 4D, the award wheel stops spinning and the section indicator 108 indicates a section in the annular area 102*a*. Section 108 is indicated by the indicator and the player receives an award of eighty associated with that section. The award, eighty, is transferred and added to the award indicated by the total award display 114 to give the player a new total award of eighty-five. The player has one spin remaining in the bonus game as indicated by spins remaining display 112.

Figure 4E:
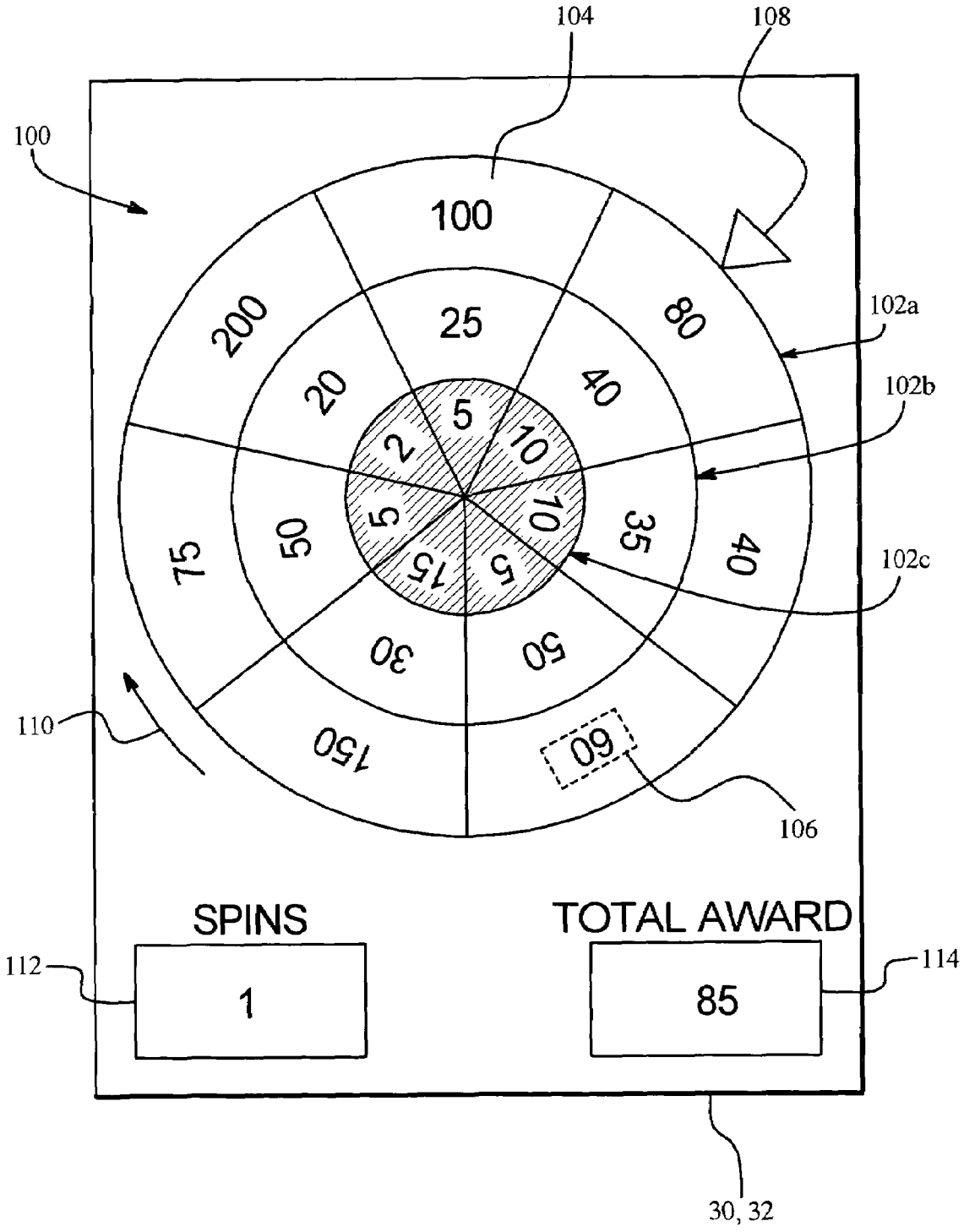
Figure 4F:
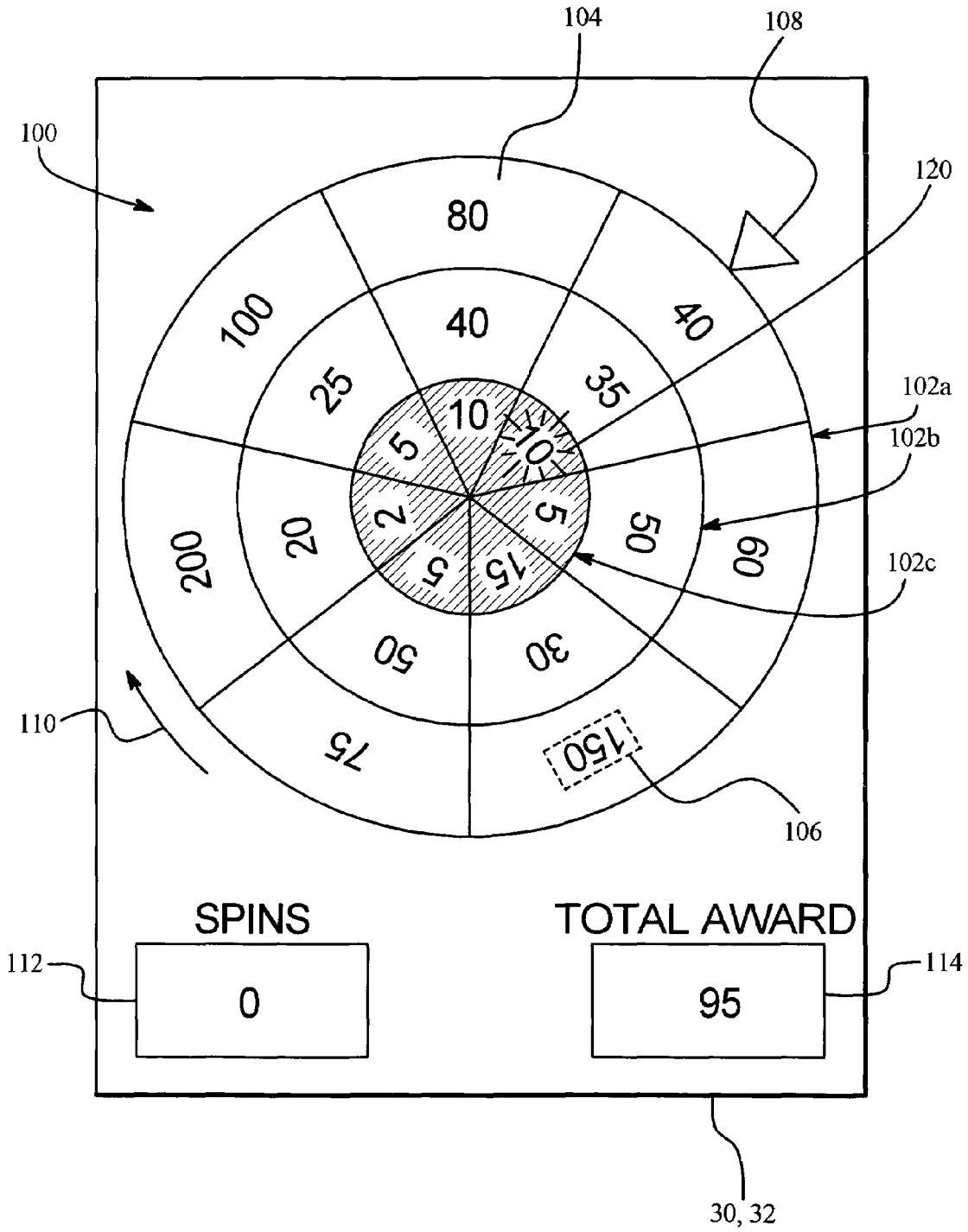

Referring now to FIG. 4E, the gaming device alternately illuminates the annular areas 102 until selecting area 102*c*. Annular area 102*c* remains illuminated and the gaming device spins the award wheel 100. In FIG. 4F, once the award wheel stops, the section indicator 108 indicates section 120. An award of ten associated with section 120 is transferred and added to the total award displayed in the total award display 114. The new total award equals ninety-five as indicated by the total award display 114. The player does not have any spins remaining as indicated by spin display 112 and therefore, the bonus game ends.

Figure 5:
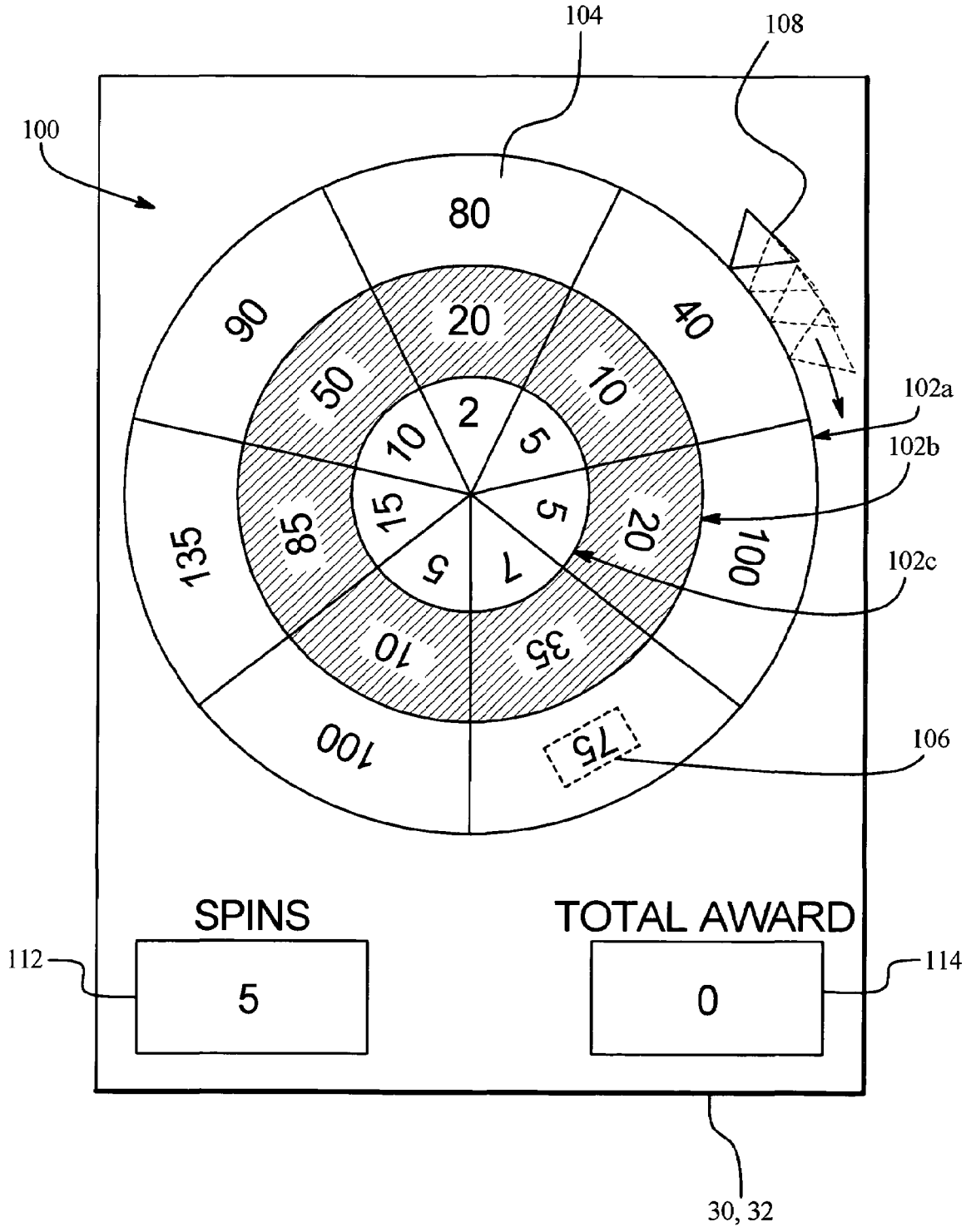
FIG. 5 is an enlarged elevation view of another embodiment of the present invention where the section indicator moves about the perimeter of the multi-coordinate award wheel.

Referring now to FIG. 5, another embodiment of the present invention is illustrated where the multi-coordinate award wheel is stationary and the section indicator 108 moves in a clockwise direction along the perimeter of the award wheel. In this embodiment, the section indicator 108 may move in a clockwise or counter clockwise direction to indicate a section 104.

Figure 6:
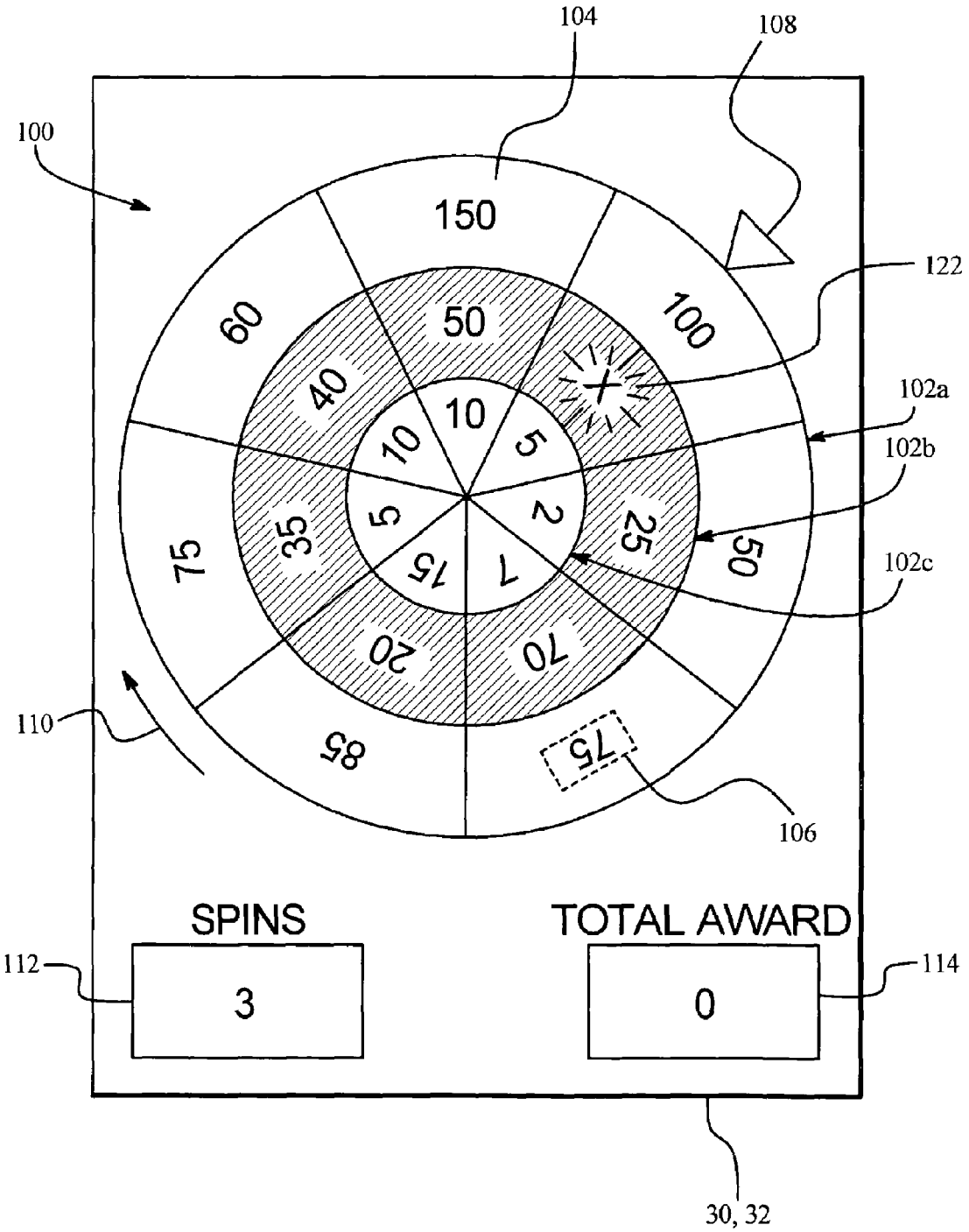
FIG. 6 is an enlarged elevation view of a further embodiment of the present invention where the multi-coordinate award wheel includes a terminator.

Referring to FIG. 6, another embodiment of the present invention includes one or more terminators 122, where the terminator is represented by the letter "X." If a player obtains a section associated with a terminator, the bonus game ends regardless of how many spins remain in the game. In this embodiment, the player attempts to obtain as many awards as possible before obtaining a terminator or running out of spins. It should be appreciated that a section including a terminator may be associated with a probability such that the coordinates of that section are more likely to be selected by the gaming device than the coordinates of a section associated with an award.

Because there are several different sections 104 including a plurality of awards 106 and one terminator 122, the coordinates are preferably associated with probabilities or weighted such that one coordinate is more likely to be indicated by the processor or indicator than another coordinate. In one embodiment, the coordinates are equally weighted or associated with equal probabilities. For example, if an award wheel has twenty-one sections, there are forty-two coordinates associated with those sections. A player, therefore, has a 1/42 or approximately 2.38% chance of obtaining any one of the coordinates. Therefore in this embodiment, a player's chances of obtaining the coordinates associated with a particular award are equal to their chances of obtaining the coordinates of the terminator.

In another embodiment, the probabilities change after each spin of the award wheel. Coordinates on the award wheel start a bonus game having predetermined probabilities and then the probabilities change after each spin by a player. For example, assume that at the beginning of a bonus game the player has a 2.38% chance of obtaining any coordinate on an award wheel having twenty-one sections. After the player's first spin, the player receives an award. Now the processor alters the probabilities so that the player has a 5% chance of obtaining each coordinate associated with the terminator and a 2.25% chance of obtaining a coordinate associated with any other section on the wheel. Thereafter, the probabilities continue to change after each subsequent spin by the player. It should appreciated that the probability of obtaining the coordinates associated with the terminator may decrease and the probabilities of obtaining the coordinates associated with the awards may increase after a spin, or the awards and terminator may alternately increase and decrease after each spin or change according to whatever probability scheme is desired by the game implementor. It should also be appreciated that the coordinate probabilities may change after the first spin only and remain the same the rest of the bonus game or change after any number of spins desired.

In another embodiment, the coordinate probabilities change after a predetermined number of spins of the award wheel. In this embodiment, the implementor sets the probabilities to change after a certain number of spins so that a coordinate having a terminator is more likely or a coordinate associated with a section having a large award is less likely the further the player goes into a bonus game. By adjusting the coordinate probabilities in this manner, the game implementor limits the award amounts that the gaming device pays to players. It also limits the likelihood that a player will obtain the one substantially large award on a spin of the award wheel.

For example, assume that an award wheel has twenty sections and a player starts the bonus game with a 2.5% probability of obtaining each coordinate on the wheel. Before the fourth spin of the award wheel, the coordinate probabilities are programmed to change so that there is a 10% chance of obtaining each coordinate associated with the terminator and approximately a 2.11% chance of obtaining each coordinate associated with a section. Now the player is more likely to obtain a terminator with each subsequent spin than any single award associated with a section.

Similarly, a bonus game could be programmed to decrease the probability of obtaining coordinates associated with a large award section after a certain number of spins. Therefore, a player still has the possibility of obtaining the large award, but the probability is less. For example, an award wheel having twenty-one sections, including one terminator and one large award section, starts a bonus game where a player has an equal probability of approximately 2.38% of obtaining each coordinate on the award wheel. The gaming device is programmed to decrease the probability of obtaining each coordinate of the large award section after five spins to 0.25%. Therefore after five successful spins of the award wheel, the probability of obtaining each coordinate of the large award section decreases to 0.25% and the probabilities of obtaining any one of the other coordinates associated with the other sections increases to 2.49%.

In a further embodiment, total awards or award payouts in a bonus game are associated with probabilities. In this embodiment, the processor of the gaming device is programmed so that relatively larger awards are less likely than relatively smaller awards, or vice versa, in a bonus game. Therefore the game implementor controls the award amounts that are paid out by the gaming device without affecting the player's excitement and enjoyment of playing the game. For example, a processor is programmed to award values of zero through fifty in 60% of the bonus games, 51 through 100 in 30% of the bonus games and over 100 in only 10% of the bonus games in a particular gaming device. Based on the probabilities, the processor picks a total award value for the bonus game and subsequently determines the number of spins and the award amounts for each spin for the game. Thus, the total award is predetermined before the game ever starts, yet the player plays the bonus game as if the award is still to be determined.

In yet another embodiment, each section is associated with a probability such that one section is more likely to be indicated than another section on the award wheel. For example, sections including large value awards have a lower probability of being indicated by the indicator than sections including relatively lower valued awards.

In each of the above embodiments, the players always have an opportunity or chance to obtain each section on the award wheel whether the section includes a terminator or an award. Therefore, although the section probabilities may change in a bonus game, the players maintain their excitement and enjoyment of the bonus game.

Figure 7:
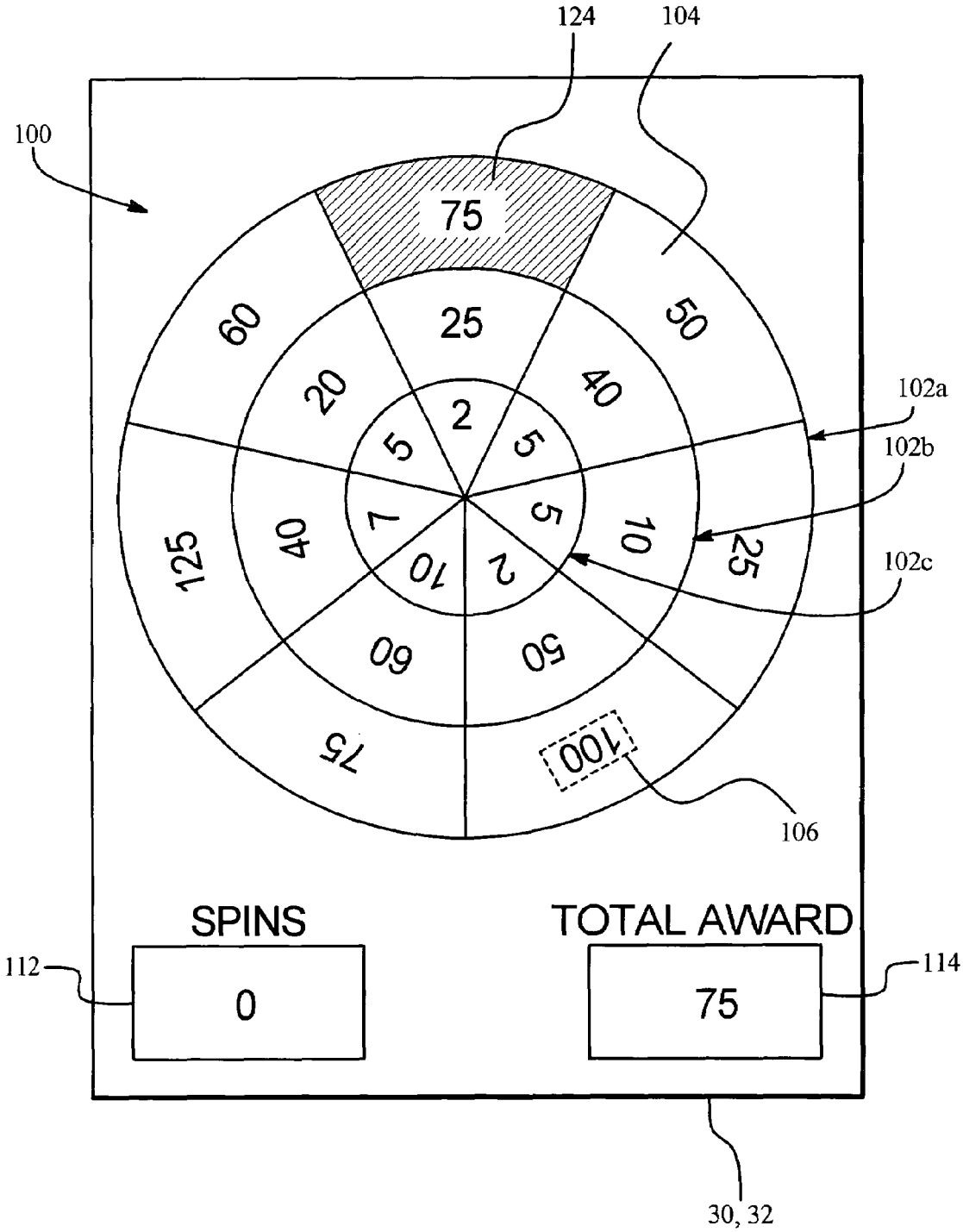
FIG. 7 is an enlarged elevation view of a further embodiment of the present invention where the multi-coordinate award wheel is stationary and the sections alternately illuminate to provide an award to the player.

Referring now to FIG. 7, a further embodiment of the present invention where the annular areas 102 are alternately illuminated until an area is selected by the gaming device. Then the sections 104 within the selected annular area 102 are alternately illuminated until a section is selected. For example, the annular area 102*a* was selected by the gaming device. Then the gaming device selected section 124 within annular area 102*a* as the section provided to the player. The player receives an award of seventy-five associated with section 124.

Figure 8:
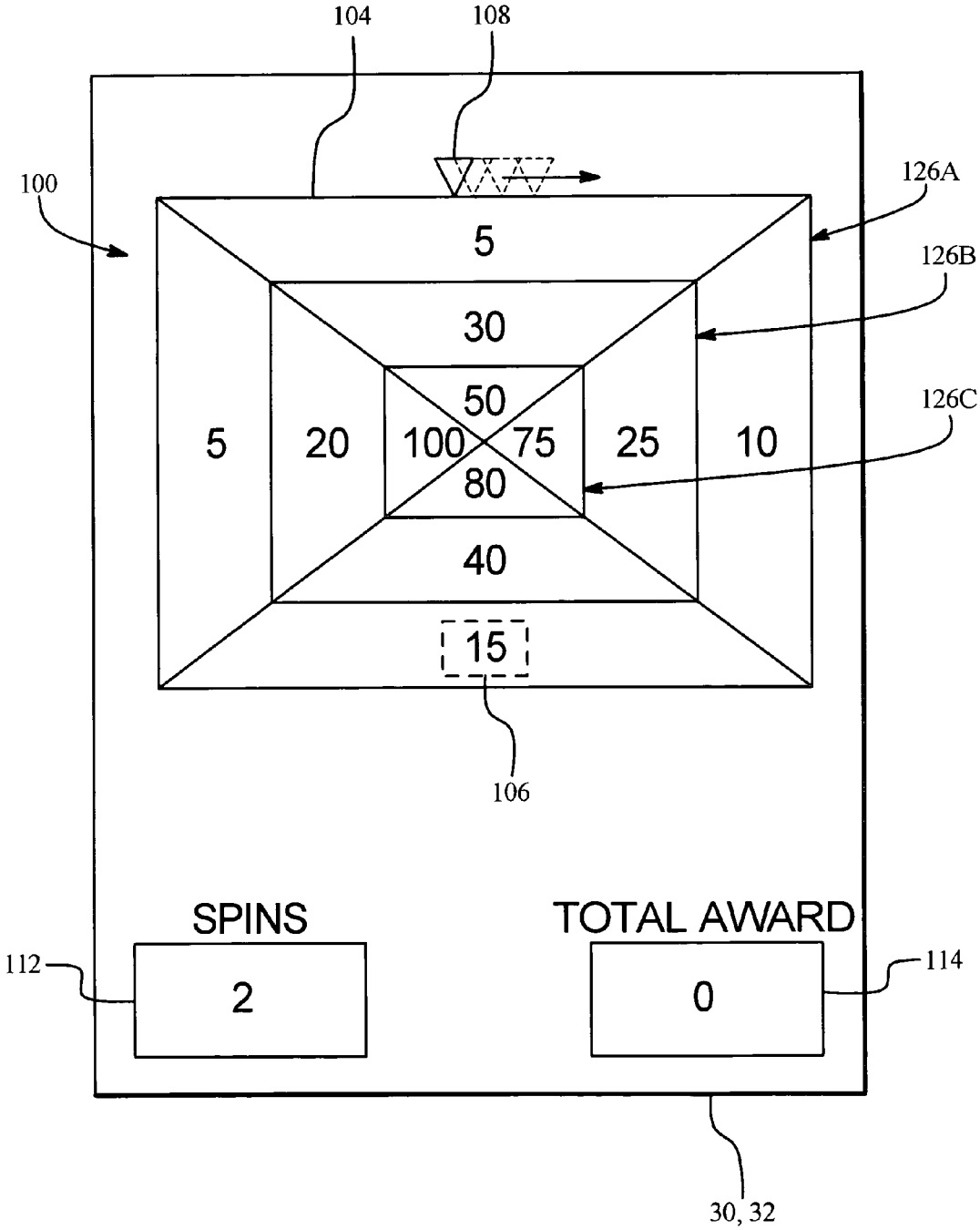
FIG. 8 is an enlarged elevation view of a further embodiment of the present invention where the sections are arranged in a square configuration.

Referring now to FIG. 8, another embodiment of the present invention is illustrated where the multi-coordinate award wheel 100 is a square. The award wheel 100 may be any shape or configuration as desired by the game implementor. In FIG. 8, the award wheel 100 includes square areas 126*a*, 126*b* and 126*c*. Each area is further divided into sections 104 that include awards 106. The sections each have an X coordinate and a Y-coordinate. An X,Y coordinate defines each of the sections displayed to the player. In operation, the gaming device alternately illuminates square areas 126*a* to 126*c* one at a time. The gaming device then picks one of the areas. Once an area 102 is picked, the section indicator 108 moves along the perimeter of the outside square 102*a* until a section is indicated. When the section indicator stops, a section 104 within the illuminated area 126 is determined. The award associated with this section is provided to the player and displayed in the total award display 114. The player continues to play the bonus game until the player runs out of spins in the bonus game.

In another embodiment of the present invention is illustrated where the award wheel sections 104 include an annular area 102 that has several low value awards, an annular area that has medium value awards and a annular area that has several high value awards. The probability of obtaining each low value award is preferably greater than the probability of obtaining the high value awards or the terminator. The award disparity creates enhanced levels of excitement for players because the player may obtain the large award. Additionally, the player is likely to obtain multiple spins in the bonus game because the probability of obtaining a low value award is higher than obtaining the terminator. Thus, each additional spin increases the players excitement and enjoyment of the game because each spin means an additional opportunity to obtain the large award. Even if the player does not obtain the large award, the player still obtains several awards in the bonus game and may accumulate a large award before obtaining a terminator.

It should be appreciated that the terminator symbol could be a blank symbol and that one or more blank symbols could function as terminator symbol or can have no function or other functions. For instance, the occurrence of one or more blank symbols could provide alternative awards.

Figure 9:
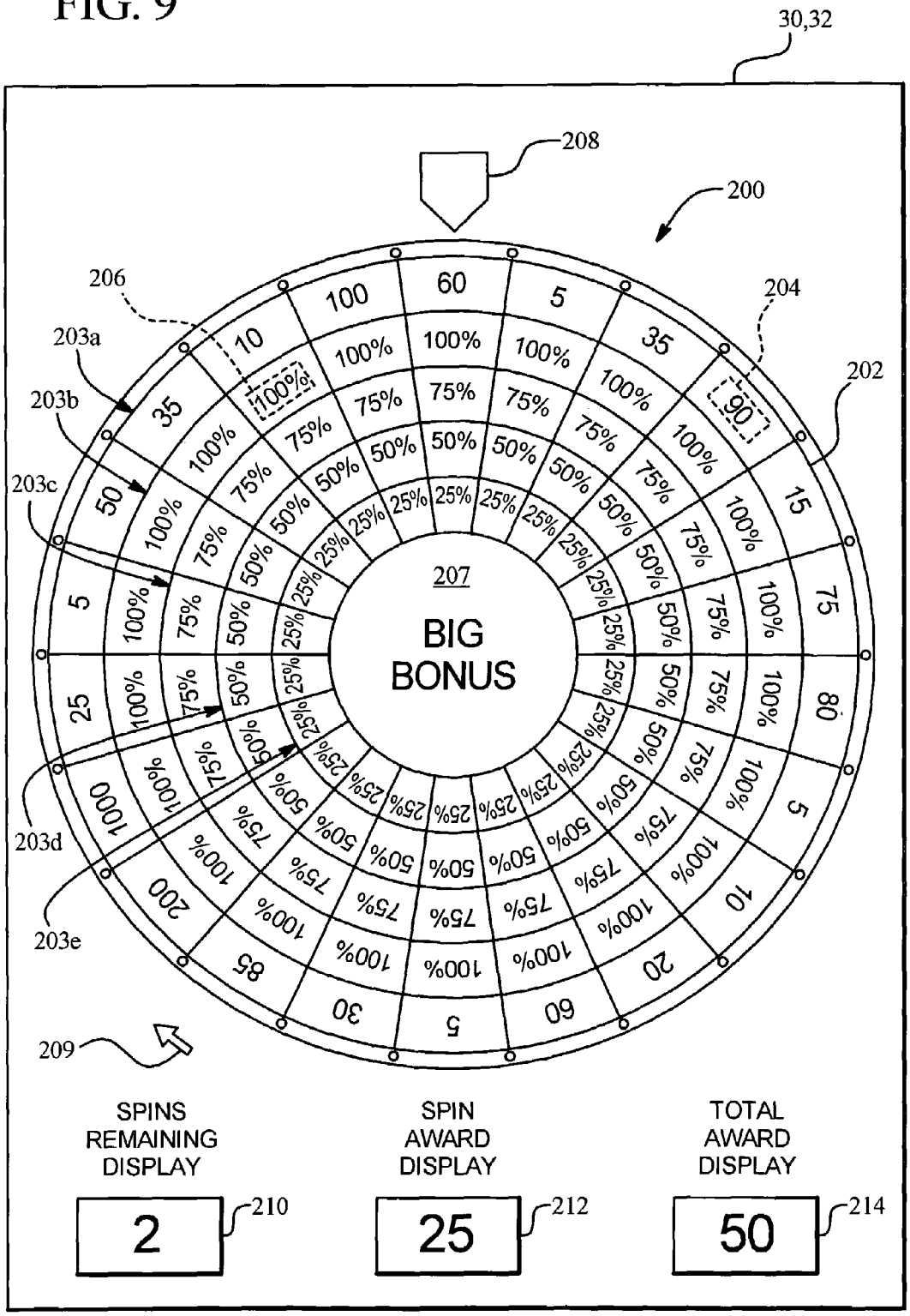
FIG. 9 is an enlarged elevation view of an alternative embodiment of the present invention where the sections of the wheel include awards and percentages of those awards.

Referring now to FIG. 9, an alternative embodiment of the present invention is illustrated where the sections 204 on the award wheel 200 include a plurality of awards and a plurality of award percentages. Specifically, the award wheel 200 includes a plurality of sections 202, wherein the sections are arranged in a plurality of groups. The groups of sections include a symbol group, which includes the sections in annular area 203*a*, and a plurality of modifier groups, which include the sections in annular areas 203*b*, 203*c*, 203*d* and 203*e*. It should be appreciated that although the groups in this embodiment include the sections in the annular areas on the award wheel 200, the groups may include any suitable number of sections or arrangement of sections.

In one embodiment, a plurality of awards, such as award values or credits, are associated with the sections in the symbol group or annular area 203*a*. The awards may include values, multipliers, modifiers, monetary prizes, non-monetary prizes, physical prizes or any suitable type of award. It should also be appreciated that any of the annular areas or groups on the award wheel 200 may include sections having one or more awards.

A plurality of award portions or award percentages 206 are associated with the sections in the modifier groups or annular areas 203*b*, 203*c*, 203*d* and 203*e*. In this embodiment, modifier group or annular area 203*b* includes award percentages of 100% associated with each of the sections in this group. Modifier group or annular area 203*c* includes award percentages of 75% associated with each of the sections in the group. Modifier group or annular area 203*d* includes award percentages of 50% associated with each of the sections in the group. Additionally, modifier group or annular area 203*e* includes award percentages of 25% associated with each of the sections in this group. It should be appreciated that the award percentages may be any suitable award percentage desired by the game implementor. In one embodiment, as shown in FIG. 9, the award percentages associated with the sections in each of the modifier groups are the same. In another embodiment, the award percentages associated with the sections in each of the modifier groups are different. It should be appreciated that at least one of the award percentages, a plurality of the award percentages or all of the award percentages associated with the sections within each of the groups may be different. Additionally, the award percentages associated with the sections may be different from group to group. For example, as shown in FIG. 9, the award percentages associated with modifier group 203*e* are less than the award percentages associated with modifier group 203*d*. Similarly, the award percentages associated with modifier groups 203*c* and 203*b* incrementally increase. It should be appreciated that the award percentages associated with the sections in the groups may increase from the innermost annular area or modifier group 203*e* to the outermost annular area or group 203*b*. The award percentages may also decrease from modifier group or annular area 203*e* to modifier group or annular area 203*b*. It should be appreciated that any suitable award percentages may be associated with the sections in each of the modifier groups. Furthermore, the award percentages in FIG. 9 are shown as percentages or percentage values. However, the award percentages may be represented as fractions, decimals or any other suitable type of award portion, fraction or percentage.

As will be explained below, the gaming device indicates an award percentage and an award in each activation or spin of the award wheel 200. The indicated award percentage is multiplied by the or applied to an indicated award in the symbol group to provide an activation or spin award to the player for that activation or spin. For example, when an indicated section includes an award percentage of 25% (0.25), the gaming device provides the player with 25% of the award associated with the indicated section in the symbol group. In other words, the gaming device multiplies the indicated award by 0.25 to provide an activation award to the player for that activation or spin. Similarly, the gaming device provides 50%, 75%, and 100% of the indicated awards when each of those award percentages are indicated on the award wheel.

In one embodiment, each of the modifier groups or annular areas 203*a*, 203*b*, 203*c*, 203*d* and 203*e* are included on the same wheel and rotate in the same direction. In another embodiment, at least one of the modifier groups or annular areas 203 is included on a separate wheel from the other annular areas. In this embodiment, the wheels may rotate in the same direction or in different directions. In a further embodiment, each of the modifier groups or annular areas 203 are included on separate wheels. The wheels may rotate in the same direction, at least one may rotate in different directions from the other wheels or a plurality of the wheels may rotate in a different direction. It should be appreciated that the modifier groups 203 may be included on the same or different wheels and rotate in any suitable direction desired by the game implementor. It should also be appreciated that the award wheel 200 may be stationary and the section indicator 208 may rotate about the perimeter of the award wheel in a clockwise or counterclockwise direction.

The gaming device also includes a bonus award such as a big bonus award 207. In one embodiment, the gaming device provides a player with the big bonus award 207 when the player accumulates all of the sections associated with an award (i.e., each of the sections associated with an award are indicated or illuminated in the game). It should be appreciated that the big bonus award may be provided to the player based on any suitable number of indicated sections in the game, or other combinations of indicated sections in the game. The big bonus award 207 indicated in the middle of the award wheel 200 includes a masked or hidden award that is provided to the player by the gaming device when all of the award percentages associated with a particular award indicated in the game (i.e, in the number of spins of the wheel provided to the player). It should be appreciated that the big bonus award may be provided to the player when a designated number of sections in an annular area, a plurality of annular areas, a pie-shaped section, a plurality pie shaped sections, or any other suitable section or area on the wheel are indicated in a game. The big bonus award may be an award value, a modifier, a multiplier, free spins, free games or any other suitable award. The big bonus award 207 is provided to the player in the game or in a subsequent game (i.e, free spins) or added to the player's total award in the game (i.e, an award value or credits). It should be appreciated that the big bonus award 207 may be masked or displayed to the player in the game.

Additionally, a spins remaining display 210 indicates the number of spins remaining in the game. A spin award display 212 (or activation award display) and a total award display 214 indicate the award associated with a particular activation or spin in the game and the total accumulated award provided to the player in the game, respectively.

Referring to FIGS. 10A to 10M, an example of the embodiment of FIG. 9 is illustrated where the gaming device provides a player with six activations or spins at the beginning of the game. Also, the player's total award is zero as indicated by the total award display 214. In this example, the award wheel 200 includes a plurality of sections 202. The sections are included in a plurality of groups on the wheel. The groups include a symbol group or annular area 203*a* and a plurality of modifier groups or annular areas 203*b*, 203*c*, 203*d* and 203*e*. A plurality of awards 204 are associated with the sections of the symbol group 203*a* and a plurality of award percentages 206 are associated with the sections in modifier groups 203*b*, 203*c*, 203*d*, and 203*e*. It should be appreciated that the sections in the modifier groups 203*b*, 203*c*, 203*d* and 203*e* may also include fixed amounts such as fixed awards which increase in value from annular area 203*e* to annular area 203*a*, decrease in value from annular area 203*e* to annular area 203*a* or include any suitable fixed amounts or awards. In this example, the award wheel is a single award wheel including all of the groups of sections or annular areas 203. The wheel rotates or spins in a clockwise direction as indicated by the arrow 209.

Figure 10A:
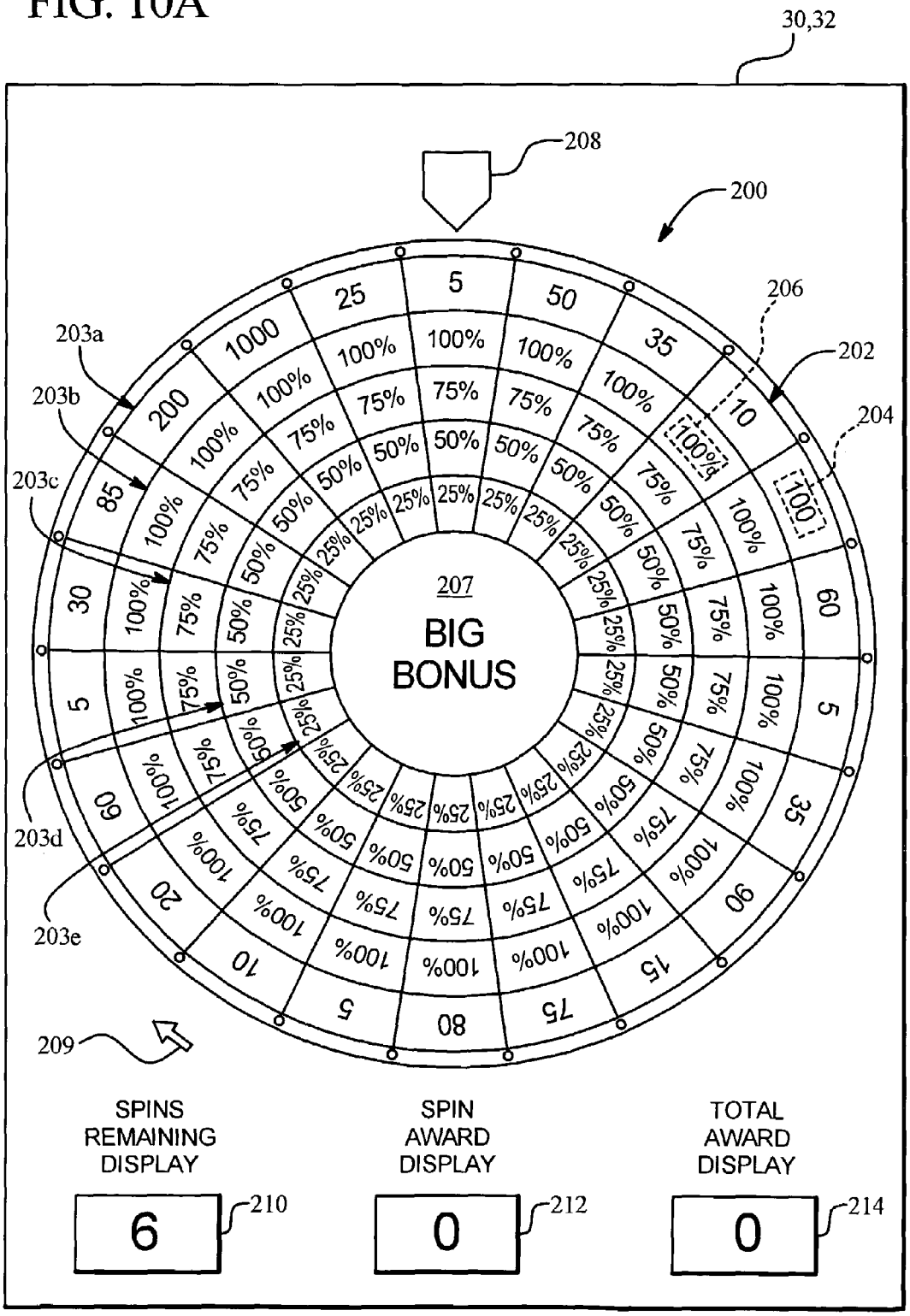
FIGS. 10A, 10B, 10C, 10D, 10E, 10F, 10G, 10H, 10I, 10J, 10K, 10L and 10M are enlarged elevation views of an example of the alternative embodiment of FIG. 9.
Figure 10B:
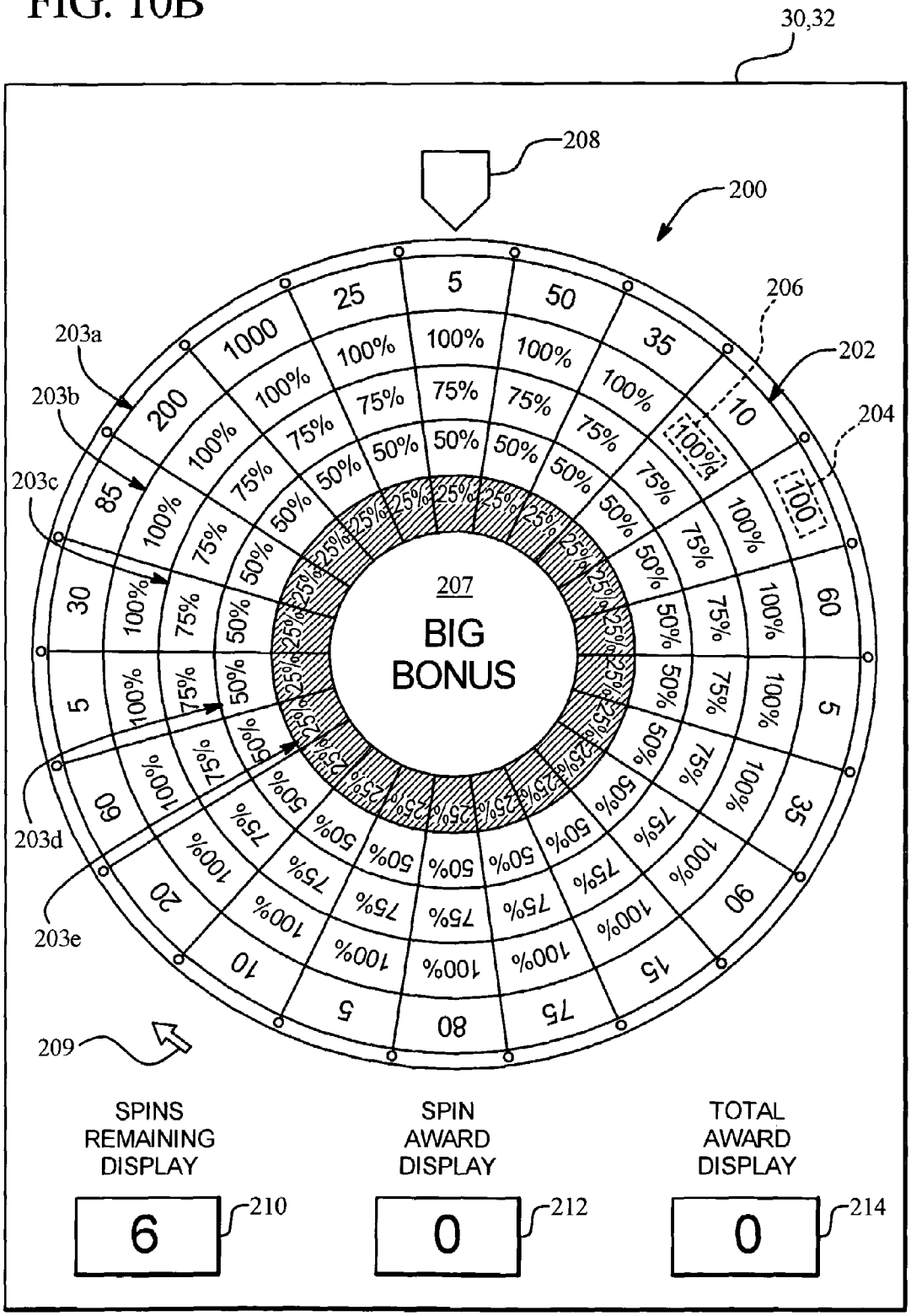

Referring to FIG. 10B initially, the gaming device and processor alternately illuminate each of the groups of sections or annular areas 203 on the award wheel 200. For example, all of the sections and symbol group 203*a* are highlighted or illuminated and then all the sections in modifier group 203*b* are highlighted or illuminated and each subsequent group is then highlighted or illuminated. The indicated modifier group remains highlighted or illuminated until the section indicator 208 indicates one of the sections in that group. This illumination pattern repeats until the processor picks one or stops on one of the groups or annular areas. It should be appreciated that the groups or annular areas 203 may be highlighted or illuminated in any order or sequence. It should also be appreciated that one or more of the groups or annular areas 203 may be simultaneously highlighted or illuminated during the game. Additionally, it should be appreciated that the gaming device may not include a section indicator 208 and therefore indicates the sections on the wheel by illuminating an annular area and then subsequently illuminating a section in the indicated annular area. The sections may also be indicated by raising or lowering the indicated sections on the wheel such as on a mechanical wheel. The raising and lowering of the sections to indicate the sections on the wheel may also be accomplished in a video-type wheel where a three dimensional virtual wheel is displayed to the player. On a video wheel, the individual sections would rise or move upwards to indicate the indicated section on the wheel in a spin. It should be appreciated that one section, a plurality of the sections or all the sections may raise and/or lower simultaneously or alternately in a spin or plurality of spins in a game. As described above, the present invention may employ a mechanical or electrical mechanical wheel, an electronic wheel or a video wheel displayed on a display device.

Figure 10C:
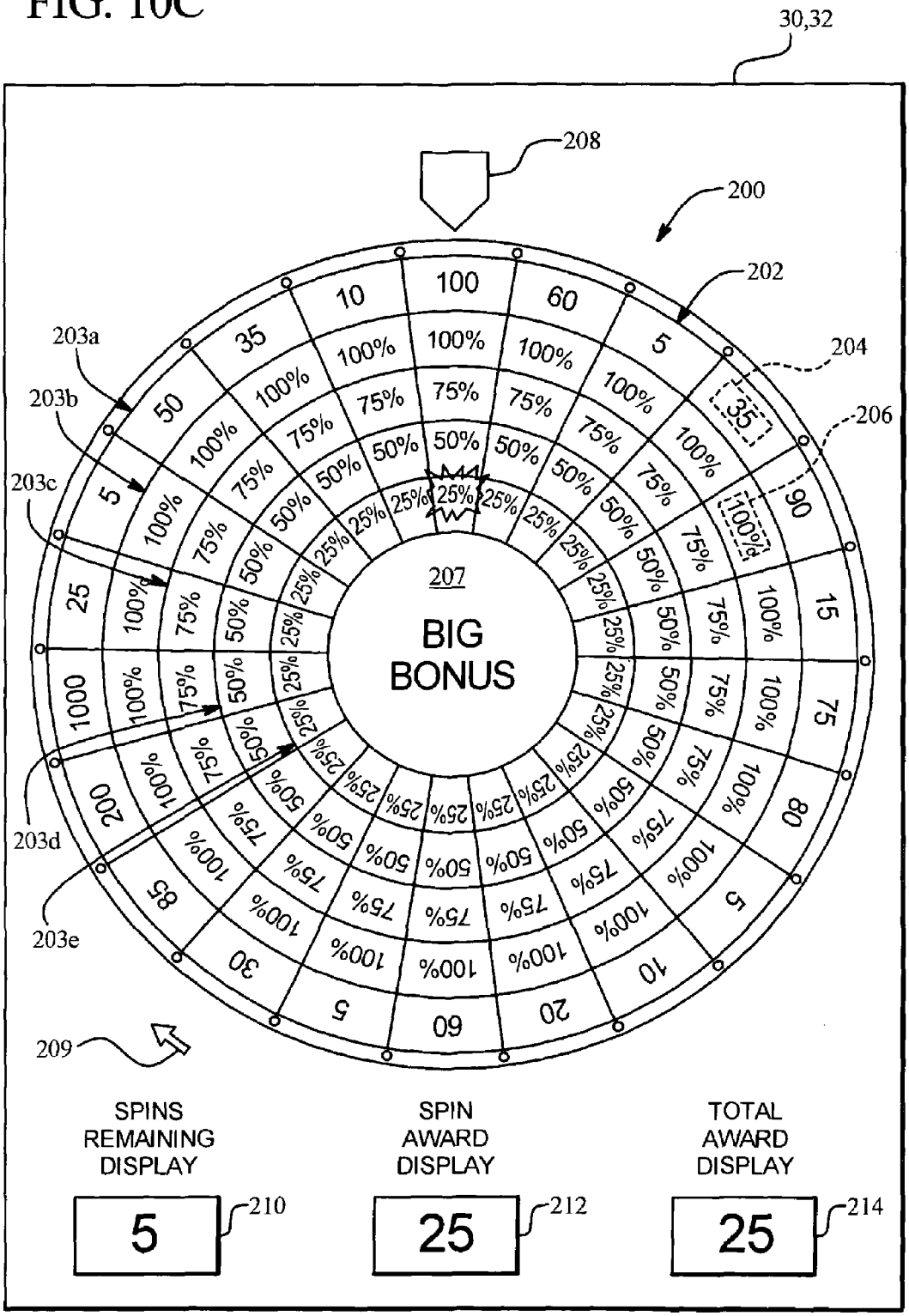

In FIG. 10B, the gaming device alternately illuminates the modifier groups on the award wheel 200 until stopping on modifier group 203*e*. Award percentages of 25% are associated with each of the sections in the indicated modifier group 203*e*. After the group is indicated, the gaming device or player activates or spins the award wheel 200 in a clockwise direction as shown by arrow 209 to indicate one of the sections in the highlighted or indicated modifier group 203*e*. In this example, the gaming device spins the award wheel 200 and the section indicator 208 indicates one of the sections in the modifier group and also one of the sections in the symbol group. The award associated with the indicated section in the symbol group 203*a* is modified by or multiplied by the award percentage associated with the indicated section in the indicated modifier group. Referring to FIG. 10C, the section indicator 208 indicates one of the sections in the symbol group 203*a* having an associated award of one hundred and a section in the modifier group 203*a* having an award percentage of 25%. Thus, the award of one hundred is multiplied by the indicated award percentage 25% to give a multiplied award of twenty-five. The multiplied award is the activation award or spin award for that spin in the game. In this example, the spin award is twenty-five (100×0.25). Because the total award was zero at the beginning of the game, the player's new total award is twenty-five, as indicated by the total award display 214. The player now has five spins remaining as indicated by the spins remaining display 210.

In this example, the award percentage associated with the indicated section on the award wheel remains highlighted or indicated in the subsequent spins in the game. This enables a player to accumulate the award percentages in the game and attempt to accumulate all of the award percentages associated with a particular award in the game. By keeping the indicated sections highlighted or illuminated in the game, the gaming device provides a visual indicator of how the player is progressing in the game and also how many more sections the player needs to obtain to achieve an additional award or big bonus award in the game. Thus, the player's enjoyment and excitement increases in the games. If the player accumulates all of the award percentages associated with a particular award, the gaming device provides the player with the big bonus award 207 as described above. In this example, the gaming device provides an additional award of five hundred for the big bonus award 207.

Figure 10D:
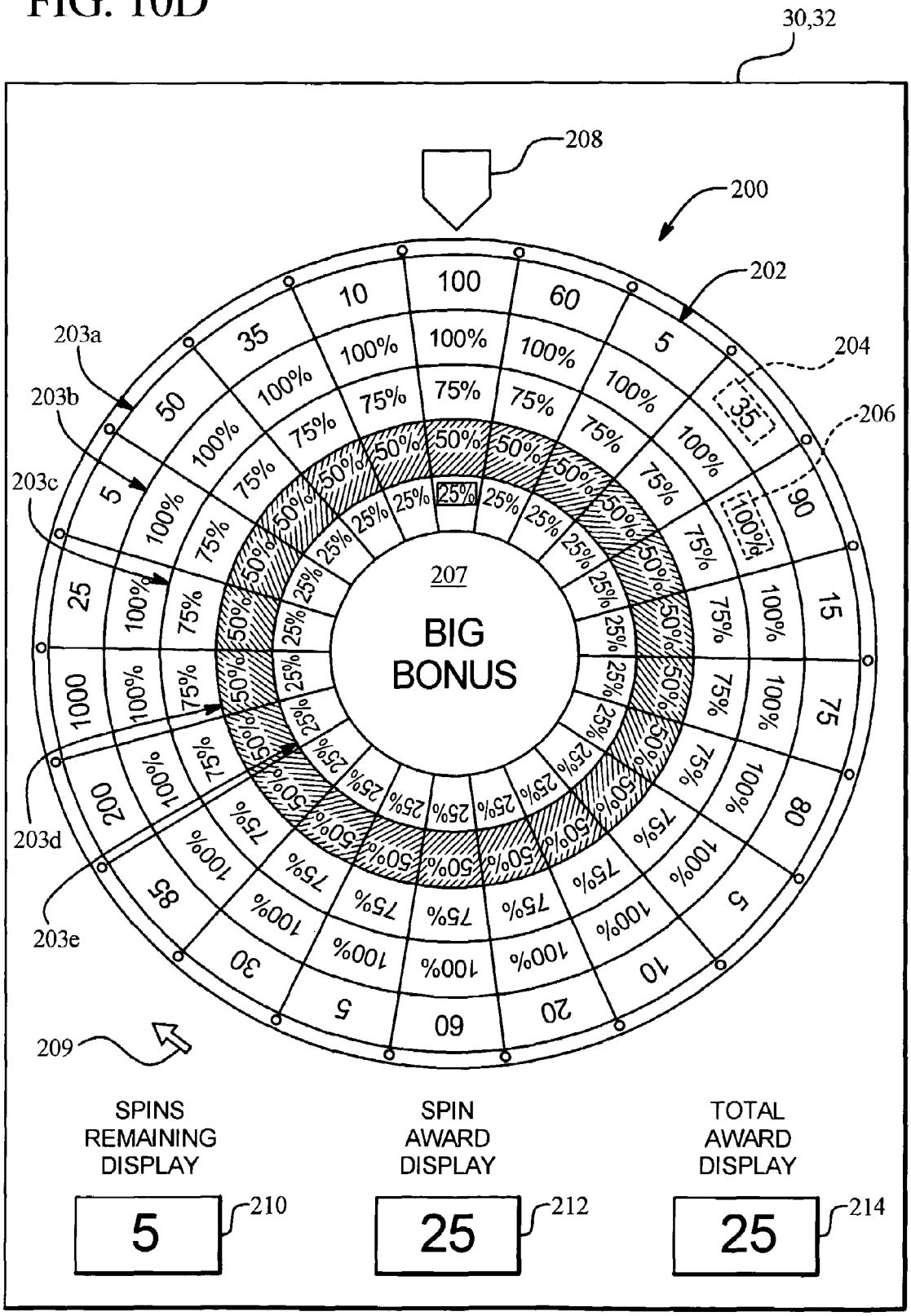

Referring to FIG. 10D, the gaming device alternately illuminates the modifier group or annular areas 203 and stops on modifier group 203*d*. The modifier group 203*d* remains highlighted as shown in FIG. 10C until the gaming device or player spins the wheel to indicate one of the sections in that group. Modifier group 203*d* includes sections having an award percentage of 50% (0.50). Therefore, any award associated with a section indicated by the section indicator 208 in the symbol group 203*a* will be multiplied by 50% or 0.50 to provide the player with a spin award for that spin. As shown in FIG. 10D, the award percentage associated with the indicated section remains highlighted as shown by the box or border around that award percentage.

Figure 10E:
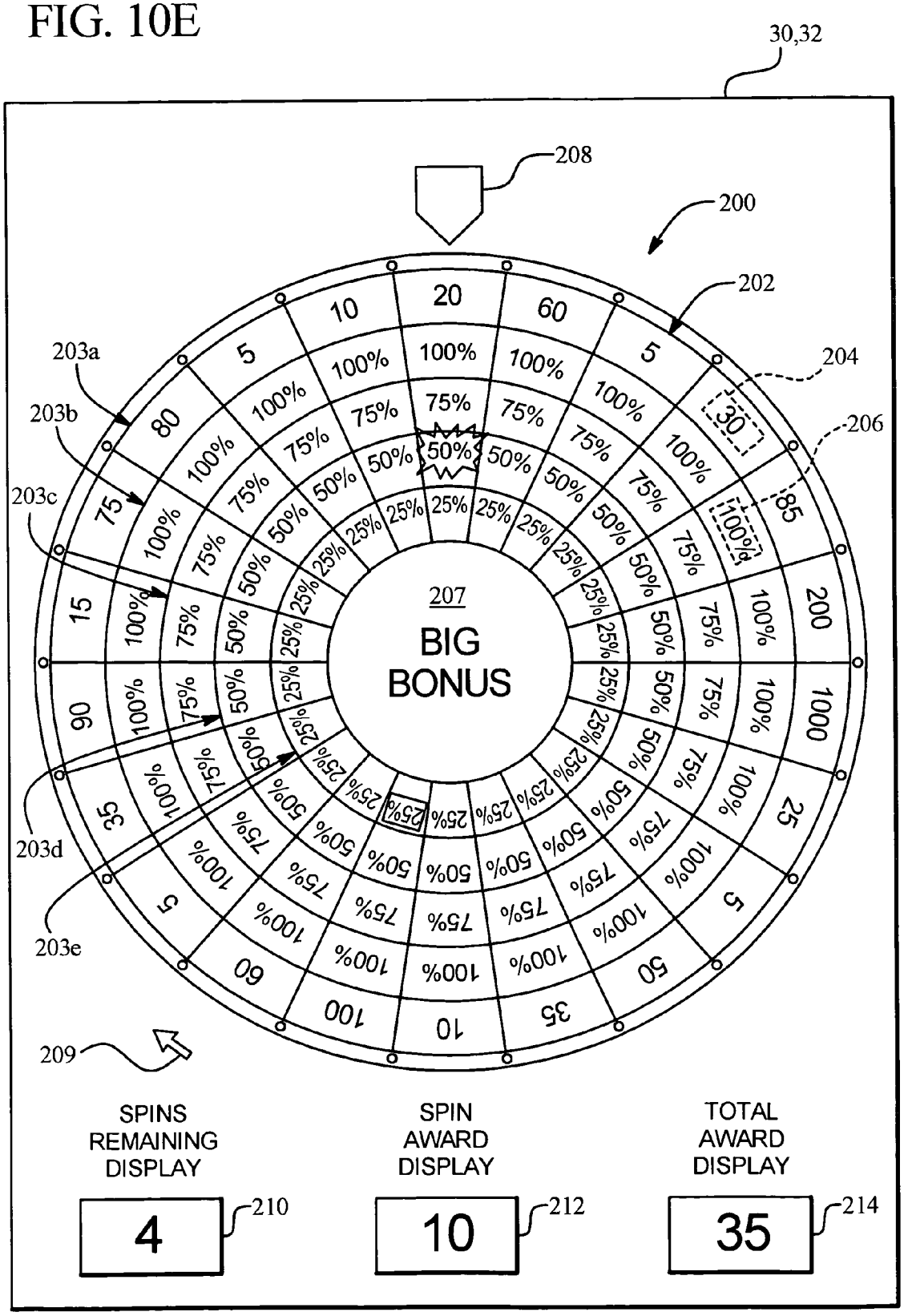

Referring to FIG. 10E, the gaming device spins the award wheel in a clockwise direction to determine the angular coordinate of a section included in the indicated modifier group or annular area 203*d*. In this example, the section indicator 208 indicates a section in the modifier group 203*d* including an award percentage of 25% and a section in the symbol group having an award of twenty. The gaming device therefore multiplies the award of twenty by 50% or 0.50 to provide the player with a spin award of ten (20×0.50) for that spin as indicated by the spin award display 212. The award of ten is added to the player's previous total award of twenty-five to provide the player with a new total award of thirty-five as indicated by the total award display 214. The player now has four spins remaining in the game as indicated by the spins remaining display 210.

Figure 10F:
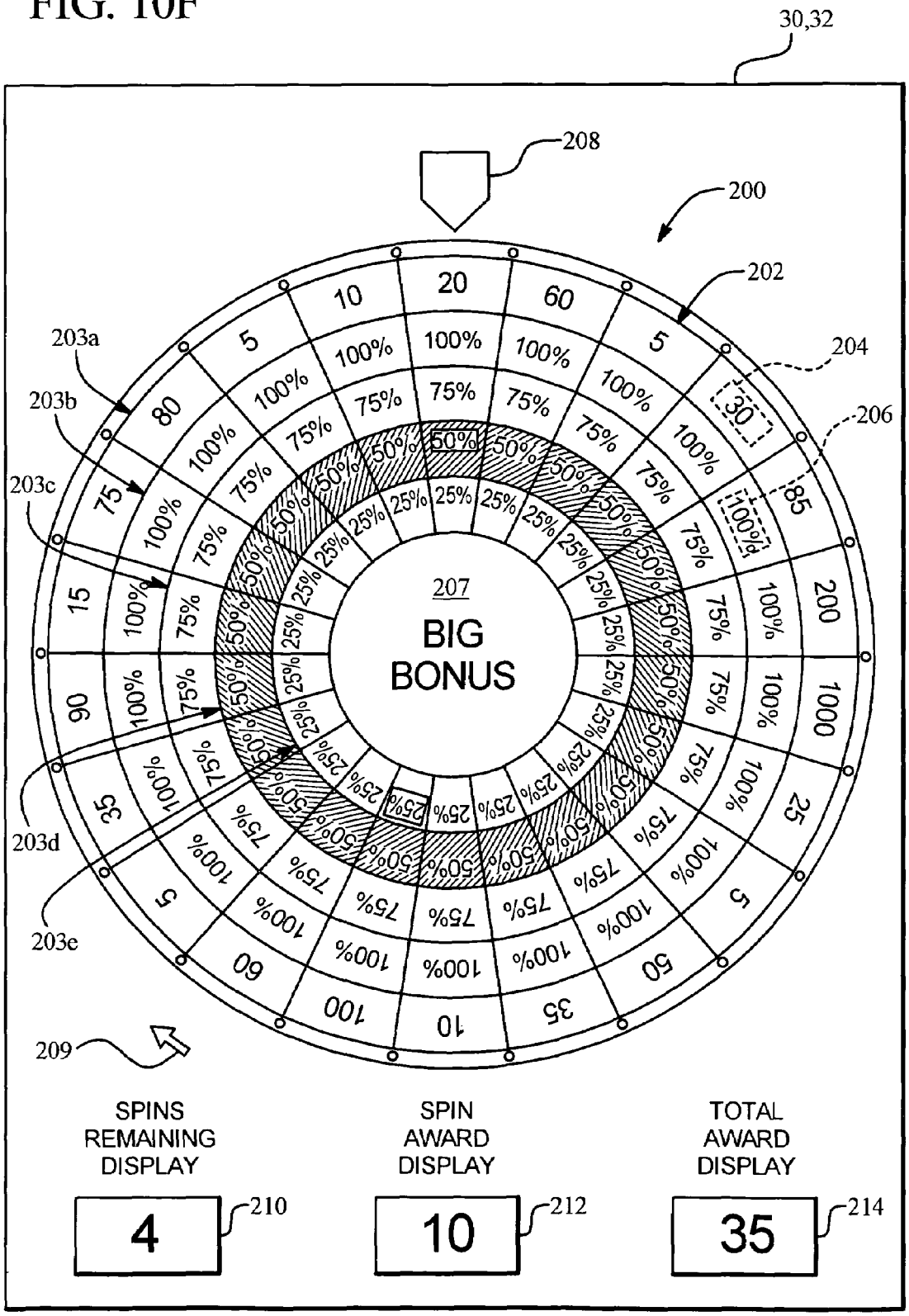
Figure 10G:
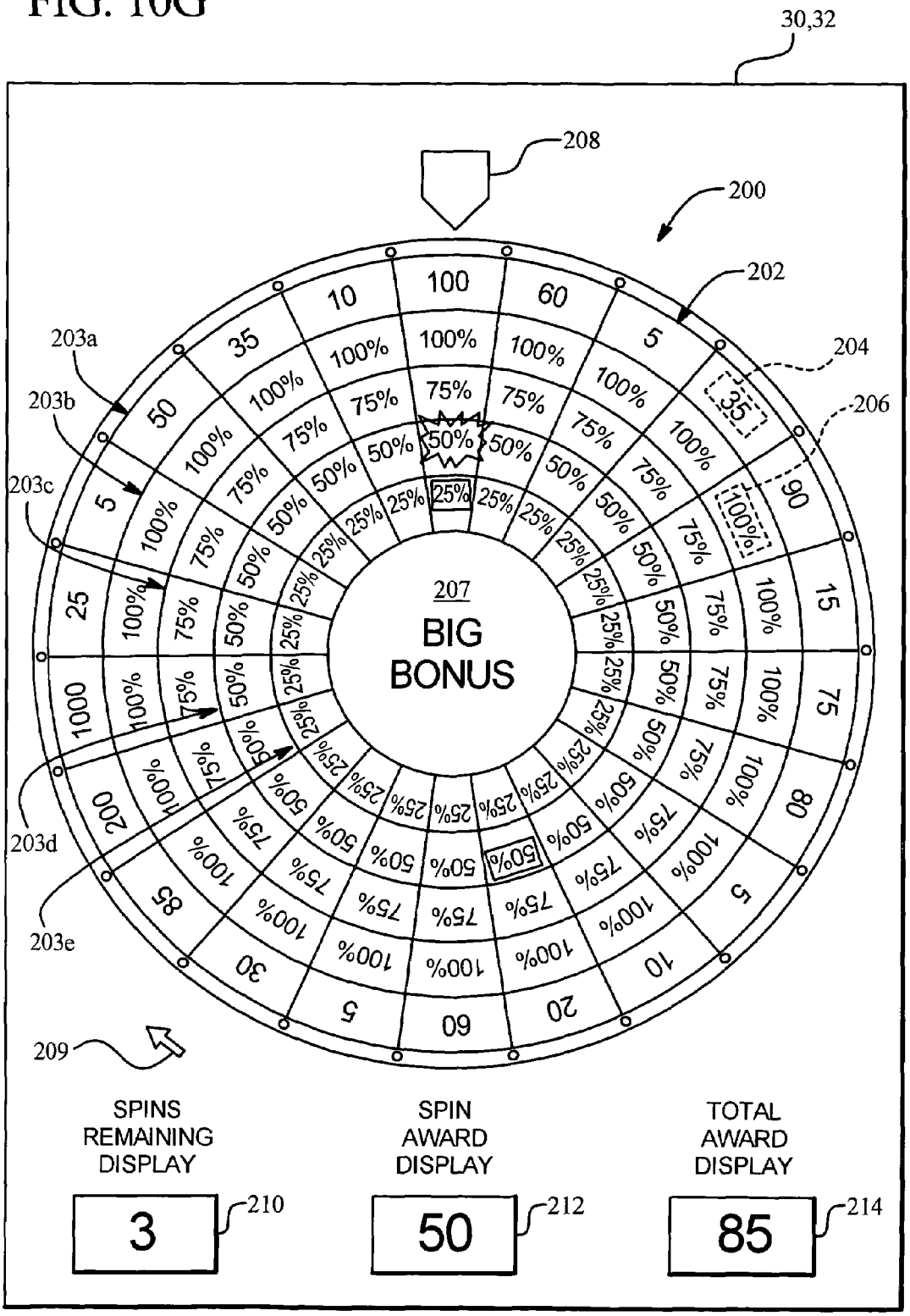

Referring to FIG. 10F, the gaming device alternately illuminates the modifier groups or annular areas 203 and stops on modifier group 203*d*. As in the previous spin, annular area 203*d* includes sections having award percentages of 50%. Thus, any award indicated by section indicator 208 will be multiplied by 50% or 0.50 to provide the player with a spin award in that spin. Referring to FIG. 10G, the gaming device spins the award wheel 200 and the section indicator 208 indicates a section in the symbol group or annular area 203*a* having an award of one hundred. This is the second time in the game that the award of one hundred has been indicated and therefore the player now has indicated two of the sections associated with the award of one hundred include the award percentages of 25% and 50%. If the two remaining sections associated with the award of one hundred, including the award percentages of 75% and 100%, are indicated by the section indicator 208 in this game, the player wins the big bonus 207. The gaming device provides the player with a spin award that equals 50% or 0.50 of the indicated award of one hundred. Therefore, the gaming device provides the player with a spin award of fifty (100×0.50) as indicated by the spin award display 212. The spin award of fifty is added to the player's total award of thirty-five to provide the player with a new total award of eighty-five as indicated by the total award display 214. The player now has three spins remaining in the game as indicated by the spins remaining display 210.

Figure 10H:
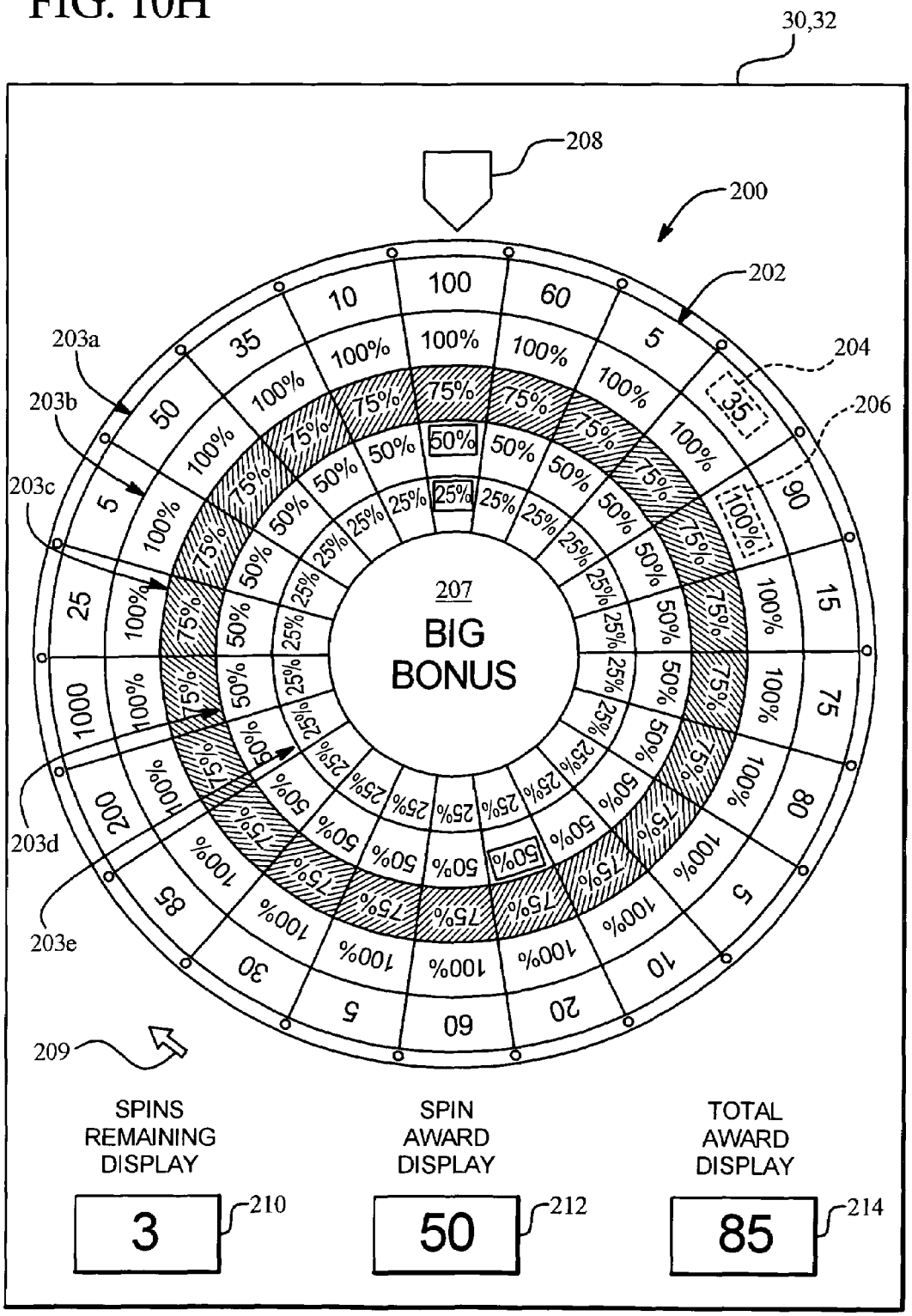
Figure 10I:
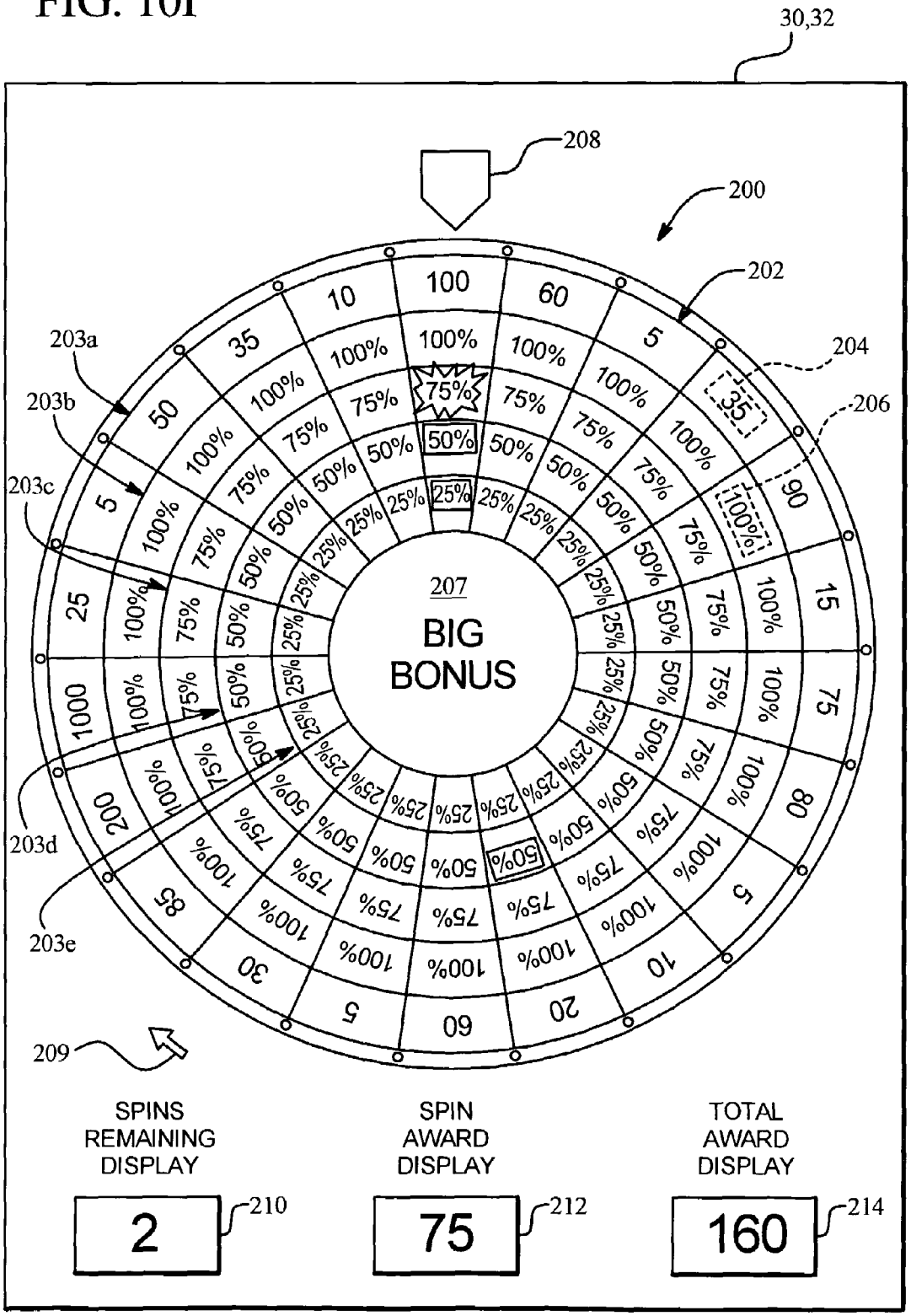

Referring to FIG. 10H, the gaming device alternatively illuminates the modifier groups or annular areas 203 and selects modifier group 203*c*. Modifier group or annular area 203*c* remains highlighted until the player spins the award wheel 200 to indicate a section in this group. Additionally, modifier group 203*c* includes sections having award percentages of 75%. Thus, any award indicated by the section indicator 208 will be multiplied by 75% to provide a spin award to the player for that spin. Referring to FIG. 10I, the gaming device spins the award wheel 200 and the section indicator 208 indicates a section including an award of one hundred. Thus, the gaming device provides the player with 75% (100×0.75) of the indicated award of one hundred or an award of seventy-five (100×0.75). The award of seventy-five (100×0.75) is indicated by the spin award display 212. In addition, the award of seventy-five (100×0.75) is added to the player's previous total award and the player now has a new total award of one hundred sixty as indicated by the total award display 214. The player now has two spins remaining in the game as indicated by the spins remaining display 210.

Figure 10J:
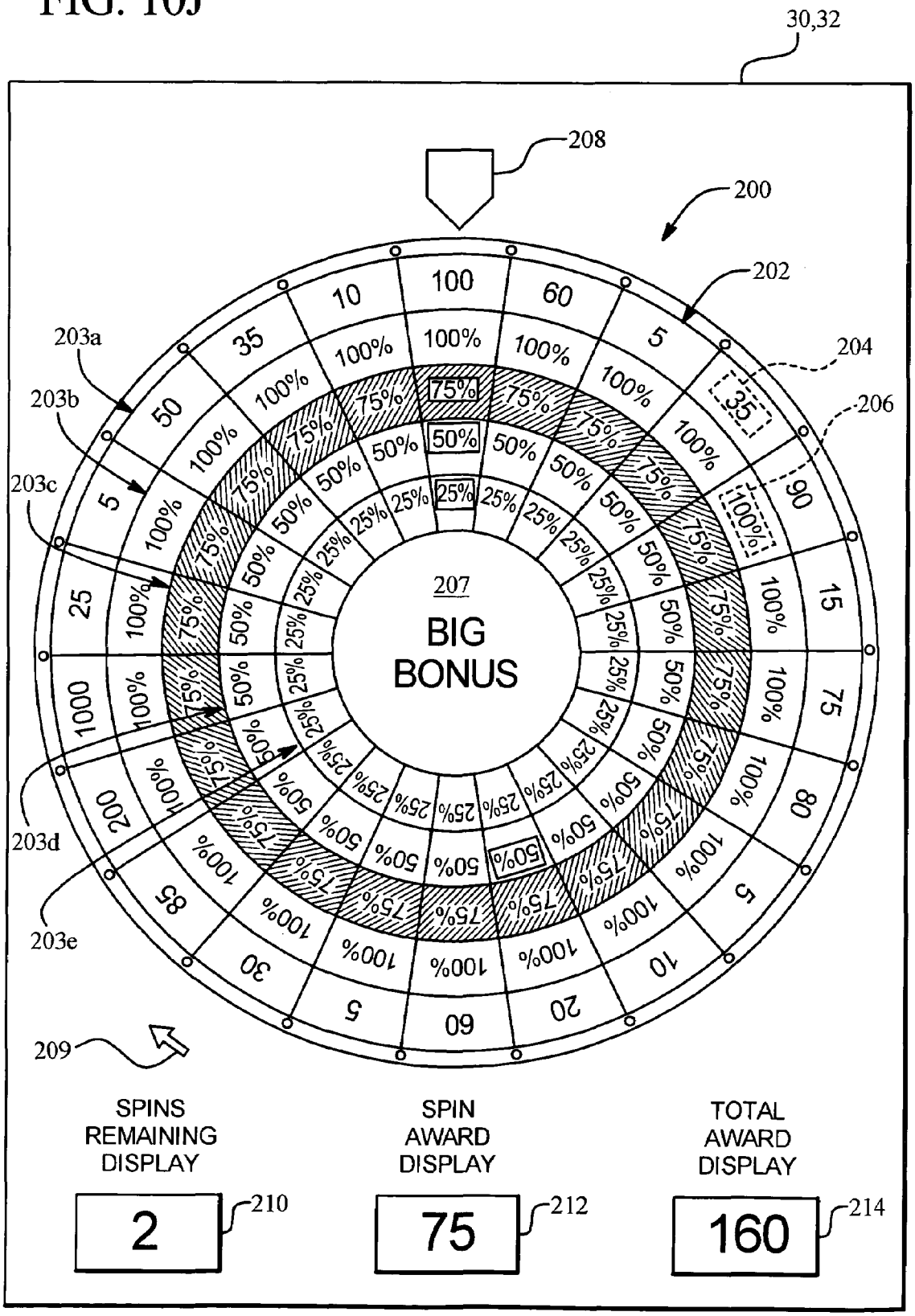
Figure 10K:
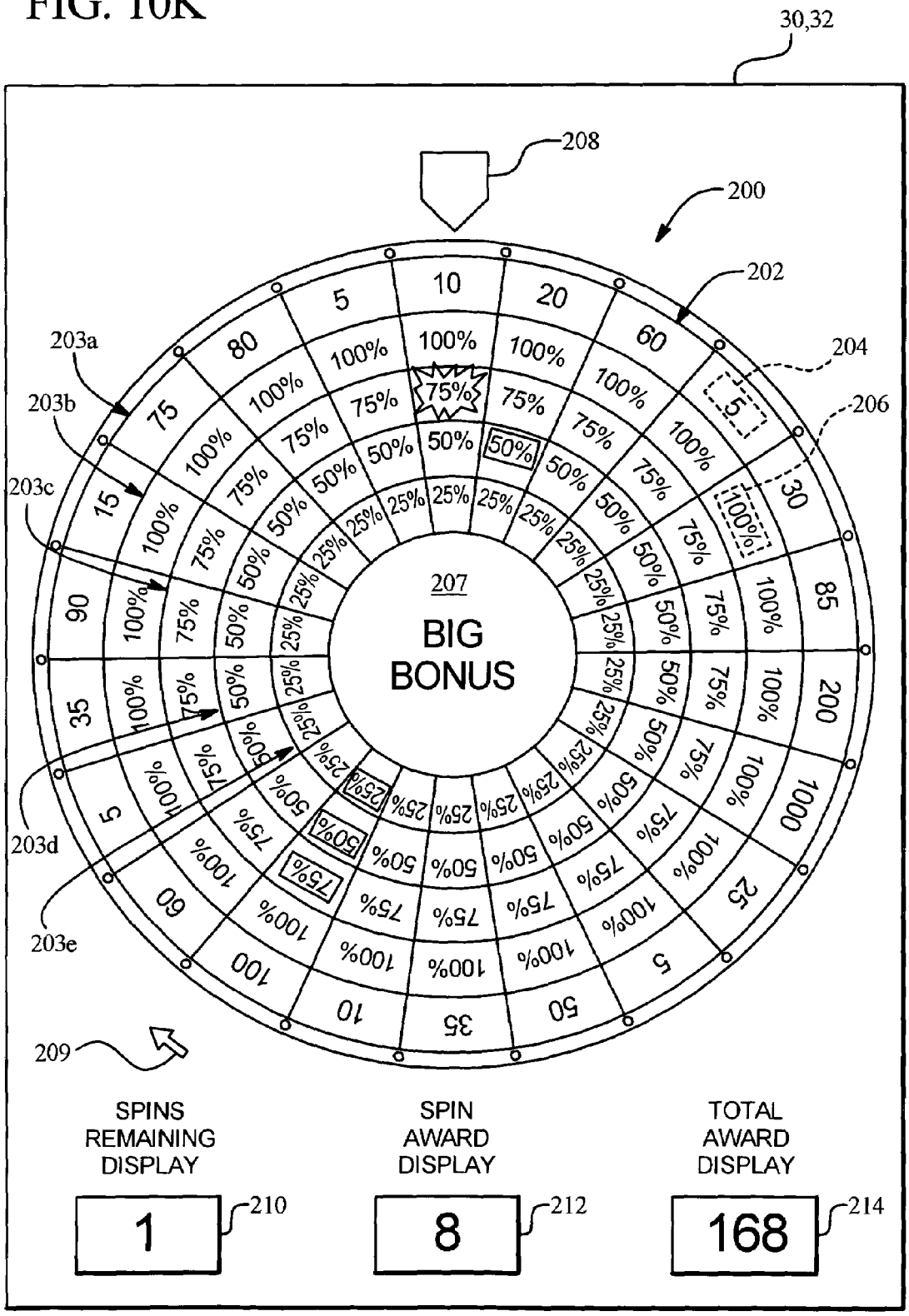

Referring to FIG. 10J, the gaming device alternatively illuminates the modifier groups 203 and selects group 203*c*. The sections included in the modifier group or annular area 203*c* include award percentages of 75%. The annular area 203*c* remains highlighted until the gaming device spins the award wheel 200 to indicate a section in this group. Referring to FIG. 10K, the gaming device spins the award wheel 200 and the section indicator 208 indicates a section in the symbol group 203*a* having an award of ten. Thus, the gaming device multiplies the award of ten by 75% to produce an award of seven and one-half (i.e., 7.5) for that spin. In this example, the gaming device only provides awards having whole numbers or integers and therefore does not provide the player with an award of seven and one-half (i.e., 7.5). Instead, the gaming device rounds the award of seven and one-half (i.e., 7.5) to an award of eight and provides that award to the player for this spin. It should be appreciated however, that the gaming device may round the number up, round the number down, provide the player with the decimal award or any suitable award desired by the game implementor. The spin award of eight is then indicated by the spin award display 212 and added to the player's previous total award of one hundred sixty. The player's new total award is one hundred sixty-eight, as indicated by the total award display 214. The player has one spin remaining in the game as indicated by the spins remaining display 210. As shown in FIGS. 10J and 10K, all the previously indicated sections in the modifier groups on the award wheel 200 remain highlighted or otherwise indicated to show that these awards were previously indicated in the game. This enables a player to track or see which modifiers or sections the player has obtained and which modifiers the player still needs to indicate to obtain the big bonus award 207 in the remaining spins in the game.

Figure 10L:
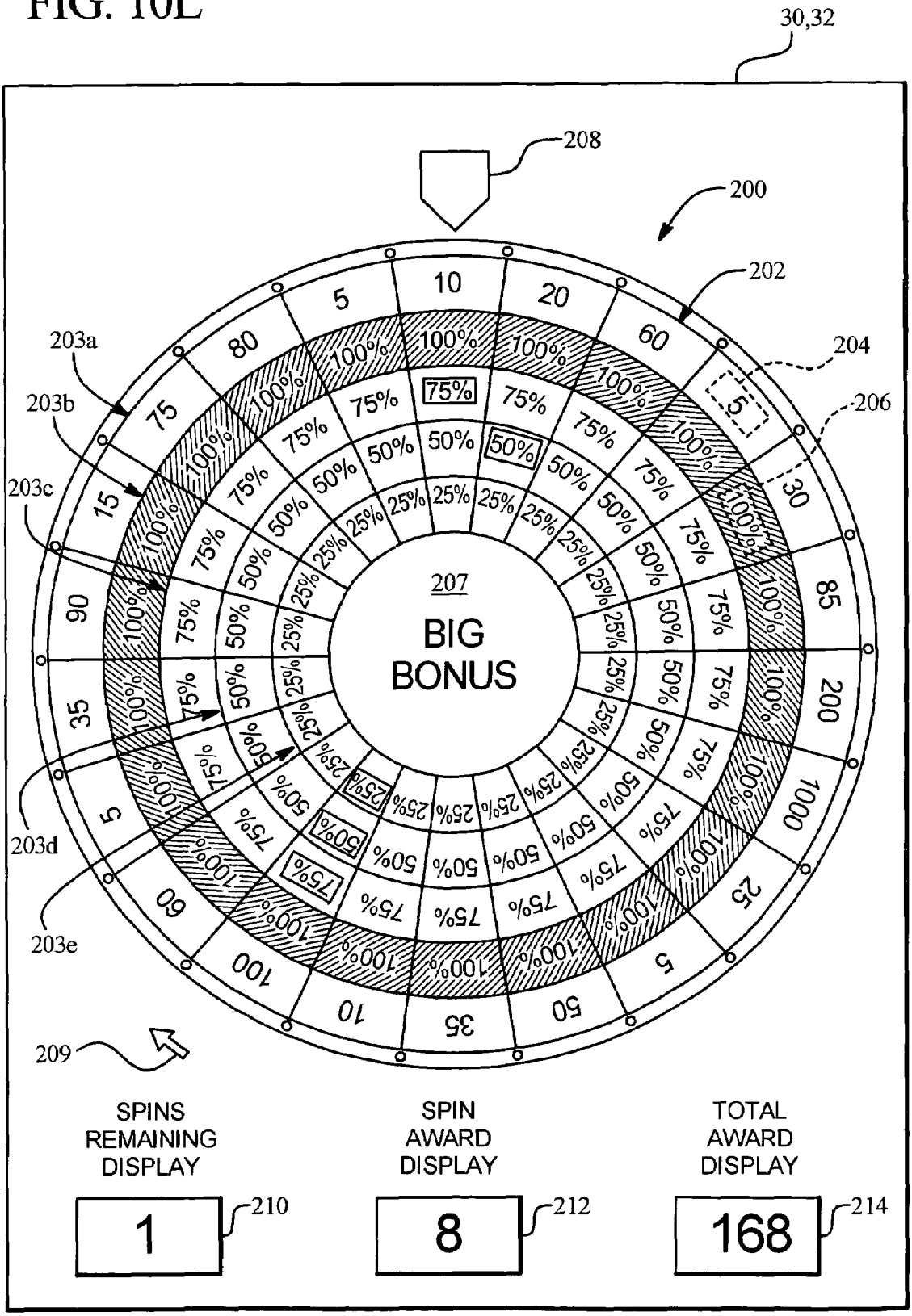
Figure 10M:
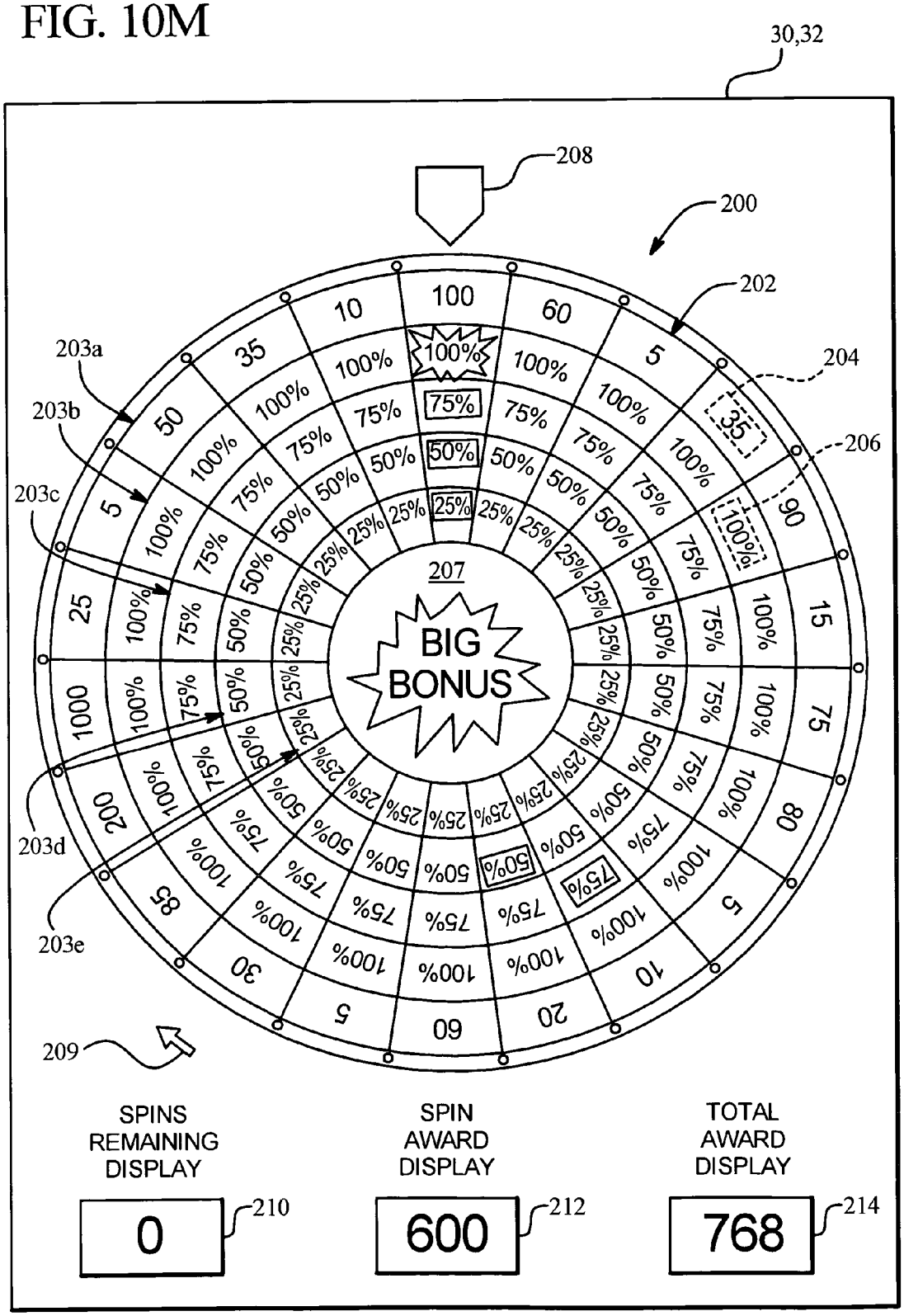

Referring to FIG. 10L, the gaming device alternately illuminates the modifier groups or annular areas 203 and stops on the modifier group 203*b*. Modifier group 203*b* includes sections having an award percentage of 100%. The gaming device will therefore multiply any awards indicated in the symbol group in this spin by 100% (i.e., provide the entire award to the player). Referring to FIG. 10M, the gaming device spins the award wheel and the section indicator 208 indicates a section in symbol group 203*a* including an award of one hundred. In this game, the sections including the award percentages of 25%, 50% and 75% have already been indicated by the section indicator 208 as shown by the boxes or borders surrounding the award percentages associated with those sections. In this spin, the fourth or final section including the award percentage of 100% is indicated by the section indicator in the game. The gaming device therefore provides 100% of the award of one hundred to the player or a spin award of one hundred.

Additionally, because the player indicated all of the sections in the symbol groups 203 associated with a single award (i.e., the award of one hundred), the gaming device provides the player with the big bonus award 207 as shown in FIG. 10M. In this example, the big bonus award 207 includes an award of five hundred as described above. The big bonus award of five hundred is added to the player's spin award of one hundred to provide the player with a total spin award of six hundred as indicated by the spin award display 212. The spin award of six hundred is then added to the player's previous total award of one hundred sixty-eight to provide the player with a new total award of seven hundred sixty-eight as indicated by the total award display 214. The player does not have any spins remaining as indicated by the spins remaining display 210 and therefore, the game ends. The gaming device provides the player with the total award of seven hundred sixty-eight indicated in the total award display 214 for the game.

Figure 11:
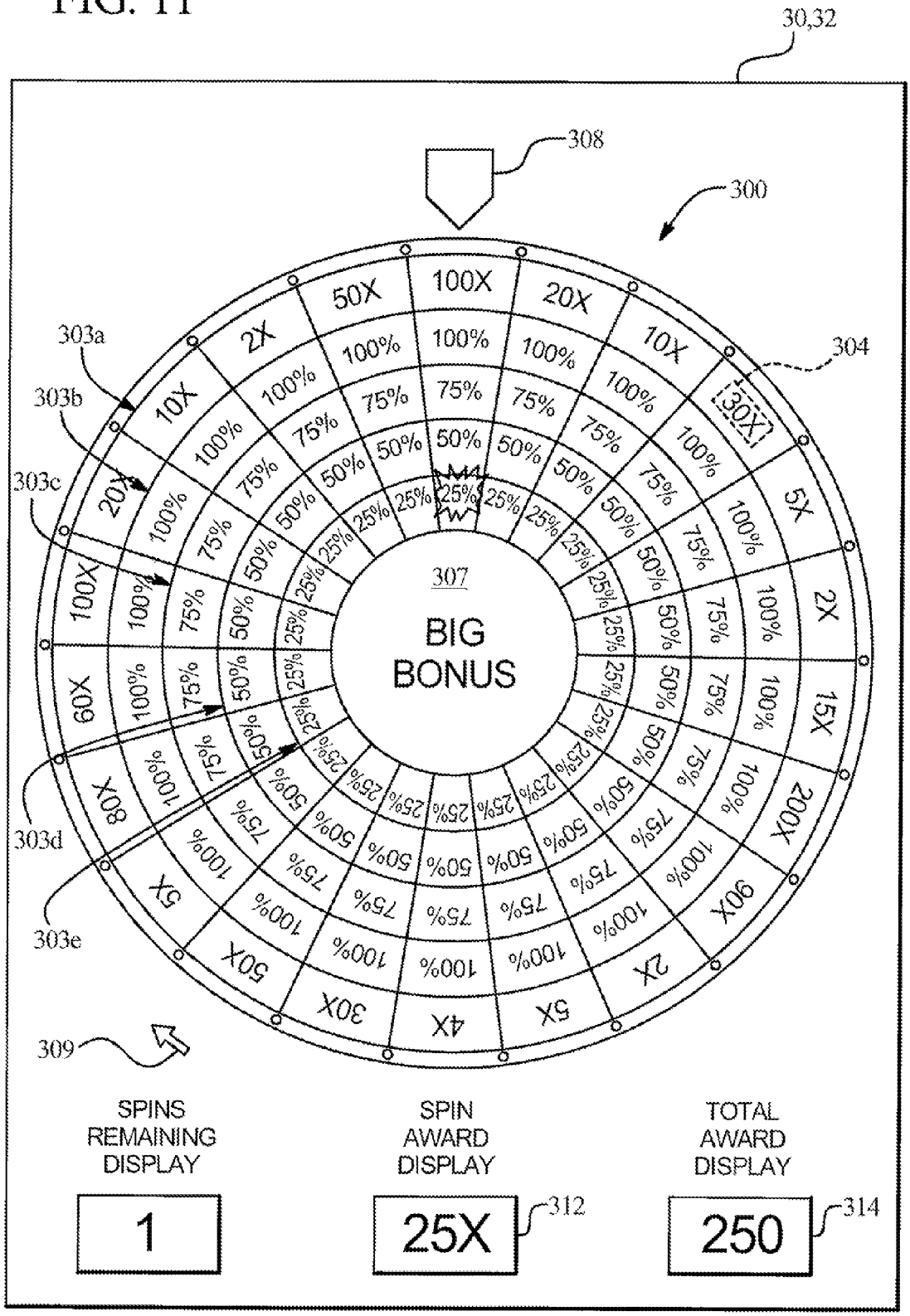
FIG. 11 is an enlarged elevation view of another alternative embodiment of the present invention where the sections includes multipliers and percentages of those multipliers.

Referring to FIG. 11, another alternative embodiment of the present invention is illustrated where the modifier group or annular area 303*a* includes sections having different multipliers. Also, modifier groups 303*b*, 303*c*, 303*d* and 303*e* include sections having award percentages. In this embodiment, the gaming device alternatively illuminates the modifier groups or annular areas 303 until picking one of the groups. The gaming device then spins the award wheel in a clockwise direction as shown by arrow 309. The section indicated by the section indicator 308 in the indicated modifier group is associated with one of the multipliers 304 in that group. The gaming device then multiplies the multiplier 304 associated with the indicated section in the highlighted modifier group to provide the player with a multiplier for that spin.

For example, a section in the modifier group 303*e* including an award percentage of 25% is indicated by the section indicator 308 as shown in FIG. 11. The indicated section is associated with a multiplier of one hundred, which is also indicated by the section indicator 308. The multiplier provided to the player for that spin therefore is 25% of the multiplier one hundred, which is a multiplier of 25 or 25×. The multiplier, 25×, is then indicated by the spin award display 312. In one embodiment, an award provided to the player in a primary or base game is multiplied by the multiplier indicated by that spin (i.e., 25×). In another embodiment, the gaming device provides a predetermined award in the game such as in a secondary or bonus game, and that award is multiplied by the indicated multiplier in that spin. In this example, the gaming device randomly provided the player with an award of ten for that spin and therefore the award of ten is multiplied by the spin award of 25× to provide the player with a total award of two hundred fifty as indicated by the total award display 314. It should be appreciated that the gaming device may accumulate the multipliers obtained in the spins in the game and use the total multiplier to multiply a previous award or a subsequent award in the game. It should also be appreciated that the multipliers indicated in the symbol groups or annular areas 303*a* may be any suitable multipliers desired by the game implementor.

Figure 12:
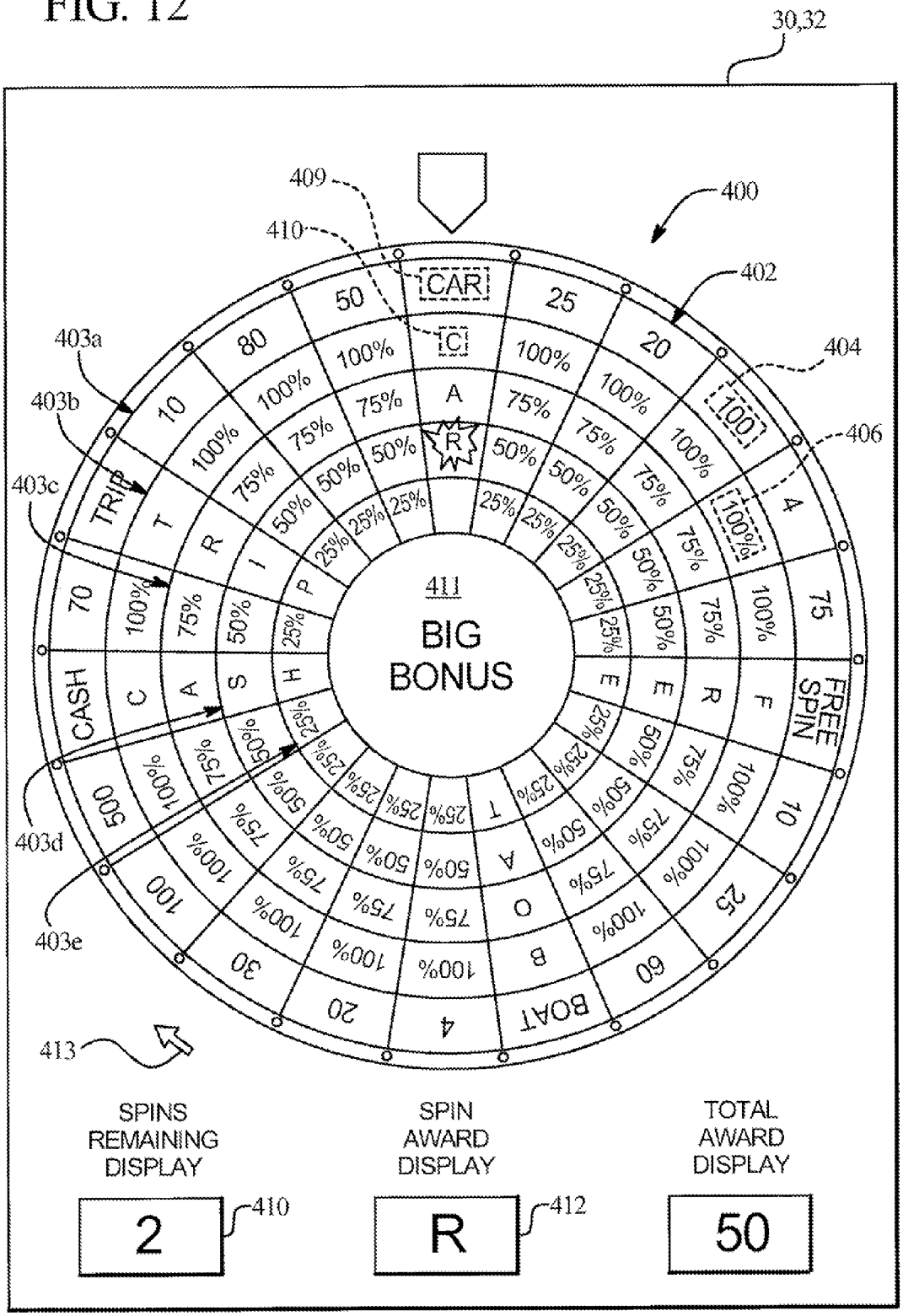
FIG. 12 is an enlarged elevation view of a further alternative embodiment of the present invention where the sections include awards, percentages of those awards, and letters which form a prize or prizes.

Referring to FIG. 12, a further alternative embodiment of the present invention is illustrated where the award wheel 400 includes a plurality of groups or annular areas 403*a* to 403*e* including sections 402. In this embodiment, the group or annular area 403*a* includes sections having a plurality of awards 404 and prizes 409. The awards may be any suitable type of awards and the prizes 409 may include any suitable prizes such as a car, a free spin or spins, a boat, cash, or a trip. As described above, a gaming device alternatively illuminates the annular areas 403*a* to 403*e* to indicate one of the areas in that spin. The gaming device then spins the award wheel 400 in a clockwise direction as shown by arrow 413 to indicate one of the sections in the indicated annular area 403*a*. If a section including an award percentage 406 is indicated, the gaming device provides the player with the award associated with the indicated section of the group of sections included in indicated annular area 403*a*. The multiplied award is then indicated in the spin award display 412.

Each prize 409 includes sections that have letters 410 which spell out a word or words associated with the prize. If the player indicates all of the sections (i.e., accumulates all the letters or sections associates with that prize), the gaming device provides the prize to the player in the game. For example, if the player spins the wheel in the game and indicates all of the letters including the blank space associated with the car, the gaming device provides the car to the player. Additionally, if the player indicates all of the sections including all of the award percentages associated with the award, the gaming device provides the player with the big bonus award 411. It should be appreciated that the big bonus award 411 may be provided to the player when the player indicates all the sections associated with one of the awards or one of the prizes. The addition of the prizes to the game increases the excitement and enjoyment of the game for the player. If the player wins one of the prizes, the gaming device indicates the prize in the spin award display 412. A receipt or suitable redemption coupon is printed by the gaming device and the player redeems the prize at a remote location or other suitable redemption location.

Figure 13:
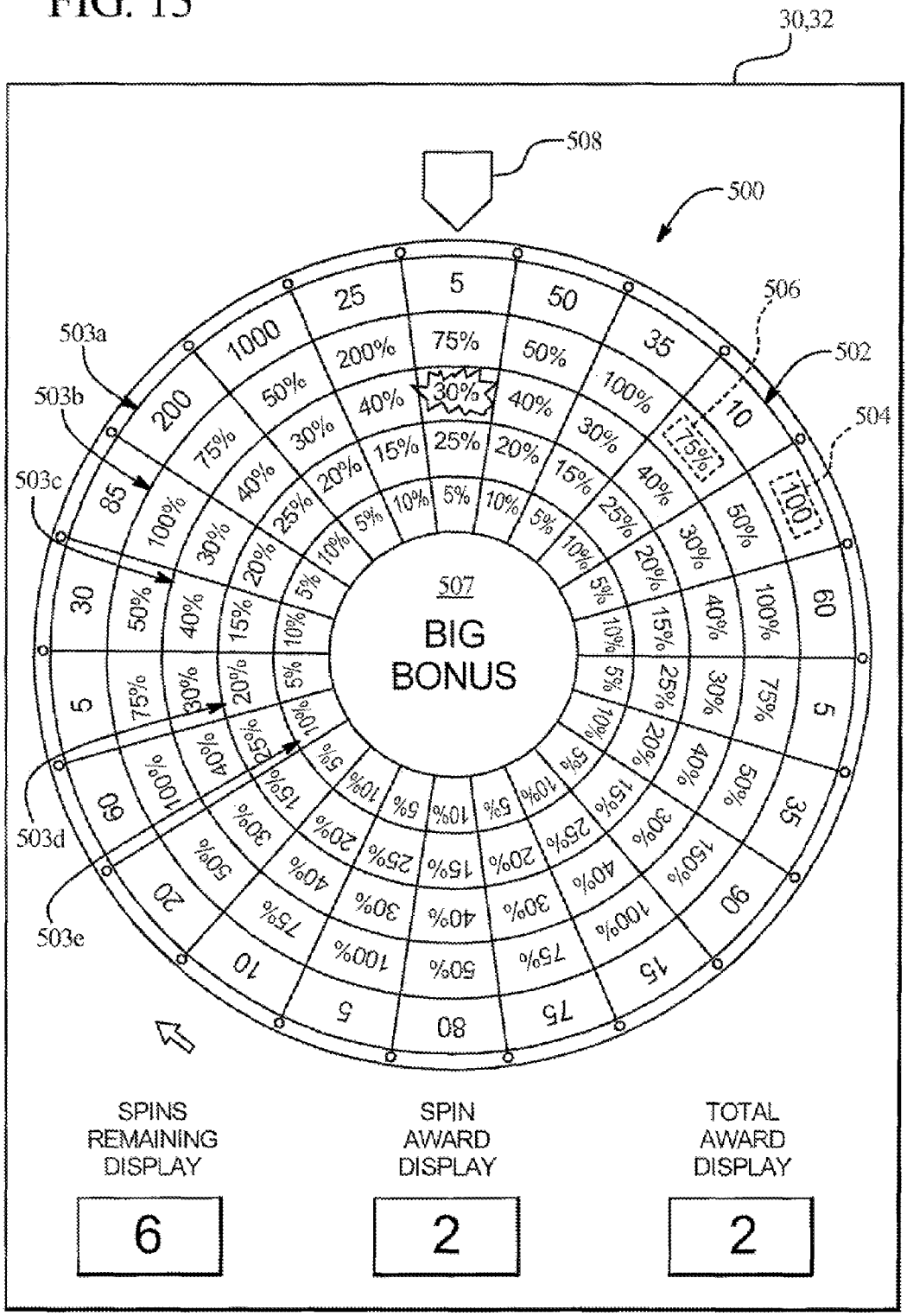
FIG. 13 is an enlarged elevation view of another alternative embodiment of the present invention where the sections of the wheel include awards and different award percentages.

Referring to FIG. 13, another alternative embodiment of the present invention is illustrated where the award wheel 500 includes groups or annular areas 503*a*, 503*b*, 503*c*, 503*d* and 503*e*. In this embodiment, the groups include sections 502 having awards and award percentages. The awards 504 may be any suitable type of awards desired by the game implementor. Each of the annular areas 503 include separate wheels such that each of the wheels independently rotates with respect to the other wheels. Additionally, each of the sections 502 associated with the groups 503*b*, 503*c*, 503*d* and 503*e* include a plurality of different award percentages. For example, the award percentages associated with group 503*b* are different than the award percentages associated with groups 503*c*, 503*d* and 503*e*. In a game therefore, the gaming device alternatively illuminates the groups or wheels 503 to indicate one of the groups or wheels in that spin. The gaming device then spins one or more of the wheels including the groups to indicate one of the sections in the highlighted or indicated group. The indicated section includes an award percentage 506. The section indicator also indicates a section in the symbol group 503*a* having an award 504. The indicated award 504 is multiplied by the indicated award percentage 506 to provide a spin award or multiplied award to the player in that spin. The player then spins the wheel or wheels until there are no spins remaining in the game.

The different award percentages provide an extra level of excitement and enjoyment to a player in a game because the player's award depends on two factors. One factor is the award indicated by the section indicator 508 in a spin and the second factor is the award percentage indicated in that spin. Also, because the award wheels all independently rotate, it is more difficult to accumulate all of the sections associated with the particular award because one or more of the wheels including the sections are moving in each spin.

In another embodiment, the gaming device enables a player to pick or select an annular area or pie-shaped area or segment of the wheel prior to playing the game or initiating the spins of wheel in the game. It should be appreciated that the gaming device may enable the player to pick one, a plurality or the annular areas and/or pie-shaped segments or areas of the wheel in a game. It should also be appreciated that the gaming device may enable the player to pick the annular area or areas or pie-shaped section or sections prior to playing the game, prior to one spin in the game or prior to a plurality of the spins in the game. For example, a player picks one of the annular areas on the wheel and then spins the wheel. The section indicator indicates one of the sections in the annular area picked by the player and provides the award associated with that section. It should be appreciated that the gaming device may enable the player to pick one of the annular areas or pie-shaped sections by pressing or touching the corresponding annular area or section on a touch screen display device or by pressing a button or similar input device which corresponds to the annular area or pie-shaped section on the wheel.

In a further embodiment, the gaming device of the present invention is employed in a progressive type game where a player accumulates indicated sections on the wheel in the plurality of games. In this embodiment, the indicated sections remain highlighted or illuminated for a designated number of games. The designated number of games may be predetermined, randomly determined or determined in any suitable manner. The progressive accumulation of the indicated sections enables one or more players to be able to accumulate multiple sections in a game or games and also increases the probability that a player will obtain the big bonus award by accumulating all the sections associated with one of the awards in the outer most annular area in a game. In one aspect of this embodiment, the awards are associated with a probability of being indicated such that the relatively small awards include greater probabilities than the relatively large awards. In this aspect, a significant portion of the relatively small awards are indicated before the relatively large awards are indicated on the wheel. This creates excitement and enjoyment of the game because the longer the game is played or the more games that are played, more of the sections of the wheel are illuminated or indicated. Also, as more sections are indicated on the wheel, the awards associated with the non-indicated sections increase to enable players to obtain larger awards in a game or games. Once the designated number of games are reached, the gaming device resets the award wheel so that none of the sections are indicated (i.e., highlighted) on the wheel. It should be appreciated that the gaming device may reset the award wheel so that none, one, a plurality or all of the sections remain highlighted on the wheel.

In another embodiment, a plurality of section indicators are associated with the wheel such that multiple sections are indicated on the wheel in a spin. This enables a player to obtain multiple awards associated with the multiple sections indicated on the wheel in a single spin. In one embodiment, the section indicators associated with the wheel are activated such that only the activated section indicators indicate sections on the wheel. The section indicators may be activated by particular sections on the wheel or based on the number of spins provided to the player in the game. The number of section indicators may also be based on a wager made by the player in the base game or in a bonus game.

In a further embodiment the multiple section indicators are moveable such that the section indicators move about the wheel at the beginning of a game and are stopped or locked in place by the gaming device or the player. The section indicators may move at the beginning of the game, during the game, after one spin or a plurality of the spins of the wheel or at any suitable point in a game. The moveable indicators enable the player to interact with the game and therefore provides additional excitement and enjoyment of the game.

In another embodiment, a time dimension is associated with the present invention to offer enhanced play and awards in the game. In one aspect of this embodiment, a larger award or awards are provided to the player when a designated number of sections are indicated in a designated number of spins of the wheel. For example, the gaming device provides a larger award or a bonus award to a player when the player indicates all of the sections associated with one of the awards in a particular number of spins such as five spins. The gaming device decreases the award for each additional spin or spins needed by the player to indicate those sections.

In another aspect of this embodiment, the gaming device only provides a bonus award when the player indicates a specific section or sections in a designated number of spins. If the section or sections are indicated after the designated number of spins are reached, the gaming device does not provide a bonus or extra award to the player. It should be appreciated that the designated section or sections may be predetermined, randomly determined or determined according to any suitable determination method.

In a further aspect of this embodiment, a time period is associated with the game such that the gaming device or the player spins the wheel during the time period and indicates sections and accumulates awards associated with those sections during the time period. When the time period expires, the game ends and the player receives the total accumulative award for the game.

It should be appreciated that the present invention may be employed in a primary or base game or, a secondary or bonus game or any suitable type of game such as poker, blackjack, roulette, dice, slots, multi-line slots or any other suitable wagering game.

It should also be appreciated that multiple pointers or indicators for simultaneously indicating different sections may be employed in the present invention.

Figure 14:
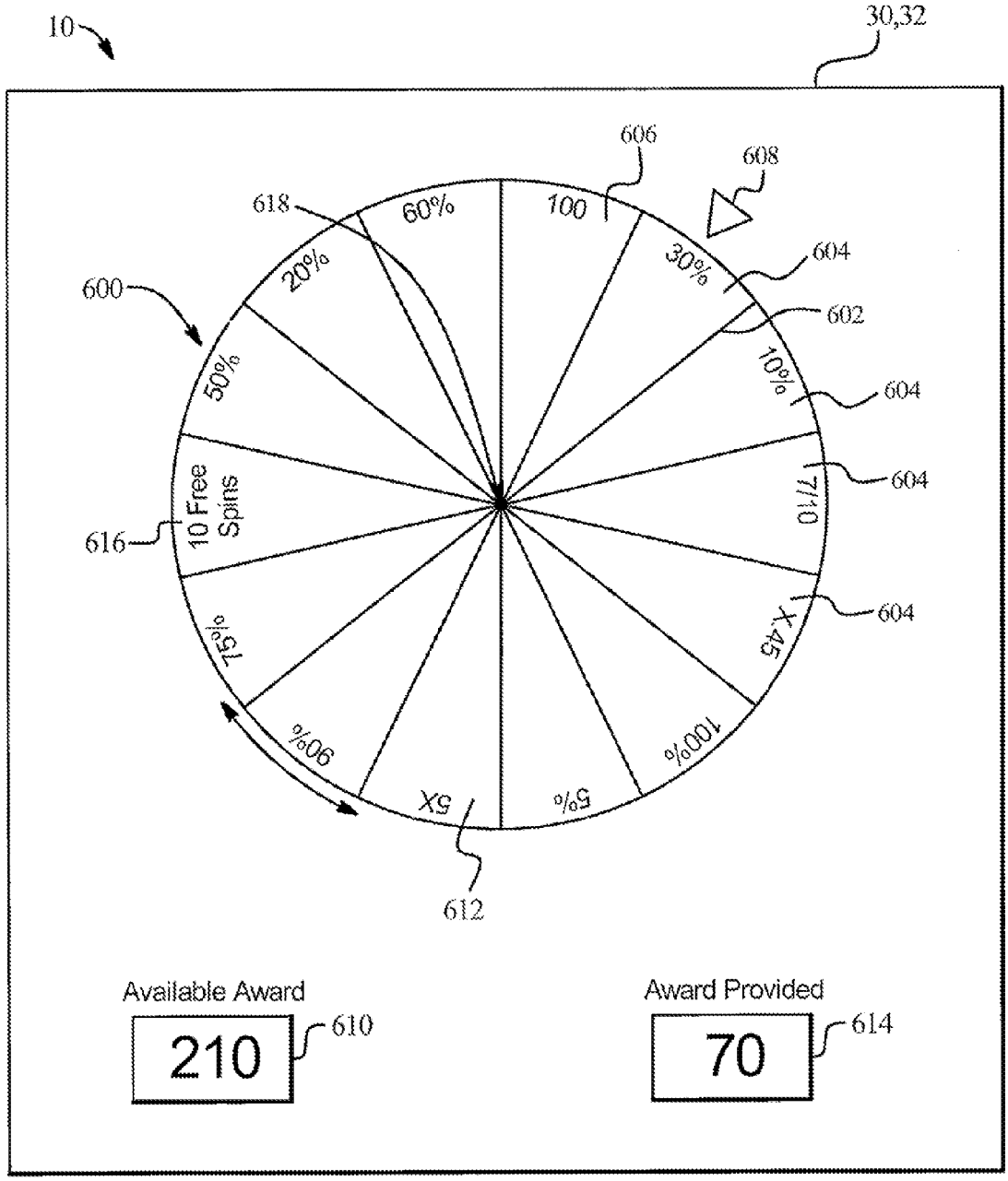
FIG. 14 is an enlarged elevation view of still a further alternative embodiment, wherein sections of the wheel include portions of an available amount.

Referring now to FIG. 14, a further alternative embodiment of a display device is illustrated by wheel 600. Wheel 600 in alternative embodiments is displayed on a video or electromechanical display device 30 or 32 of gaming device 10. That is, wheel 600 can be simulated or electromechanical as described above. Wheel 600 includes a plurality of sections 602. At least some of the sections 602 have or display an apportioning symbol or indicia 604.

As illustrated, apportioning symbols 604 can be shown in at least three different formats. In one format, apportioning symbol 604 is shown as a percent, such as 10%, 100%, 5%, 90%, 75%, 50%, 20%, 60%, or 30%, illustrated clockwise on wheel 600. Alternatively, apportioning symbol 604 is shown as a fraction such as 7/10 as seen on wheel 600. Further alternatively, apportioning symbol 604 is shown as a decimal or number less than one as seen by the 0.45 symbol on wheel 600. The apportioning symbol could alternatively be displayed in any other suitable manner.

In one embodiment, the wheel 600 include symbols in addition to the apportioning symbols 604. For example, wheel 600 include any one or more of game credit symbols 606, multiplier symbols 612 and/or free spin symbols 616. The primary difference between apportioning symbols 604 and the additional symbols 606, 612 and 616 is that apportioning symbols 604 operate with an available amount shown in display 610, while additional symbols 606 and 616 operate independently and multiplier symbol 612 multiplies a number of credits.

Any of the embodiments disclosed above for triggering or activating the above-disclosed wheels are applicable to the triggering and/or activating of the display device such as wheel 600. For example, if a player playing a base game of gaming device 10 receives a designated symbol or symbol combination such as along a played payline, wheel 600 may be activated automatically or upon one or more prompted inputs from the player. At that point, wheel 600 spins about axis 618 clockwise or counterclockwise for a preset or otherwise determined number of rotations and stops eventually. The section 602 stopping in front of or adjacent to indicator 608 is used to determine an award provided to the player. If the section 602 displays one of the apportioning symbols 604, the player is provided an award based on or equal to the apportioning symbol multiplied by the available amount shown in meter 610.

In the illustrated embodiment, the available amount is two hundred ten credits. The apportioning symbol 604 that has been generated randomly lands in front of indicator 608 is 30%. Accordingly, the player's provided award is seventy credits shown in meter 614. It should be appreciated that if the apportioning symbol is not evenly divisible into the available amount, gaming device 10 can be configured to round up or down to the nearest whole credit. Alternatively, gaming device 10 can be configured to pay the remainder in a denomination that is a fraction of a credit.

The available amount shown in meter 610 may be determined in any one or more of the following ways. The available amount may be preset or determined randomly, e.g., as an outcome of base or bonus game play. The available amount is alternatively a progressive award, which is built via a collection of a percentage taken from players' wagers. In various alternative embodiments, the progressive awards is for a single gaming machine, is for a plurality of gaming machines in a single casino implemented through a local area network and in a plurality of gaming machines at a plurality casinos implemented through a wide area network. Still further, the available amount may be determined randomly and displayed via wheel 600. For example, the independent rotating rings of wheel 500 may be employed with wheel 600 and apportioning symbols 604, such that one rotating ring displays the apportioning symbol 604 to be used in combination with the available amount, while a second rotating ring displays the available amount shown in meter 610.

Figure 15:
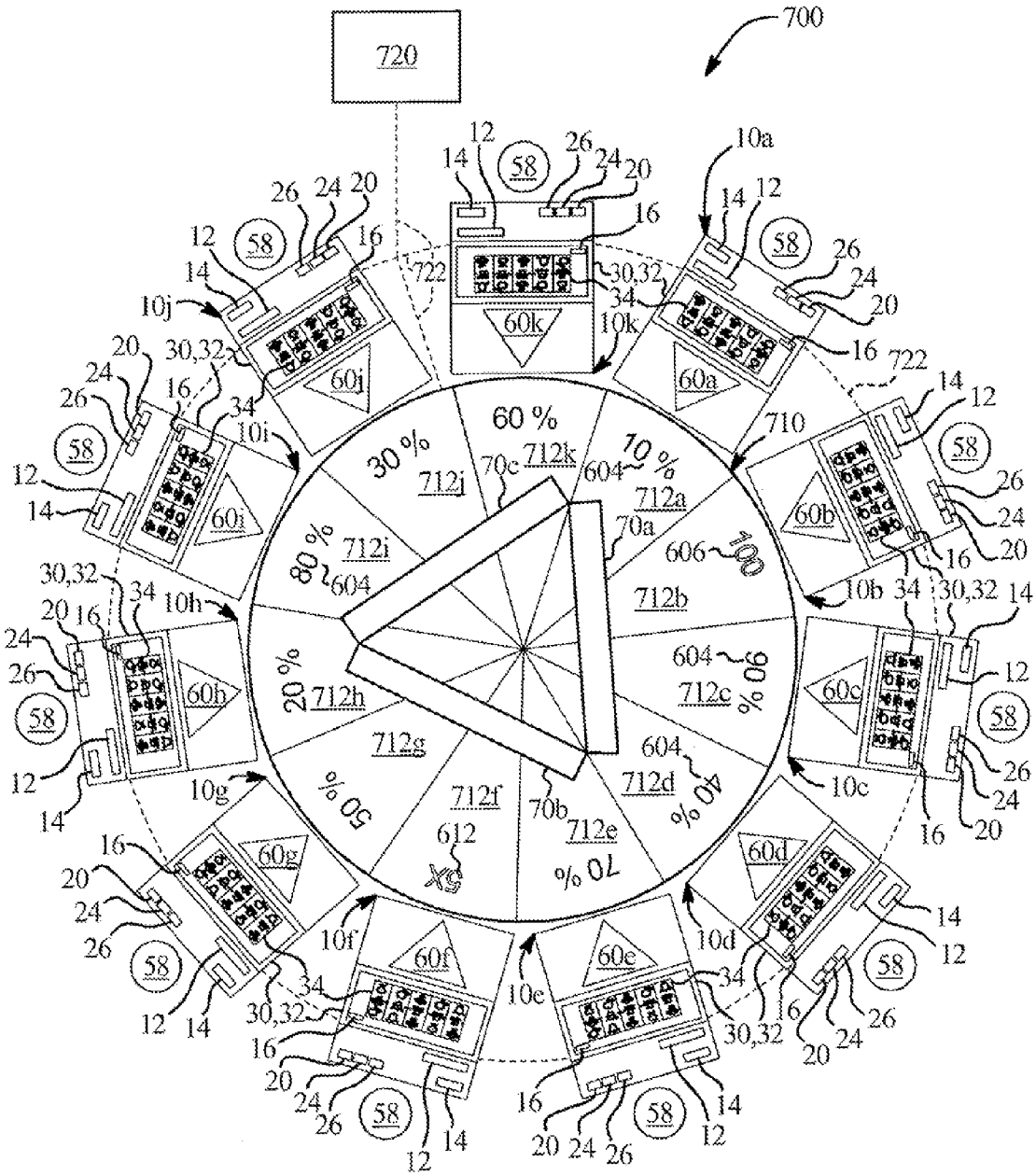
FIG. 15 is a top plan view of one embodiment of a system including multiple gaming devices and a shared outcome display having percentages corresponding to portions of an available amount.

Referring now to FIG. 15, one embodiment of a multiplayer system employing any one of the wheel embodiments disclosed herein is shown by system 700 having a shared wheel 710. For ease of illustration, system 700 is shown using the apportioning symbols 604 of wheel 600. Any of the types of apportioning symbols 604 (such as percentages, fractions, decimals) may be used with wheel 710. Also, any of the different symbols and area or ring arrangements discussed above in connection with wheel 100, 200, 300, 400 or 500 may be used in connection with wheel 710.

In particular, system 700 includes a shared outcome display or wheel 710, which employs the apportioning symbols 604, credit symbols 606 and multiplier symbols 612 shown above in connection with wheel 600. Credit symbols 606 and multiplier symbols 612 are not based on the available amount. Multipliers 612 can multiply any suitable base game quantity, such as total credits, total credits previously wagered, total credits won, total paylines played, total wager per payline, etc. Although not illustrated, any of the sections 712*a* to 712*k* of wheel 710 may display a free spin symbol 616 shown in connection with wheel 600.

As illustrated, wheel 710 includes eleven sections 712*a* to 712*k*. A same number of gaming devices 10*a* to 10*k* is provided in system 700. In an alternative embodiment, wheel 710 includes more sections 712 (referring collectively to sections 712*a* to 712*k*) than gaming devices 10 (referring collectively to gaming devices 10*a* to 10*k*). Alternatively, wheel 710 can include less sections 712 than gaming devices 10.

In system 700, display 710 is shared between multiple gaming devices 10*a* to 10*k*. Various embodiments for multiplayer, shared display systems are set forth in U.S. patent application Ser. No. 11/212,404 ("the '404 application"), entitled "GAMING DEVICE SYSTEM HAVING SHARED MULTI-PLAYER SYMBOL DISPLAY," filed on Aug. 26, 2005, assigned to the assignee of the present application, the entire contents of which are expressly incorporated herein by reference.

In the illustrated embodiment, wheel 710 is substantially horizontally disposed with gaming devices 10*a* to 10*k* spaced in roughly equal increments about shared display 710. Overhead displays 70*a* to 70*c* are located above wheel 710 and are provided in any suitable number and size so that each of the players system 700 can see at least one of overhead displays 70*a* to 70*c*. In an alternative embodiment, wheel 710 is at least substantially vertically disposed, for example, with a backside against a wall of the gaming establishment. Here, gaming devices may be provided for example in a semicircle about the vertically disposed wheel. In another alternative embodiment, apportioning symbols 604 and the other types of symbols described herein are provided on a relatively large rotating reel or drum. In such a case a separate indicator can be provided to indicate one of the symbols of the reel or drum.

For reference, each of the constituent gaming devices 10*a* to 10*k* in FIG. 15 shows coin slot 12 and bill acceptor 14 described above. Each gaming device also shows display device 30, 32, reels 34 (simulated or electromechanical), credit display 16, play button 20, bet one button 24 and cash out button 26.

In the illustrated embodiment, gaming devices 10*a* to 10*k* are of a low-profile type in which a player sits at a seat 58 to play the gaming device. Such configuration enables shared wheel 710 to be located closer to the casino floor. Gaming devices 10 alternatively have any suitable standing or sitting configuration. Any of the wagering games described herein are suitable for system 700, such as, slot, poker, keno and/or blackjack.

In the illustrated embodiment, each gaming device 10*a* to 10*k* includes a combination hand pay/shared display indicator 60*a* to 60*k*, respectively. Indicators 60 (referring collectively to indicators 60*a* to 60*k*) function in one aspect to indicate a player's desire to receive a hand pay or other item from a gaming establishment attendant. In one embodiment of the present invention, indicators 60 point to or indicate one of the symbols of the sections 712 displayed on wheel 710. Indicators 60 can be selectively not illuminated, illuminated, flashed on and off or illuminated in combination with audio played from the speakers of the respective gaming device 10.

As discussed above, each gaming device 10*a* to 10*k* includes an individual processor 38. In one embodiment, each of the processors 38 is configured in a client-server communication relationship via a link 722 with a separate processor or server 720. Server 720 controls via link 722 the shared wheel 710 and one or more large overhead displays 70*a* to 70*c*. Server 720 communicates information back and forth between the displays 70 (referring collectively to displays 70*a* to 70*k*) and gaming devices 10 and information back and forth between wheel 710 and gaming devices 10.

Link 722 may be of any type discussed above for gaming device 10, such as any type of LAN, WAN, fiber optic network, Ethernet, copper cable or other suitable type of link or network. Via link 722, server 720 can communicate with any of gaming devices 10*a* to 10*k* for any suitable purpose, such as to update the player's credits on the credit display 16 or to command an individual game processor 38 to display a message or indicia on the respective individual monitor or display 30, 32. Server 720 also monitors which gaming devices 10*a* to 10*k* are currently being played. Server 720 can further be configured for example to: (i) track the amount of coins wagered at any one or more or all of gaming devices 10; (ii) track the frequency of play at any one or more of gaming devices 10; and (iii) note the base game output of any one or more of gaming devices 10 (for example, to determine of any constituent gaming device has triggered a bonus involving shared wheel 710).

Separate server 720 runs one or more random outcome generation ("ROG") programs, which determines the random outcomes displayed by the shared display 710 in one embodiment. The ROG program is independent of any run by processors 38 of individual gaming devices 10 (described in detail in the '404 application).

In an embodiment, server 720 knows the fixed relationship between each of the symbols of the sections 712. In the illustrated example, server 720 is programmed to know that the 40% apportioning symbol 604 shown in section 712*d* is located one section clockwise from the 90% apportioning symbol 604 shown in section 712*c*, which is located one section clockwise from the 100 credit symbol 606 shown in section 712*b*, which in turn is located one section clockwise from the 10% apportioning symbol 604 shown in section 712*a*, and so on.

It should therefore be appreciated that if server 720 generates one of the symbols randomly for gaming device 10*a*, for example, the fixed relationship between the symbols enables server 720 to know the symbols generated randomly for gaming devices 10*b* to 10*k*. That is, if the ROG program of server 720 generates the 10% apportioning symbol 604 randomly for gaming device 10*a*, the ROG program server 720 also generates: (i) 100 credits for gaming device 10*b* randomly, (ii) the 90% symbol for gaming device 10*c* randomly, (iii) the 40% symbol for gaming device 10*d* randomly, and (iv) the 70% symbol for gaming device 10*e* randomly, and so on.

In operation, one or more triggering event sets wheel 710 in motion. For example, one of the gaming devices 10 may trigger a bonus, which causes processor 38 of that machine 10 to send a signal via link 722 to server 720. Server 720 in turn commands wheel 710 to rotate. Server 720 in an embodiment also updates overhead displays 70 to show video and/or audio information informing each of the players playing system 700 that a bonus has been hit and wheel 710 is about to rotate. Displays 70 can inform which of the gaming devices has triggered the bonus. Also, indicator 60 (referring generally to one of indicators 60A to 60K) associated with the triggering gaming device can be lit or flashed (as discussed in the '404 application describing overhead display and individual gaming device display interaction in detail).

Assuming gaming device 10*i* triggers the bonus, for example, processor 38 of gaming device 10*i* sends a signal along link 722 to server 720. Processor 38 also causes display device 30, 32 (and/or speakers 36) of gaming device 10*i* to inform the player of gaming device 10*i* that the player has reached the shared wheel bonus. Server 720 updates overhead displays 70 and causes a motor or other motion control device located beneath wheel 710 to rotate the wheel. Wheel 710 rotates in a predefined or randomly defined manner until it stops. At that point, whichever symbol is located adjacent to indicator 60*i* of gaming device 10*i* is used to determine, at least in part, the bonus award provided to the player. If the symbol is an apportioning symbol 604, server 720 sends the associated percentage (fraction or decimal) and the currently displayed available amount to processor 38 of game 10*l*, which in turn calculates the player's award and updates credit displays 16 accordingly. Alternatively, server 720 calculates the player's award and sends that amount to processor 38 of gaming device 10*i*, which in turn updates credit display 16.

In the illustrated embodiment, section 712*i* stops in front of gaming device 10*i* and its associated indicator 60*i*. Section 712*i* shows the apportioning symbol 604 of 80%. That apportioning symbol 80% is multiplied by an available amount (e.g., shown on overhead displays 70, shared display 710 and/or on display devices 30, 32 of gaming devices 10) to form an award that is downloaded to gaming device 10*i* and updated on the credit meter 16. A player can then cash out via button 26 and retrieve the award or continue playing with its proceeds.

In one embodiment, if a single gaming device 10*a* to 10*k* triggers the bonus, only that gaming device receives any bonus award. In an alternative embodiment, any two or more or all gaming devices receive a bonus award even though only a single gaming device 10*a* to 10*k* has triggered the bonus condition. Here, the ability to pay more than one or all of the gaming devices 10 is made possible by varying the likelihood of triggering the bonus, the available amount and/or the percentages of apportioning symbols 604.

The size of the available amount can additionally or alternatively be scaled to meet the payback percentage requirements of system 700. For example, the available amount could be a relatively large award, such as $1000, which is apportioned to only one player, or a relatively small award, such as $100, which is apportioned to each active gaming device.

It should be appreciated that the amounts of the percentages, fractions or decimals of apportioning symbols 604 can additionally or alternatively be scaled to meet the payback percentage requirements of system 700. For example, the percentages could add to 450% (as shown in FIG. 15) when the available amount is apportioned to only one player, or the percentages could add to 100% or less when the available amount is apportioned to multiple players.

In one embodiment, the available amount is a progressive amount, which is built from an initial starting value and an accumulation of small percentages taken from the wagers of the players. The progressive amount keeps building until one of the gaming devices triggers the bonus. Here, the available amount can vary from one bonus to the next. The frequency of hitting the bonus controls the size of the available amount.

If the total possible award provided upon a spin of wheel 710 is less than or equal to the progressive amount (for example when (i) only the triggering player receives an award and the highest percentage is equal to or less than 100%, or (ii) multiple players win but the total percentage is equal to or less than 100%), then no additional funds are needed to pay for the bonus and bonus trigger hit frequency need not be considered in the overall payback equation.

If the total possible award provided upon a spin of wheel 710 can possibly be greater than the progressive amount (for example when (i) only the triggering player receives an award and the highest percentage is greater than 100% or (ii) multiple players win and total percentage is potentially greater than 100%), then additional funds may be needed to pay for the bonus.

In one example, a progressive available amount is built by accumulating 1% of each wager, the overall bonus trigger hit frequency is relatively high and the percentages on wheel 710 add to 100%. Each player or multiple players win a portion of the progressive amount as it exists at the time any of the played gaming device 10 triggers the bonus. Here, the game is exciting because each player can expect a bonus award after any spin of wheel 710.

Regardless of whether the available amount as contemplated herein is: (i) a jackpot award; (ii) a progressive award; (iii) a fixed award; (iv) a randomly determined award; (v) an award determined in a base game played on the gaming device by the player; (vi) an award determined in a bonus game played on the gaming device by the player; (vii) an award displayed by the shared outcome display; and/or (viii) an award determined by a separate processor running the shared outcome display, it is possible that some of the available amount will not be awarded. This can happen for example when: (i) only a single player wins and at least one of the percentages is less than 100%; and (ii) multiple players can win and obtain a total percentage from wheel 710 adding to less than 100%.

In one embodiment, the portion of the available amount not awarded to one or more player in one progressive embodiment is left in the pool as the starting point for the next progressive available amount. If for example only 70% of a $1000 pool is paid out after a spin of wheel 710, the available amount for the next bonus begins at $300.

The portion of the available amount not awarded to one or more player in one fixed amount embodiment is added to the fixed amount for the next available amount. If for example only 70% of a $1000 fixed amount is paid out after a spin of wheel 710, the available amount for the next bonus is set at $1300.

The portion of the available amount not awarded to one or more player in one random amount embodiment is added to the randomly determined amount for the next available amount. If for example only 70% of a $1000 randomly determined amount is paid out after a spin of wheel 710, the available amount for the next bonus is set at $300 plus whatever amount is randomly determined.

In an alternative embodiment, the house keeps a portion or all of any unused or non-paid portion of the available amount. Here, and in the case in which (i) the available amount is known or randomly determined from a finite set of values and (ii) only the triggering player wins an award, an expected outcome can be determined knowing the average percentage of the apportioning symbols 604 (and assuming each symbol is equally likely to be generated) and the known or averaged available amount. Knowing the expected amount makes the bonus predictable over time, enabling the bonus to be implemented into the overall payout percentage of system, and potentially enabling higher available amounts and/or higher average percentages for apportioning symbols 604. For example, if the average percentage is 60% and the average award is $500.00, than the average expected amount is $300.00, which is taken into account in the paytables.

As discussed previously, in one embodiment multiple players can win a portion of the available amount after one activation of shared display, wherein only portions of the amount generated in connection with active gaming devices are provided to the players. As used herein, active gaming devices may be ones which have a positive credit balance on credit display 16 or ones which have placed one or more wagers or played one or more base games within the specified period of time, as desired by the game implementers. It may be desirable to prevent players from (i) occupying multiple gaming devices or (ii) funding a gaming machine to carry a balance without playing the machine, in the hopes of increasing bonus award chances or amounts.

In an alternative embodiment, and in a situation in which the percentages collectively are equal to or less than 100%, it is contemplated to distribute any portion of the amount generated for non-active machines to the active machines based on the relative differences in the percentages generated for each of the gaming devices. For example, if the available amount is $1000, active gaming device 10*a* obtains 10%, active gaming device 10*d* obtains 15%, active gaming device 10*g* obtains 10%, active gaming device 10*j* obtains 5% and the remaining gaming devices 10 obtain the remaining 60%, the original available amount $1000 can be increased by dividing it by the total active percentage or 0.4, wherein the available amount now becomes $2500. Now, active gaming device 10*a* obtains 10% of $2500 or $250, active gaming device 10*d* obtains 15% of $2500 or $375, active gaming device 10*g* obtains 10% of $2500 or $250, and active gaming device 10*j* obtains 5% of $2500 or $125, totaling $1000. Here, the original available amount is guaranteed to be paid out completely. The percentages may be chosen to eliminate rounding payments or paying in fractions of a coin.

As discussed previously, in one embodiment a single player achieves a bonus triggering symbol in base game play, which triggers the shared display bonus and the spinning of wheel 710. It is also possible that multiple players achieve the bonus trigger within a relatively short timeframe. Here, the bonus spinning of wheel 710 can run consecutively for each player, in which case it is possible for only the triggering player to win an award or for multiple players to win an award.

Alternatively, a single spin of shared wheel 710 is made to generate an apportioned award for each player who has triggered the bonus. Here, it is preferable that only triggering players receive an apportioned award. The '404 application describes in detail multiple embodiments for enabling two players who trigger the bonus within a relatively short time span to play the same bonus. In general, the embodiments involve a countdown period before the next spin of the shared wheel during which a player may either opt-in or opt-out of the next bonus, depending on the embodiment.

As discussed previously, in one embodiment a player achieves a bonus triggering symbol in base game play, which triggers the shared display bonus and the spinning of wheel 710. It is also contemplated to trigger the shared wheel bonus: (i) via a random generation of a triggering condition by server 720; (ii) after a specified amount of game play by one or more of the players; and (iii) via a combination of base game results from the gaming devices played by the first and second players.

Depending upon the mode of triggering used, the shared display 710 may result in apportioned awards for a single player, select multiple players or all active players. For example, a bonus spin of shared display 710 triggered via a random generation of a triggering condition by server 720 could result in a bonus award for each active gaming device 10 since the bonus is not the result of play of any base game. A bonus spin of shared display 710 triggered via a specified amount of game play by one of the players could result in an award for that player only. A bonus spin of shared display 710 triggered via a specified amount of game play by multiple players could result in an award for those multiple players or all active players. A bonus spin of shared display 710 triggered via a combination of base game results from multiple gaming devices could result in an award for those multiple players or all active players.

Figure 16:
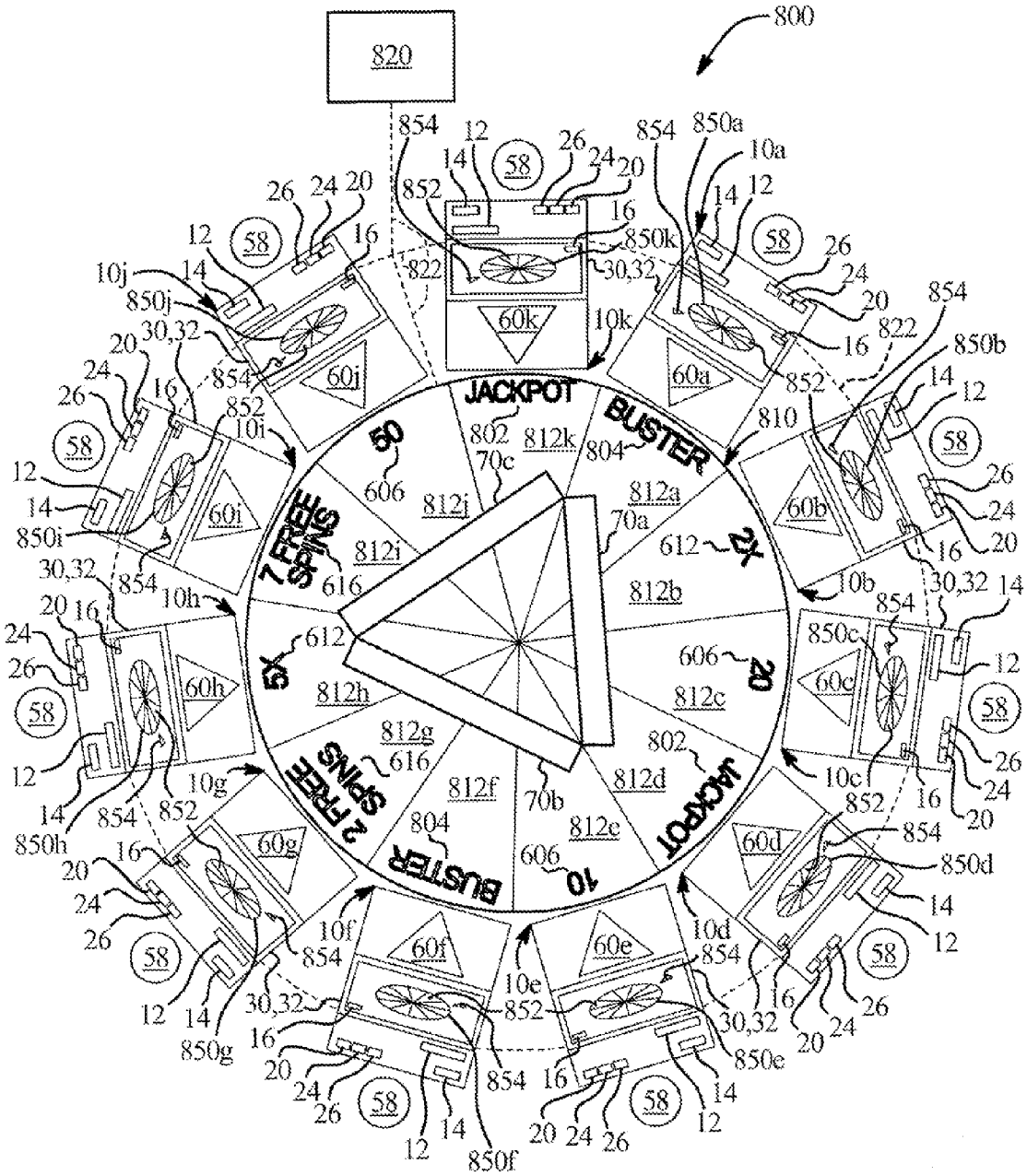
FIG. 16 is a top plan view of another embodiment of a system having multiple gaming devices and a shared outcome display configured to choose which of the gaming devices receives all or a portion of an available amount.

Referring now to FIG. 16, another embodiment of a multiplayer system employing any one of the wheel embodiments disclosed herein is shown by system 800 having a shared wheel 810. For ease of illustration, system 800 is shown using the apportioning symbols 604 of wheel 600. Any of the types of apportioning symbols 604 (percentages, fractions, decimals) may be used with system 800. Also, any of the different symbols and area or ring arrangements discussed above in connection with wheel 100, 200, 300, 400 or 500 may be used in connection with wheel 810.

Here, unlike with wheel 710, system 800 includes a shared outcome display or wheel 810, which shows credit symbols 606, multiplier symbols 612 and free spin symbols 616 shown above in connection with wheel 600. Credit symbols 606, multiplier symbols 612 and free spin symbols 616 are not apportioned or based on an available amount. The multipliers 612 as before can multiply any suitable base game quantity, such as total credits, total credits previously wagered, total credits won, total paylines played, total wager per payline, etc.

Additionally, wheel 810 shows jackpot or available amount symbols 802 and buster or pooper symbols 804. As illustrated, wheel 810 includes eleven sections 812*a* to 812*k*. A same number of gaming devices 10*a* to 10*k* is provided in system 800. In an alternative embodiment, wheel 810 includes more sections 812 (referring collectively to sections 812*a* to 812*k*) than gaming devices 10. Alternatively, wheel 810 can include less sections 812 than gaming devices 10.

Wheel 810 can be: (i) substantially horizontally disposed with gaming devices 10*a* to 10*k* spaced in roughly equal increments about shared display 810; (ii) at least substantially vertically disposed with gaming devices 10 provided in a semicircle about the vertically disposed wheel; or (iii) a large rotating reel or drum with a separate indicator. Overhead displays 70*a* to 70*c* are again located above wheel 810 and are provided in any suitable number and size so that each of the players system 800 can see at least one of overhead displays 70*a* to 70*c*.

For reference, each of the constituent gaming devices 10*a* to 10*k* in FIG. 15 shows coin slot 12 and bill acceptor 14, display device 30, 32, reels 34 (simulated or electromechanical), credit display 16, play button 20, bet one button 24 and cash out button 26. Gaming devices 10*a* to 10*k* can be of the low-profile type or otherwise as described above. Any of the wagering games described herein are suitable for system 800, such as, slot, poker, keno and/or blackjack. Each gaming device 10*a* to 10*k* includes a combination hand pay/shared display indicator 60*a* to 60*k*, respectively, as described above. Here, however, indicators 60*a* to 60*k* indicate awards or award amounts, such as a symbol representing the available amount, but not apportioning symbols 604, such as percentages.

In system 800, display device 30, 32 of each of gaming devices 10*a* to 10*k* include an apportioning wheel or outcome display 850*a* to 850*k*, respectively. Apportioning wheels 850*a* to 850*k* each include multiple sections 852. Sections 852 each display an apportioning symbol 604, such as a percentage, fraction or decimal. Apportioning wheels 850*a* to 850*k* each include an indicator 854 configured to indicate one of the apportioning symbols 604. Wheels 850*a* to 850*k* in an embodiment are simulated and displayed in place of reels 34 as needed to conserve space. Alternatively, wheels or reels 850*a* to 850*k* are electromechanical entities separate from the reels 34 or other type of base game apparatus.

As above, each gaming device 10*a* to 10*k* includes an individual processor 38, which is configured in a client-server communication relationship via a link 822 with a separate processor or server 820. Server 820 controls via link 822 the shared wheel 810 and one or more large overhead displays 70. Server 820 communicates information (any type described above) back and forth between the displays 70 and gaming devices 10 and information back and forth between wheel 810 and gaming devices 10 for messaging, updating credits and tracking play as described above. Separate server 820 runs one or more ROG programs, which determines the random outcomes displayed by shared display 810. In one embodiment, the ROG program is independent of any run by processors 38 of individual gaming devices 10.

As before, server 820 knows the fixed relationship between each of the symbols of the sections 812. In the illustrated example, server 820 is programmed to know that the jackpot symbol 802 shown in section 812*d* is located one section clockwise from the twenty credit symbol 606 shown in section 812*c*, which is located one section clockwise from the 2× multiplier symbol 612 shown in section 812*b*, which in turn is located one section clockwise from the buster symbol 804 shown in section 812*a*, and so on.

It should therefore be appreciated that if server 820 generates one of the symbols randomly for gaming device 10*a*, for example, the fixed relationship between the symbols enables server 820 to know the symbols generated randomly for each of gaming devices 10*b* to 10*k* also. That is, if the ROG program of server 820 generates buster symbol 804 randomly for gaming device 10*a*, the ROG program server 720 also generates: (i) the 2× multiplier for gaming device 10*b* randomly, (ii) the twenty credits for gaming device 10*c* randomly, (iii) the jackpot symbol 802 for gaming device 10*d* randomly, and (iv) the ten credits for gaming device 10*e* randomly, and so on.

In operation, one or more triggering event sets wheel 810 in motion. For example, one of the gaming devices 10 may trigger a bonus, which causes processor 38 of that machine 10 to send a signal via link 822 to server 820. Server 820 in turn commands wheel 810 to rotate. Server 820 in an embodiment also updates overhead displays 70 to show video and/or audio information informing each of the players playing system 800 that a bonus has been hit and wheel 810 is about to rotate. Displays 70 can inform which of the gaming devices has triggered the bonus. Also, indicator 60 associated with the triggering gaming device can be lit or flashed.

Assuming gaming device 10*k* triggers the bonus, for example, processor 38 of gaming device 10*k* sends a signal along link 822 to server 820. Processor 38 also causes display device 30, 32 (and/or speakers 36) of gaming device 10*k* to display wheel 850*k* and inform the player of gaming device 10*k* that the player has reached the shared wheel bonus. Server 820 updates overhead displays 70 and causes a motor or other motion control device located beneath wheel 810 to rotate the wheel. Wheel 810 rotates in a predefined or randomly defined manner until it stops. At that point, whichever symbol is located adjacent to indicator 60*k* of gaming device 10*k* is used to determine, at least in part, the bonus award provided to the player.

If the symbol is a credit symbol 606, the player receives the number of credits. If the symbol is an apportioning symbol 604, server 820 in one embodiment sends a message to processor 38 of gaming device 10*k* to spin wheel 850*k* to generate an apportioning symbol 604. Server 820 may also send the available amount of the jackpot award 802 to processor 38. Alternatively, processor 38 may already know such amount. Alternatively, only server 820 may know the available amount.

Once processor 38 of gaming device 10*k* generates and displays the apportioning symbol 604 (which may alternatively or additionally be displayed on any one or more of overhead displays 70): (i) the apportioning percentage is sent to server 820, which multiplies the available amount by the percentage to determine the award for the player of gaming device 10*k*; or (ii) processor 38 multiplies the available amount by the percentage to determine the award for the player of gaming device 10*k*, which may or may not be sent to server 820 to display on any one or more of overhead displays 70.

In the illustrated embodiment, section 812*k* stops in front of gaming device 10*k* and its associated indicator 60*k*. Section 812*k* shows the jackpot symbol 802, which indicates that the player will receive a portion of the jackpot or available amount. Wheel 850*k* of gaming device 10*k* spins, wherein indicator 854 indicates an apportioning symbol 604 of, for example 60%. That apportioning symbol 60% is multiplied by an available amount (e.g., $1000 shown on overhead displays 70, shared display 810 and/or on display devices 30, 32 of gaming devices 10) to form an award of $600 that is updated on credit meter 16 of gaming device 10*k*. A player can cash out via button 26 and retrieve the award or continue playing with its proceeds.

In the embodiment just described, gaming device 10*k* determines the apportioning percentage after receiving the jackpot apportioning symbol 802 from the shared wheel bonus spin. In alternative embodiments, any one or more or all of the apportioning wheels 850*a* to 850*k* of gaming devices 10*a* to 10*k*, respectively, determine their respective percentages before or simultaneously with the spinning of shared wheel 810.

In one embodiment, if a single gaming device 10*a* to 10*k* triggers the bonus, only that gaming device receives any bonus award. In an alternative embodiment, any two or more or all gaming devices receive a bonus award even though only a single gaming device 10*a* to 10*k* has triggered the bonus condition. As described in detail above, the ability to pay more than one or all of the gaming devices 10 is made possible by varying the likelihood of triggering the bonus, the available amount and/or the percentages of apportioning symbols 604.

Wheel 810 as illustrated is configured such that if all gaming devices 10*a* to 10*k* are awarded from the shared display bonus, only two gaming devices receive the apportioned jackpot award, two gaming devices receive multiplier awards, three gaming devices receive outright credit awards, two gaming devices receive free spins and two gaming devices receive the buster symbol or no award. Wheel 810 is alternatively configured to have any desirable relative amount of: (i) at least one jackpot symbol 802 or all jackpot symbols; (ii) none, one or more buster symbols 804; (iii) none, one or more credit symbols 606; (iv) none, one or more multiplier symbols 612; and (iv) none, one or more free spin symbols 616.

In one embodiment, the available amount is a progressive amount as has been described above. The progressive amount keeps building until one of the gaming devices triggers the bonus. Here, the available amount can vary from one bonus to the next. The frequency of hitting the bonus controls the size of the available amount.

In one embodiment, if the total possible award provided upon a spin of individual game wheels 850*a* to 850*k* is less than or equal to the progressive amount (for example when (i) only the triggering player receives an award and the highest percentage on the player's wheel 850 (referring generally to one of the wheels 850*a* to 850*k*) is equal to or less than 100% or (ii) multiple players win but total possible percentage from multiple wheels 850 is equal to or less than 100%), no additional funds are needed to pay for the bonus and bonus trigger hit frequency need not be considered in the overall payback equation.

If the total possible award provided upon a spin of one or more wheel 850 can possibly be greater than the progressive amount (for example when (i) only the triggering player receives an award and the highest percentage on the gaming device wheel 850 is greater than 100% or (ii) multiple players win and total percentage from wheels 850 is potentially greater than 100%), additional funds may be needed to pay for the bonus.

In one example, a progressive available amount is built by accumulating 10% of each wager of each wager. Overall bonus trigger hit frequency is relatively low and the percentages on each wheel 850 average at least approximately (1/number of participating gaming devices) times 100%. Shared wheel 810 is structured such that each player or multiple players win a portion of the progressive amount as it exists at the time any gaming device 10 triggers the bonus. Here, the game is exciting because each player can expect a bonus award after each and every spin of shared wheel 810.

As with system 700, it is possible that some of the available amount will not be awarded upon a bonus spin of shared wheel 810. This can happen for example when: (i) only a single player wins and at least one of the percentages on the player's wheel 850 is less than 100%; and (ii) multiple players can win and obtain a total percentage from participating wheels 850 adding to less than 100%.

In one embodiment discussed above, the portion of the available amount not awarded to one or more player in one progressive embodiment is left in the pool as the starting point for the next progressive available amount. Likewise, the portion of the available amount not awarded to one or more player in one fixed amount embodiment can be added to the fixed amount for the next available amount. Further, the portion of the available amount not awarded to one or more player in a randomly determined available amount embodiment can be added to the randomly determined amount for the next available amount. Still further, the house can keep a portion or all of any unused or non-paid portion of the available amount.

As discussed previously, in one embodiment only active gaming devices are eligible for winning a portion of the available amount in one embodiment. In an alternative embodiment described above with system 700, and in a situation in which the percentages collectively are equal to or less than 100%, it is contemplated to distribute any portion of the amount generated for non-active machines to the active machines based on the relative differences in the percentages generated for each of the gaming devices to guaranteed that the available amount is paid out completely upon a spin of wheels 810 and 850.

As with system 700, it is also possible in system 800 that multiple players achieve the bonus trigger within a relatively short timeframe. Here, the bonus spinning of wheels 810 and 850 can run consecutively for each player. Alternatively, a single spin of shared wheels 810 and 850 is made to generate an apportioned award for each player who has triggered the bonus according to the '239 application.

In one embodiment a player achieves a bonus triggering symbol in base game play, which triggers the shared display bonus and the spinning of shared wheel 810 and individual wheel(s) 850. It is also contemplated to trigger the shared wheel bonus: (i) via a random generation of a triggering condition by server 820; (ii) after a specified amount of game play by one or more of the players; and (iii) via a combination of base game results from the gaming devices played by the first and second players. Depending upon the mode of triggering used, the shared display 810 may result in apportioned awards for a single player, select multiple players or all active players.

Figure 17:
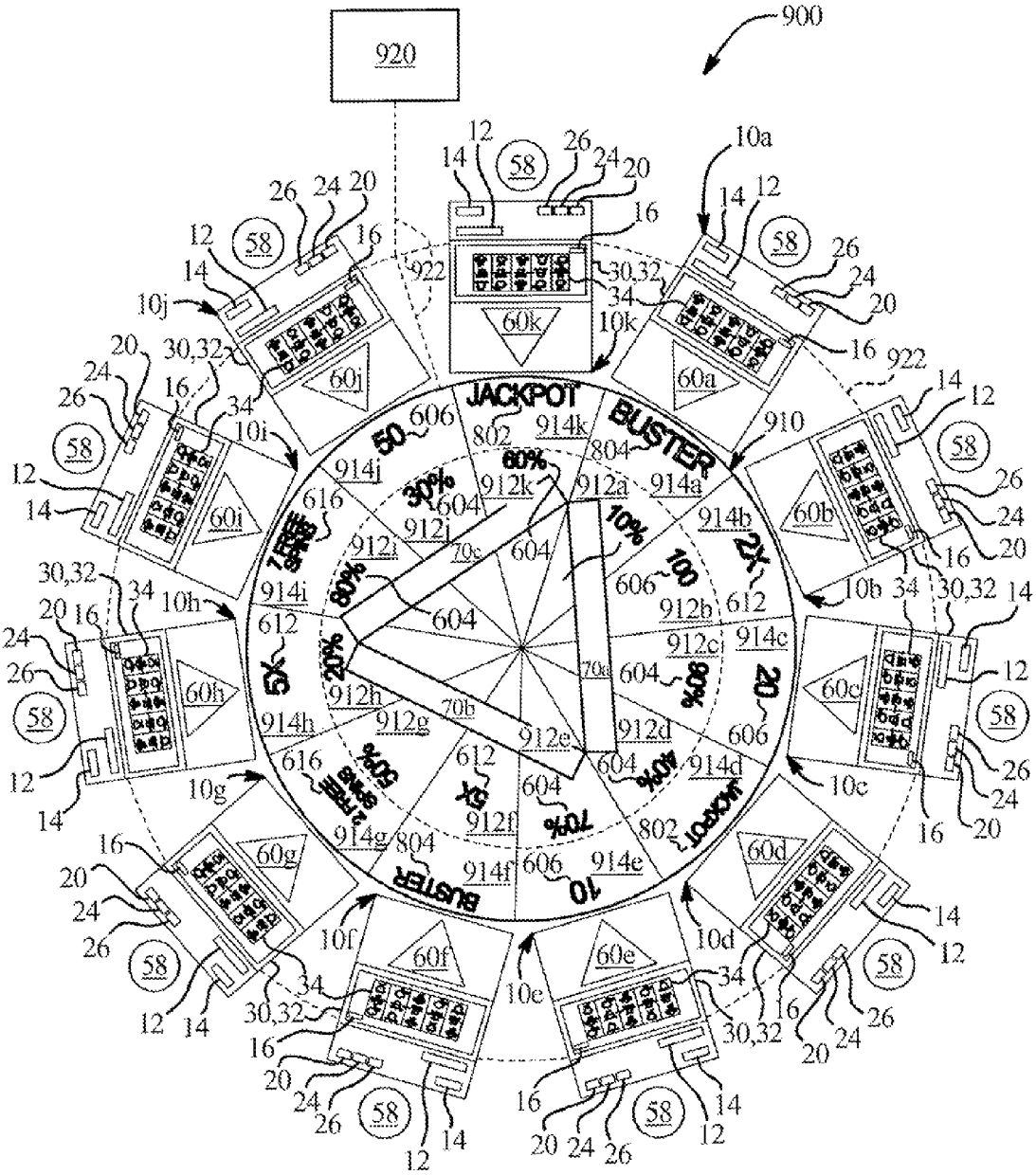
FIG. 17 is a top plan view of a further embodiment of a system having multiple gaming devices and a shared outcome display, which is configured to indicate a portion of an available amount that can be provided to a player and symbols indicating which of the plurality of gaming devices receives the portion of the available amount.

Referring now to FIG. 17, another embodiment of a multiplayer system employing any one of the wheel embodiments disclosed herein is shown by system 900 having a shared wheel 910. For ease of illustration, system 900 is shown using the apportioning symbols 604 of wheel 600. Any of the types of apportioning symbols 604 (percentages, fractions, decimals) may be used with system 900. Also, any of the different symbols and area or ring arrangements discussed above in connection with wheel 100, 200, 300, 400 or 500 may be used in connection with wheel 910.

Here, unlike with wheels 710 and 810, system 900 includes a shared outcome display or wheel 910, which has credit symbols 606, multiplier symbols 612 and free spin symbols 616 in an outer generation ring. Credit symbols 606, multiplier symbols 612 and free spin symbols 616 are not apportioned or based on an available amount. The multipliers 612 as before can multiply any suitable base game quantity, such as total credits, total credits previously wagered, total credits won, total paylines played, total wager per payline, etc. Additionally, the outer ring of wheel 910 shows jackpot or available amount symbols 802 and buster or pooper symbols 804.

Wheel 910 also includes an inner generation ring having apportioning symbols 604 (and potentially only apportioning symbols 604) and possibly one or more credit symbol 606, multiplier symbol 612 and free spin symbol 616. The outer and inner rings operate independently with respect to each other as described above in connection with wheel 500 and FIG. 13.

As illustrated, the inner ring of wheel 910 includes eleven sections 912*a* to 912*k*. The outer ring of wheel 910 includes eleven sections 914*a* to 914*k*. A same number of gaming devices 10*a* to 10*k* is provided in system 900. In an alternative embodiment, wheel 910 includes more sections 912 and 914 (referring collectively to sections 912*a* to 912*k* and 914*a* to 914*k*, respectively) than gaming devices 10. Alternatively, wheel 910 can include less sections 912 and 914 than gaming devices 10.

Wheel 910 can be: (i) substantially horizontally disposed with gaming devices 10*a* to 10*k* spaced in roughly equal increments about shared display 910; (ii) at least substantially vertically disposed with gaming devices 10 provided in a semicircle about the vertically disposed wheel; or (iii) a large rotating reel or drum with a separate indicator. Overhead displays 70*a* to 70*c* are again located above wheel 910 and are provided in any suitable number and size so that each of the players system 900 can see at least one of overhead displays 70*a* to 70*c*.

For reference, each of the constituent gaming devices 10*a* to 10*k* in FIG. 15 shows coin slot 12 and bill acceptor 14, display device 30, 32, reels 34 (simulated or electromechanical), credit display 16, play button 20, bet one button 24 and cash out button 26. Gaming devices 10*a* to 10*k* can be of the low-profile type or otherwise as described above. Any of the wagering games described herein are suitable for system 900, such as, slot, poker, keno and/or blackjack. Each gaming device 10*a* to 10*k* includes a combination hand pay/shared display indicator 60*a* to 60*k*, respectively, as described above. Here, however, indicators 60*a* to 60*k* indicate awards or award amounts, such as a symbol representing the available amount, and also the apportioning symbols 604, such as percentages.

Server 920 knows the fixed relationship between each of the symbols of each of the rings of sections 912 and 914. In the illustrated example, server 920 is programmed to know that in the outer ring: (i) the jackpot symbol 802 shown in section 914*d* is located one section clockwise from the twenty credit symbol 606 shown in section 914*c*; (ii) which is located one section clockwise from the 2× multiplier symbol 612 shown in section 914*b*; (iii) which in turn is located one section clockwise from the buster symbol 804 shown in section 914*a*, and so on.

Furthermore, in the illustrated example, server 920 is programmed to know that in the inner ring: (i) the 40% apportioning symbol 604 shown in section 912*d* is located one section clockwise from the 90% apportioning symbol 604 shown in section 912*c*; (ii) which is located one section clockwise from the 100 credit symbol 606 shown in section 912*b*; (iii) which in turn is located one section clockwise from the 10% apportioning symbol 604 shown in section 912*a*, and so on.

It should therefore be appreciated that if server 920 generates one of the symbols randomly for gaming device 10*a*, for example, the fixed relationship between the symbols of the rings enables server 920 to know the like symbols generated randomly for each of gaming devices 10*b* to 10*k* also. That is, if for the outer ring the ROG program of server 920 generates buster symbol 804 randomly for gaming device 10*a*, the ROG program server 920 also generates: (i) the 2× multiplier for gaming device 10*b* randomly, (ii) the twenty credits for gaming device 10*c* randomly, (iii) the jackpot symbol 802 for gaming device 10*d* randomly, and (iv) the ten credits for gaming device 10*e* randomly, and so on.

Further, if for the inner ring the ROG program of server 920 generates the 10% apportioning symbol 604 randomly for gaming device 10*a*, the ROG program server 920 also generates: (i) 100 credits for gaming device 10*b* randomly, (ii) the 90% symbol for gaming device 10*c* randomly, (iii) the 40% symbol for gaming device 10*d* randomly, and (iv) the 70% symbol for gaming device 10*e* randomly, and so on.

In operation, one or more triggering event sets wheel 910 in motion. For example, one of the gaming devices 10 may trigger a bonus, which causes processor 38 of that machine 10 to send a signal via link 922 to server 920. Server 920 in turn commands wheel 910 to rotate. Server 920 in an embodiment also updates overhead displays 70 to show video and/or audio information informing each of the players playing system 900 that a bonus has been hit and wheel 910 is about to rotate. Displays 70 can inform which of the gaming devices has triggered the bonus. Also, indicator 60 associated with the triggering gaming device can be lit or flashed.

Assuming gaming device 10*d* triggers the bonus, for example, processor 38 of gaming device 10*d* sends a signal along link 822 to server 920. Processor 38 also causes display device 30, 32 (and/or speakers 36) of gaming device 10*d* to inform the player of gaming device 10*d* that the player has reached the shared wheel bonus. Server 920 updates overhead displays 70 and causes a motor or other motion control device located beneath wheel 910 to rotate the wheel. Wheel 910 (and wheels 710 and 810) is alternatively simulated on a large one or more video monitor. In any event, the rings of wheel 910 rotates independently in a suitable defined manner until they stop. At that point, whichever sections 912 and 914 are located adjacent to indicator 60*d* of gaming device 10*d* is used to determine, at least in part, the bonus award provided to the player.

If the symbol in the outer ring is a credit symbol 606, the player receives the number of credits modified potentially by an apportioning symbol 604 or a multiplier symbol 612. If the symbol in the outer ring is a jackpot symbol 802, the player receives the available amount of the jackpot modified potentially by an apportioning symbol 604 or a multiplier symbol 612. In an embodiment, sections 912 of the inner ring only display apportioning symbols 604 so that any corresponding credit amount is lessened or held the same (if symbol 604 is 100%). The inner and outer rings in an embodiment does not display free spin symbols 616 or multiplier symbols 612 to avoid having to potentially provide a portion of a free spin or multiplier. However, it is contemplated to set the number free spins and the multipliers such that the may be evenly divisible by any displayed apportioning symbol 604, in which case the player receives the portioned spins or multiplier.

After the wheel 910 displays the symbols of the inner an outer reels and server 920 calculates the player's award and sends the award to the appropriate game processor 38. In the illustrated embodiment, sections 912*d* and 914*d* stop in front of gaming device 10*d* and its associated indicator 60*d*. Section 914*d* shows the jackpot symbol 802, which indicates that the player will receive a portion of the jackpot or available amount. Section 912*d* indicates the apportioning symbol 604 of 40%. That apportioning symbol 40% is multiplied by an available amount (e.g., $1000 shown on overhead displays 70, shared display 910 and/or on display devices 30, 32 of gaming devices 10) to form an award of $400 that is updated on credit meter 16 of gaming device 10*d*.

In the embodiment just described, wheel 910 spins inner and outer rings at least substantially simultaneously. In alternative embodiments, wheel 910 spins one of inner and outer rings partially or completely before spinning the other.

In one embodiment, if a single gaming device 10*a* to 10*k* triggers the bonus, only that gaming device receives any bonus award. In an alternative embodiment, any two or more or all gaming devices receive a bonus award even though only a single gaming device 10*a* to 10*k* has triggered the bonus condition. As described in detail above, the ability to pay more than one or all of the gaming devices 10 is made possible by varying the likelihood of triggering the bonus, the available amount and/or the percentages of apportioning symbols 604.

The outer ring of section 914 of wheel 910 as illustrated is configured such that if all gaming devices 10*a* to 10*k* are awarded from the shared display bonus, only two gaming devices receive the apportioned jackpot award 802. The outer ring of section 914 of wheel 910 is alternatively configured to have any desirable relative amount of: (i) at least one jackpot symbol 802 or all jackpot symbols; (ii) none, one or more buster symbols 804; (iii) none, one or more credit symbols 606; (iv) none, one or more multiplier symbols 612; and (iv) none, one or more free spin symbols 616.

In one embodiment, the available amount is a progressive amount as has been described above. The progressive amount keeps building until one of the gaming devices triggers the bonus. Here, the available amount can vary from one bonus to the next. The frequency of hitting the bonus controls the size of the available amount.

In one embodiment, if the total possible award provided upon a spin of the rings of wheel 910 is less than or equal to the progressive amount (for example when (i) only the triggering player receives an award and the highest percentage on the inner ring wheel is equal to or less than 100% or (ii) multiple players win but total possible percentage the inner ring is equal to or less than 100%), no additional funds are needed to pay for the bonus and bonus trigger hit frequency need not be considered in the overall payback equation.

In one embodiment, if the total possible award provided upon a spin of the inner ring of wheel 910 can possibly be greater than the progressive amount (for example when (i) only the triggering player receives an award and the highest percentage on the inner ring of wheel 910 greater than 100% or (ii) multiple players win and total percentage from the inner ring is potentially greater than 100%), additional funds may be needed to pay for the bonus.

In one example, a progressive available amount is built from a starting amount by accumulating 1% of each wager of each wager. Overall bonus trigger hit frequency is relatively low and the percentages on the inner ring of wheel 910 total 100%. Shared wheel 910 is thereby structured such that each player or multiple players win a portion of the progressive amount as it exists at the time any gaming device 10 triggers the bonus. Here, the game is exciting because each player can expect a bonus award after each and every spin of shared wheel 910.

As with systems 700 and 800, it is possible that some of the available amount will not be awarded upon a bonus spin of shared wheel 910. This can happen for example when: (i) only a single player wins and at least one of the percentages on the inner ring of sections 912 on wheel 910 is less than 100%; and (ii) multiple players can win and obtain a total percentage from the inner ring of sections 912 on wheel 910 less than 100%.

In one embodiment discussed above, the portion of the available amount not awarded to one or more player in one progressive embodiment is left in the pool as the starting point for the next progressive available amount. Likewise, the portion of the available amount not awarded to one or more player in one fixed amount embodiment can be added to the fixed amount for the next available amount. Further, the portion of the available amount not awarded to one or more player in a randomly determined available amount embodiment can be added to the randomly determined amount for the next available amount. Still further, the house can keep a portion or all of any unused or non-paid portion of the available amount.

As discussed previously, in one embodiment only active gaming devices are eligible for winning a portion of the available amount in one embodiment. In an alternative embodiment described above with systems 700 and 800, and in a situation in which the percentages collectively are equal to or less than 100%, it is contemplated to distribute any portion of the amount generated for non-active machines to the active machines based on the relative differences in the percentages generated for each of the gaming devices to guaranteed that the available amount is paid out completely upon a spin of wheel 910.

As with systems 700 and 800, it is also possible in system 900 that multiple players achieve the bonus trigger within a relatively short timeframe. Here, the bonus spinning of the rings of wheel 910 can run consecutively for each player. Alternatively, a single spin of shared wheel 910 is made to generate an apportioned award for each player who has triggered the bonus according to the '404 application.

In one embodiment a player achieves a bonus triggering symbol in base game play, which triggers the shared display bonus and the spinning of shared wheel 910. It is also contemplated to trigger the shared wheel bonus: (i) via a random generation of a triggering condition by server 920; (ii) after a specified amount of game play by one or more of the players; and (iii) via a combination of base game results from the gaming devices played by the first and second players. Depending upon the mode of triggering used, the shared display 910 may result in apportioned awards for a single player, select multiple players or all active players.

It should be appreciated that in various embodiments, the percentage selected can be applied to a group of awards such as a plurality of progressive awards (or such as a multi-level progressive) and the percentage would be applied to one or more of such awards in the group to determine awards for one or more players of the gaming devices.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming system comprising:

a first gaming device having a first game operable upon a wager;

a second gaming device having a second game operable upon a wager;

a first display controlled by at least one processor; and an outcome display controlled by the at least one processor and shared by the first and second gaming devices, the outcome display including a plurality of displayed symbols, at least two of said symbols being different and each of said symbols having a displayed predetermined relationship to each other symbol of said plurality of displayed symbols, wherein for each occurrence of a designated triggering event on the first gaming device, the at least one processor is programmed to operate with the first display and the outcome display to:

(a) activate the outcome display, (b) display an available amount on the first display, said available amount being greater than zero, (c) randomly determine a first one of the symbols, (d) cause an indication of the first symbol, (e) cause the first symbol in combination with the available amount to mathematically define a first portion of the available amount to be displayed and provided to a player of the first gaming device, (f) determine a second one of the symbols based on the displayed predetermined relationship between the first symbol and the determined second symbol, (g) cause an indication of the second symbol, (h) cause the second symbol in combination with the available amount to mathematically define a second portion of the available amount to be displayed and provided to a player of the second gaming device, (i) cause each of the first and second portions to be greater than zero and less than one hundred percent of the available amount, and (j) deactivate the outcome display.

2. The gaming system of claim 1, wherein the displayed symbols of the outcome display are of a type selected from the group consisting of: percentages, factors and numbers less than one.

3. The gaming system of claim 1, wherein the available amount is of at least one type selected from the group consisting of:

(i) a jackpot amount;

(ii) a progressive amount;

(iii) a static amount;

(iv) a randomly determined amount;

(v) an amount determined in a base game played on one of the gaming devices;

(vi) an amount determined in a bonus game played on one of the gaming devices;

(vii) an amount determined at least partially by the outcome display; and (viii) an amount determined at least partially by the at least one processor controlling the first display and the outcome display.

4. The gaming system of claim 1, which is configured to randomly select the displayed available amount from a plurality of available amounts, at least two of said available amounts being different.

5. The gaming system of claim 4, wherein the plurality of available amounts have at least one characteristic selected from the group consisting of:

(i) being progressive amounts;

(ii) being preset;

(iii) being displayed on the outcome display;

(iv) being displayed on the first display; and (v) being displayed on the first and second gaming devices.

6. The gaming system of claim 1, wherein the displayed available amount is a first available amount, and which is configured to determine a second available amount after the portions of the first available amount are provided to the players, the second available amount including at least the portion of the first available amount not provided to the players.

7. The gaming system of claim 1, wherein the outcome display is of a type selected from the group consisting of:

(i) a horizontally disposed wheel positioned adjacent to the first and second gaming devices;

(ii) a vertically disposed wheel positioned adjacent to the first and second gaming devices;

(iii) an overhead video monitor viewable from the first and second gaming devices; and (iv) a reel positioned adjacent to the first and second gaming devices.

8. The gaming system of claim 1, wherein a sum of all of the symbols equals or is substantially equal to 100%.

9. The gaming system of the claim 1, wherein a sum of all of the displayed symbols of the outcome display equals or is substantially equal to 100%.

10. The gaming system of claim 1, wherein at least one coordinate corresponds to each of the displayed symbols of the outcome display, and the displayed symbols of the outcome display are selected by selecting at least one of the coordinates.

11. The gaming system of claim 1, wherein the designated triggering event is selected from the group consisting of:

(i) a random generation of a triggering condition by the at least one processor controlling the first display and the outcome display;

(ii) a random generation of a triggering condition by the first gaming device;

(iii) random generations of triggering conditions by the first gaming device and by the second gaming device;

(iv) a specified amount of game play on one of the first and second gaming devices;

(v) a specified amount of game play on both of the first and second gaming devices; and (vi) a combination of base game results from the first and second gaming devices.

12. The gaming system of claim 1, wherein the outcome display is configured to indicate at least one of game credits, game credit modifiers and free spins as potential alternative awards.

13. The gaming system of claim 1, wherein the available amount is displayed on the first display and at least one of:

(i) the outcome display; and (ii) the first and second gaming devices.

14. The gaming system of claim 1, wherein each gaming device includes a game processor, and wherein the at least one processor which controls the first display and the outcome display is separate from the game processors.

15. The gaming system of claim 1, wherein at least one of the games operable upon a wager is selected from the group consisting of: slot, poker, keno and blackjack.

16. The gaming system of claim 1, which includes a third gaming device having a third game operable upon a wager, wherein for each occurrence of the designated triggering event on the first gaming device, the at least one processor is programmed to:

(a) cause a third one of the symbols in combination with the available amount to mathematically define a third portion of the available amount to be displayed and provided to a player of the third gaming device, and (b) cause the third portion to be one hundred percent of the available amount.

17. The gaming system of claim 1, wherein the displayed predetermined relationship between each symbol of said plurality of displayed symbols is a spatial relationship.

18. A gaming system comprising: a plurality of gaming devices each having a game operable upon a wager and a designated triggering event in said game;

a first display controlled by at least one processor; and an outcome display controlled by the at least one processor and shared by at least two of the gaming devices, the outcome display including multiple displayed symbols, at least two of said symbols being different, and each of said symbols having a displayed predetermined relationship to each other symbol of said plurality of displayed symbols wherein for each occurrence of one of the designated triggering events on the first gaming device, the at least one processor is programmed to operate with the first display and the outcome display to:

(a) activate the outcome display, (b) display an available amount on the first display, said available amount being greater than zero, (c) randomly determine a first one of the symbols, (d) cause an indication of the first symbol, (e) cause the first symbol in combination with the available amount to mathematically define a portion of the available amount to be displayed and provided to a player of a first actively played gaming device in a designated period relative to the occurrence of said designated triggering event, (f) for each remaining actively played gaming device in the designated period:

(i) determine an additional one of the symbols based on the displayed predetermined relationship between the first symbol and said additional symbol, (ii) cause an indication of said additional symbol, and (iii) cause said additional symbol in combination with the available amount to mathematically define a portion of the available amount to be displayed and provided to a player of said actively played gaming device, (g) cause each portion for each actively played gaming device to be greater than zero, (h) cause at least one of the portions to be less than one hundred percent of the available amount, and (i) deactivate the outcome display.

19. The gaming system of claim 18, wherein the displayed symbols of the outcome display are of a type selected from the group consisting of: percentages, factors and numbers less than one.

20. The gaming system of claim 18, wherein the available amount is of at least one type selected from the group consisting of:

(i) a jackpot amount;

(ii) a progressive amount;

(iii) a static amount;

(iv) a randomly determined amount;

(v) an amount determined in a base game played on one of the gaming devices;

(vi) an amount determined in a bonus game played on one of the gaming devices;

(vii) an amount determined at least partially by the shared outcome display; and (viii) an amount determined at least partially by the at least one processor controlling the first display and the outcome display.

21. The gaming system of claim 18, which is configured to randomly select the available amount from a plurality of available amounts, at least two of said available amounts being different.

22. The gaming system of claim 21, wherein the plurality of available amounts have at least one characteristic selected from the group consisting of:

(i) being progressive amounts;

(ii) being preset;

(iii) being displayed on the outcome display;

(iv) being displayed on the first display; and (v) being displayed on the first and second gaming devices.

23. The gaming system of claim 18, wherein the available amount is a first available amount, and which is configured to determine a second available amount after the portions of the first available amount are provided to the players, the second available amount including at least the portion of the first available amount not provided to the players.

24. The gaming system of claim 18, wherein the outcome display is of a type selected from the group consisting of:

(i) a horizontally disposed wheel positioned adjacent to the first and second gaming devices;

(ii) a vertically disposed wheel positioned adjacent to the first and second gaming devices;

(iii) an overhead video monitor viewable from at least two of the gaming devices; and (iv) a reel positioned adjacent to at least two of the gaming devices.

25. The gaming system of claim 18, wherein the available amount is displayed on the first display and at least one of:

(i) the outcome display; and (ii) at least two of the gaming devices.

26. The gaming system of claim 18, wherein each gaming device includes a game processor, and wherein the at least one processor which controls the first display and the outcome display is separate from the game processors.

27. The gaming system of claim 18, wherein at least one of the games operable upon a wager is selected from the group consisting of: slot, poker, keno and blackjack.

28. The gaming system of claim 18, wherein for each occurrence of the designated triggering event on the first gaming device, the at least one processor is programmed to cause at least one of the portions to be one hundred percent of the available amount.

29. The gaming system of claim 18, wherein the displayed predetermined relationship between each symbol of said plurality of displayed symbols is a spatial relationship.

* * * * *